US007036195B2

(12) United States Patent
Glass

(10) Patent No.: US 7,036,195 B2
(45) Date of Patent: May 2, 2006

(54) APPARATUS AND METHODS OF BURIAL USING A COLUMBARIUM POD

(75) Inventor: Robert L. Glass, Gig Harbor, WA (US)

(73) Assignee: Haven of Rest, Gig Harbor, WA (US)

( * ) Notice: Subject to any disclaimer, the term of this patent is extended or adjusted under 35 U.S.C. 154(b) by 147 days.

(21) Appl. No.: 10/646,127

(22) Filed: Aug. 22, 2003

(65) Prior Publication Data

US 2004/0098846 A1 May 27, 2004

Related U.S. Application Data

(60) Provisional application No. 60/405,481, filed on Aug. 23, 2002.

(51) Int. Cl.
*A61G 17/00* (2006.01)

(52) U.S. Cl. ..... 27/1; 27/35; 52/131; 52/133; 52/136

(58) Field of Classification Search ..... 27/1, 27/35; 52/103, 133, 134, 136, 137, 131; 40/124.5

See application file for complete search history.

(56) References Cited

U.S. PATENT DOCUMENTS

| | | | | |
|---|---|---|---|---|
| 3,581,452 | A * | 6/1971 | Jalbert | 52/133 |
| 3,726,052 | A * | 4/1973 | Thompson | 52/103 |
| 3,732,602 | A | 5/1973 | Vigh | |
| 3,898,718 | A | 8/1975 | Eubank | |
| 3,940,894 | A | 3/1976 | Nunes | |
| 4,328,606 | A * | 5/1982 | Nunes | 27/35 |
| 4,607,417 | A * | 8/1986 | Hancovsky | 27/1 |
| 4,614,066 | A | 9/1986 | Koppenberg | |
| 4,893,385 | A | 1/1990 | Schrag | |
| 4,977,652 | A * | 12/1990 | Graham | 27/1 |
| 5,195,812 | A | 3/1993 | Eickhof | |
| 5,261,199 | A | 11/1993 | Schmidt | |
| 5,692,344 | A | 12/1997 | Zarth | |
| 5,740,637 | A * | 4/1998 | Snow | 52/136 |
| 5,960,524 | A * | 10/1999 | Darby et al. | 27/35 |
| 6,055,793 | A | 5/2000 | Irwin et al. | |
| 6,161,268 | A | 12/2000 | Joseph | |
| 6,167,600 | B1 | 1/2001 | Williams et al. | |
| 6,250,025 | B1 | 6/2001 | Darby | |
| 6,421,890 | B1 | 7/2002 | Biggar | |
| 6,904,721 | B1 * | 6/2005 | Forbes | 52/103 |
| 2002/0144383 | A1 * | 10/2002 | Spence | 27/35 |

FOREIGN PATENT DOCUMENTS

| | | |
|---|---|---|
| WO | WO 99/42685 | 8/1999 |
| WO | WO 00/34126 | 6/2000 |

* cited by examiner

*Primary Examiner*—William L. Miller
(74) *Attorney, Agent, or Firm*—Black Lowe & Graham PLLC

(57) ABSTRACT

Apparatus and methods of burial using a columbarium pod are disclosed. In one embodiment, a burial system includes a water ballast control system, a stabilizing system, an identification system, a position registration system, and a mapping system. The system may include a plurality of tubes, each tube configured to store a plurality of containers, each container retrievable after burial. The plurality of containers may include, for example, a cremation urn container, and one or more additional containers that store DNA-based biological material of the deceased, memorial materials or the like.

38 Claims, 38 Drawing Sheets

Fig. 18A
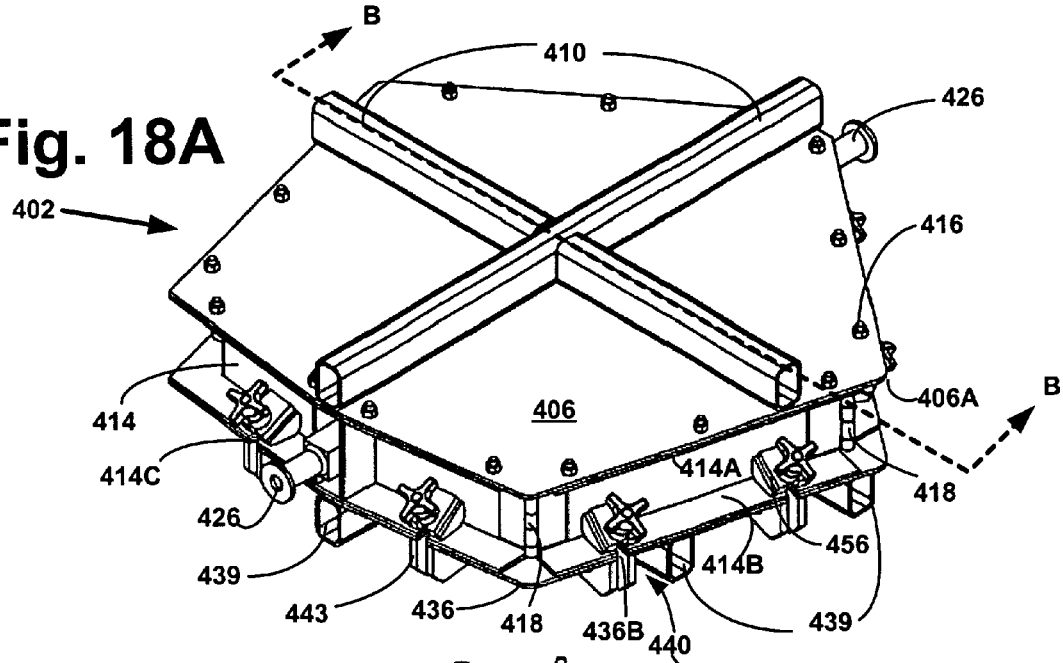
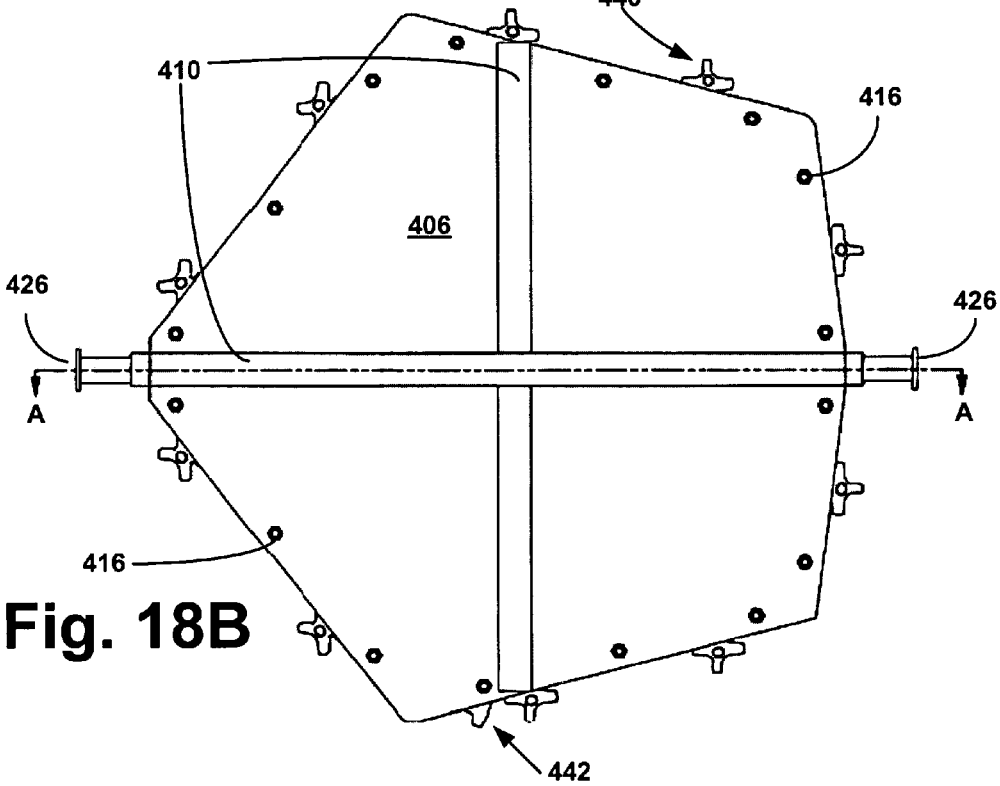
Fig. 18B

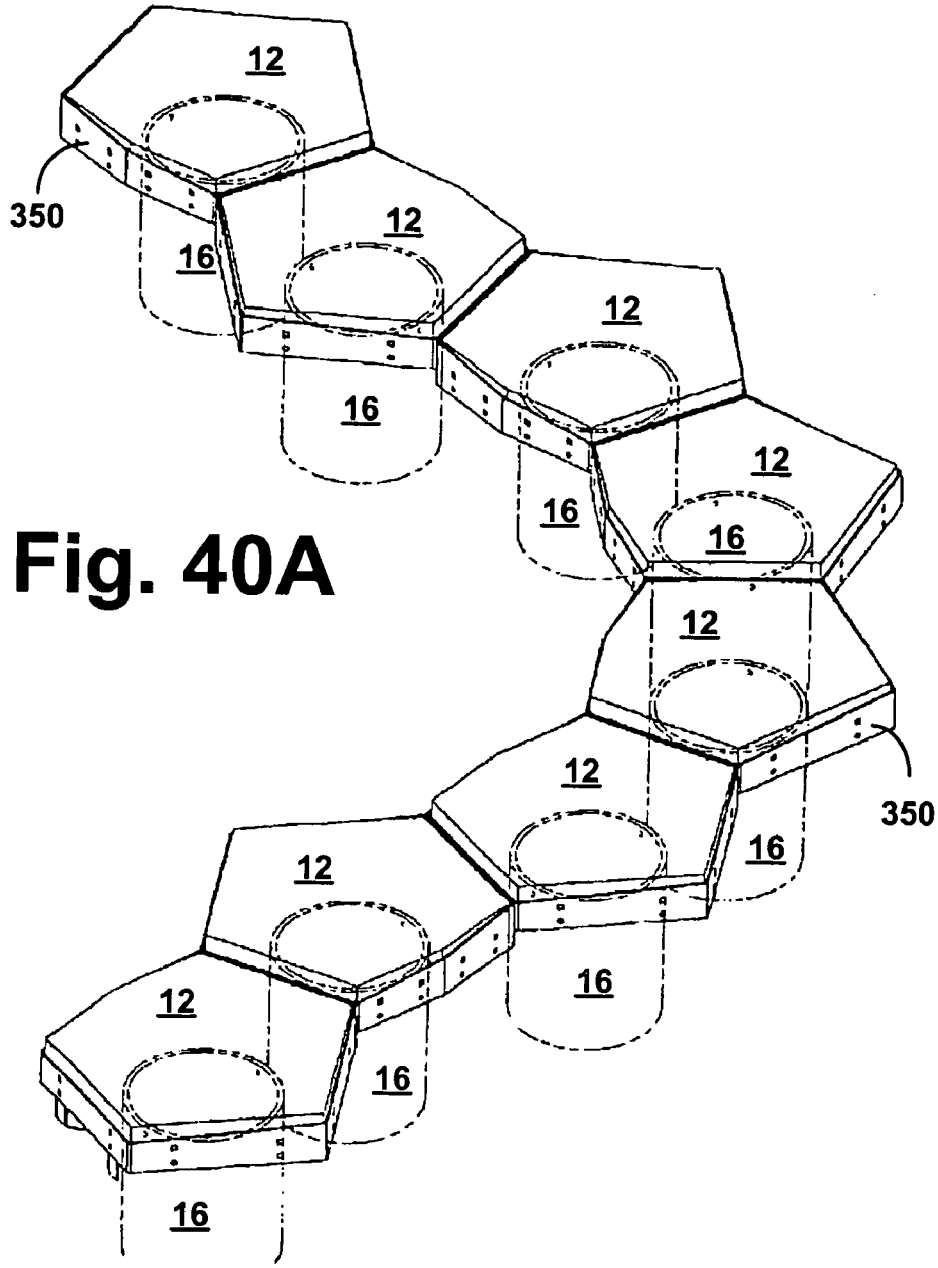
Fig. 40A
Fig. 40B
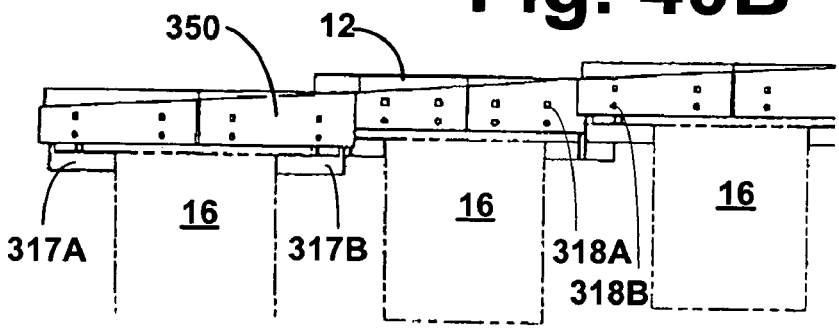

APPARATUS AND METHODS OF BURIAL USING A COLUMBARIUM POD

PRIORITY CLAIM

This application claims priority to U.S. patent application Ser. No. 60/405,481, filed Aug. 23, 2002, herein incorporated by reference in its entirety as if fully set forth herein.

FIELD OF THE INVENTION

The present invention relates generally to storing cremated remains, more specifically to storing cremated remains underground in accessible, multi-unit columbarium pods.

BACKGROUND OF THE INVENTION

The trends of funeral practices are showing a growing acceptance of cremation. In the United States, approximately 26% of deaths are disposed through cremation (Cremationist-Vol. 38, No. 2, 2002). The Peoples Republic of China cremates approximately 46% of its deaths, whereas Sweden and Switzerland cremate approximately 70% of its deaths.

In the United States, many cremationists and funeral home professionals have observed regional variation in cremation rates. For example, about half the families on the West Coast choose cremation. Of these, approximately half have the cremated remains returned to them for scattering or other forms of personal disposition. Those not wishing to be buried in traditional cemeteries often select scattering of the deceased cremains.

With scattering, the direct or immediate family may be present, but not the friends or others to share the grieving process. Often those who scattered the cremated remains later regret not having a ceremony that often accompanies a funeral or a fixed location to return for extended mourning or periodic reflection to include future generations.

Some cemeteries have developed "scattering" gardens, and have moderate acceptance by the public but distasteful to others. A few cemeteries have developed urn paths, where rocks or boulders are marked with small individual markers or monuments, but mapping is difficult, and aesthetics degrades with the haphazard placements of urn gardens and wall-based Niche columbariums.

Traditionally, cemeteries use graves and crypts in mausoleums for burial or entombment, and niches in columbariums or graves in urn gardens for cremated remains. The grave spaces of burial or cremation are generally marked with a bronze or granite marker or headstone mounted on a cement base. In the case of an urn garden, there is typically row upon row of small markers that look very unnatural. Niches in columbariums or walls look more attractive, but are costly.

Interring cremation remains over conventional whole-body burials in caskets is attractive to cemetery owners, mostly due to decreasing space available for future burials. Though urns take up less space then coffins, they are stored in relatively high-volume boxes known as niches, each niche usually a member of a group of niches built into a wall. Though efficient, in that the reduced size of storing cremation urns in niches allows more burials per cemetery than larger volume coffins and crypts, traditional niches cannot easily adapt to landscapes having a varied terrain. Many cemeteries have fixed landscapes and dedicated areas for urn gardens and conventional gravesites and are limited primarily to this readily usable land. After all the readily useable lands are used, only sloped landscapes and grounds prone to water saturation remain. Often ground near ponds and rivers, having high underground water levels, and hilly areas, cannot be used.

As cemeteries reach capacity, only sloped terrains, narrow areas between established pathways, areas adjacent to existing closely-packed structures, and areas prone to seasonal or permanent high-water levels cannot be used for underground inuruments. Sloped terrains present practical burial problems to keep inurnments stabilized and into position. Similarly, existing columbaria in urn gardens cannot be interred underground in water soaked areas because conventional underground niches are built impervious to water and serve to float out or be expelled from the ground as the water level rises. Moreover, single inurrment systems take up too much space and cannot as readily be positioned in tight spaces remaining between buildings, pathways, and landscaped trees and bushes.

A disadvantage to cremation is the obliteration of DNA sources of the diseased, forever losing genetic based information for future studies. Often, for reasons of forensics, genealogy, or epidemiology, analysis of post-interred remains is desired or required. Additionally, a source of DNA from the deceased with the cremated remains would also serve as a relic for visitation by the bereaved survivors.

It is desirable therefore to have a storage system for storing a large number of cremated remains in a space efficient manner. Furthermore, it is desirable to have a storage system that will efficiently utilize the limited supply of cemetery land.

SUMMARY OF THE INVENTION

The present invention is directed to apparatus and methods for burial using a columbarium pod. In one embodiment, a multi-unit underground columbarium pod burial system includes a water ballast control system, a stabilizing system, an identification system, a position registration system, and a mapping system. The system further includes a tub with a removable lid, a removable cover or door placed over the tub and lid, a plurality of tubes or pods placed inside the tub, where each tube is configured to store at least one container, and wherein the container is retrievable after burial. The cover is circular, oval, or polygonal in shape and the surface of the cover is made to have a stone-like or other decorative appearance. The cover may also be carved and uncut natural stone materials. In alternate embodiments, the system may further include tubes configured to receive at least two retrievable containers. The two retrievable containers may include a cremation urn container, and one or more additional containers that stores relics of the deceased and memorial materials. The relics of the deceased may be biologically-derived material, including DNA sources of the deceased that can be later retrieved for historical or criminal investigation.

In a preferred embodiment, the multi-unit columbarium is a substantially circular tub that houses the plurality of tubes. The tub and tubes may be substantially triangular, rectangular, or any polygon shape. Inside the tub is the water ballast control system and includes at least one opening to permit the ingress and egress of water, so that the columbarium pod does not float or migrate up and above ground. The tubes are substantially watertight to restrict water from reaching deceased remains and relics. Alternatively, the water ballast control system includes at least one pipe having at least one hole to permit the ingress and egress of water. Each pipe serves to keep the plurality of tubes from shifting position within the tub.

Other preferred embodiments of the columbarium burial system include a slope terrain system that permits the burial of the columbarium pod under steep terrains. The slope terrain columbarium burial system has mounting hardware fixed to the tub and stone to prevent the stone from sliding off and downhill from the buried tub. The mounting hardware is located on the downslope side of the tub and stone to support the stone and prevent stone slippage. The stone is removable using a positioning and lifting apparatus so that post burial access to the internal contents of the tub is possible.

Yet other preferred embodiments of the columbarium pod includes a registration system and a mapping system. The registration system locates the position of each cremation urn or relic container within the columbarium unit. The mapping system locates the columbarium unit in a cemetery using landmark or property description alphanumeric arrays.

Other preferred embodiments of the columbarium pod burial system include a decorative memorial system having a vase receptacle configured to receive and securely hold a vase. The vase receptacle is mounted on the ground adjacent to the columbarium stone or mounted on the stone.

Yet other preferred embodiments include separated and linked columbariums that are detachable and transportable to accommodate the relocating of interred remains. Separate or linked columbariums may be placed in multiple patterns, including angled, circular, and branched arrays. Each individual columbarium or array, including the tub or tubs, are transportable to be relocated to different cemetery sites. The stones of the columbiums may have raised walls to create architecturally decorative partitions or stepped terraces. The stones may be made precast or cast-on-site with mold assemblies. Individual columbariums or arrays may be installed inside buildings.

BRIEF DESCRIPTION OF THE DRAWINGS

FIG. 18A is a perspective view of a stone mold assembly in accordance with a further embodiment of the invention;

FIG. 18B is a top view of the cover mold assembly of FIG. 18A;

FIG. 40A is a perspective view of a curved and stepped array of connected columbarium units using a hexagon frame with slanted sides;

FIG. 40B is a side view of a curved and stepped array of connected columbarium units using a hexagon frame with slanted sides;

DETAILED DESCRIPTION OF THE PREFERRED EMBODIMENT

Generally, the present invention relates to apparatus and methods for burial using a columbarium pod, and more specifically, to an underground single pod and multi-pod burial systems and methods for storing cremated remains. Many specific details of certain embodiments of the invention are set forth in the following description and in FIGS. 1–42 to provide a thorough understanding of such embodiments.

Figure 1:
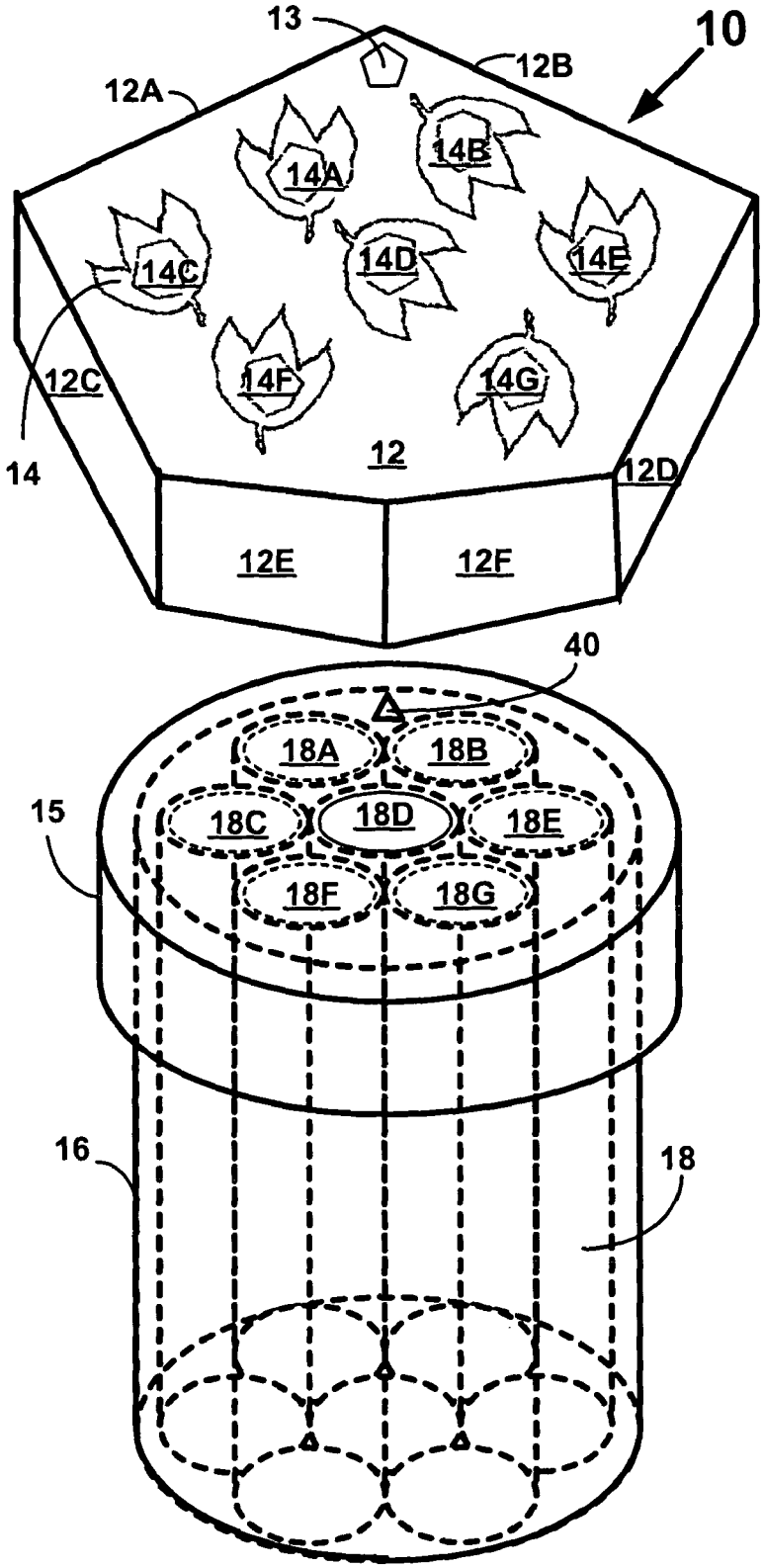
FIG. 1 is a perspective view of a columbarium pod burial system in accordance with an embodiment of the present invention.

FIG. 1 is a perspective view of a multi-pod columbarium burial system 10 in accordance with an embodiment of the present invention. The multi-pod columbarium burial system 10 includes a stone 12 having a plurality of memorial plaques 14. By the term, "stone" it is meant to be a poured and cured concrete cover or other formed and durable material serving as a removable cover or removable door in which the surface has a stone-like appearance or other decorative appearance. The term "stone" also may mean a carved cover made from natural stone materials, for example, granite and sandstone, or uncut natural stone. The cover or removable door may be of any circular, oval, or polygon shape, including regular and irregular triangles, rectangles, diamonds, pentagons, and hexagons. In this embodiment of the invention, there are seven memorial plaques 14A–14G of a substantially leaf-shaped configuration with an internal hexagon-like area for receiving engravings. The leaf shaped configuration of each memorial plaque 14 includes a three-lobe top section and a bottom stem section. The stone 12 is an irregular hexagon comprising of four substantially equally sized sides, a first side 12A, a second side 12B, a third side 12C, and a fourth side 12D. The other two sides of the stone 12 are approximately half the dimensions of sides 12A, B, C and D and these sides include a fifth side 12E and a sixth side 12F. Of course, the stone 12 shown in FIG. 1 is simply one embodiment of many possible embodiments that may be conceived in accordance with the present invention.

As further shown in FIG. 1, the stone 12 is placed over a tub 16 that is buried in the ground. The tub 16 has over it a lid 15. Contained within the tub 16 and the lid 15 in a perspective phantom view is a plurality of pods 18A–18G. In this embodiment, each pod 18 is substantially cylindrical in shape and includes a hollow tube with a solid bottom and capped with a tube lid. Each pod 18 can vary in dimensions to accommodate storage of single and multiple containers of variable sizes, preferably having an outside diameter of 5 and ½ inches and an inside diameter of 5 inches. On the internal wall of the tub 16 is a tub locator 40. On the top surface of the stone 12 and adjacent to the memorial plaques 14 is a mapping locator 13. The mapping locator 13 is aligned with the tub locator 40 and is engraved with a number to identify the stone. For example, the mapping locator might be engraved with the number "946" to signify that Stone 12 is the stone number 946.

The alignment of the mapping locator 13 with the tub locator 40 arranges for the registration of memorial plaques 14 with the pods 18. For example, memorial plaque 14A is aligned over the first tube 18A, and the second memorial plaque 14B is aligned over the second pod 18B, and so on Each memorial plaque 14 can be mounted to the stone 12 in a variety of orientations. Underneath each memorial plaque 14 are at least two pins to permit the orientation and securing to companion slots drilled in the stone 12. The orientation of each memorial plaque 14 depends on the placement of the slots. For example, the central lobe of the leaf of the first plaque 14A points towards first side 12A of the stone 12, and the central lobe of the leaf of the seventh plaque 14G points to the sixth side 12G of the stone 12.

In this embodiment, approximately in the center of each memorial plaque 14 is a centrally located area (e.g. a hexagonal area) in which text may be engraved. In one embodiment, text engraved within the hexagonal area of each memorial plaque 14 are co-aligned with text engraved in adjacent memorial plaques 14. For example, a person standing adjacent to and just below sides 12E and 12F and looking in the direction of the mapping locator 13 would be able to read inscriptions engraved in the first and seventh memorial plaques 14A and 14G without having to change location. In another preferred embodiment, text engravings between each memorial need not be co-aligned, but can vary in orientation.

The stone 12 in the illustrated embodiment is substantially an irregular hexagon and comprises four substantially equal major sides and two substantially equal minor sides. The angle between the first side 12A and the second side 12B is approximately 105 degrees. The angle between the first side 12A and the third side 12C is approximately 112 degrees. The angle between the second side 12B and the fourth side 12D is approximately 112 degrees. The angle between the third side 12C and the fifth side 12E is approximately 112 degrees. The angle between the fourth side 12D and the sixth side 12F is approximately 112 degrees. The angle between the fifth side 12E and the sixth side 12F is approximately 165 degrees. The stone 12 may also be configured to a plurality of polygon shapes including a regular pentagon, an irregular pentagon, a regular hexagon, a square, a rectangle, and a triangle.

Figure 2A:
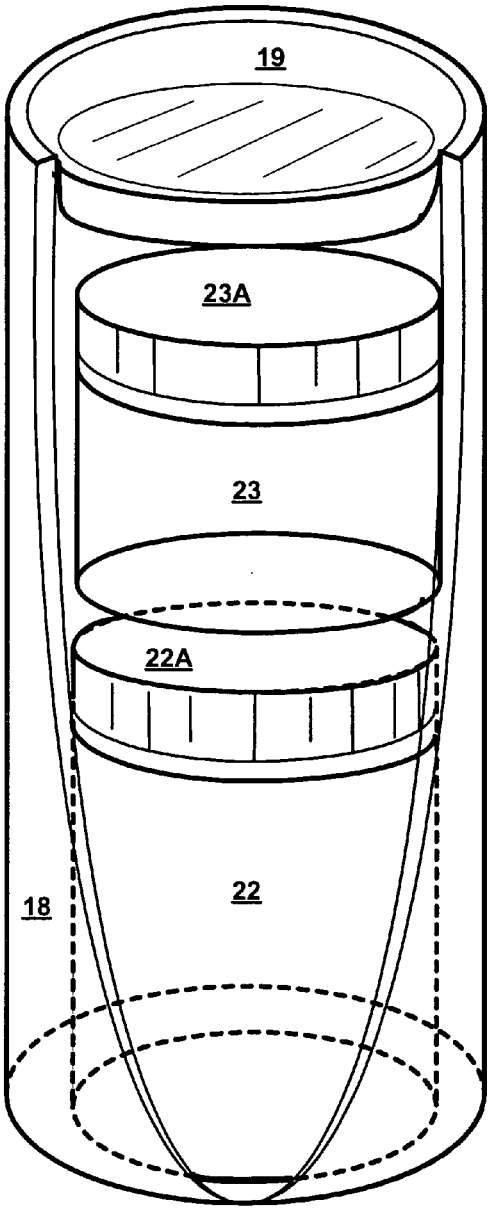
FIG. 2A is a partial cross-sectional view of a pod of the burial system of FIG. 1 in accordance with another embodiment of the invention.
Figure 2B:
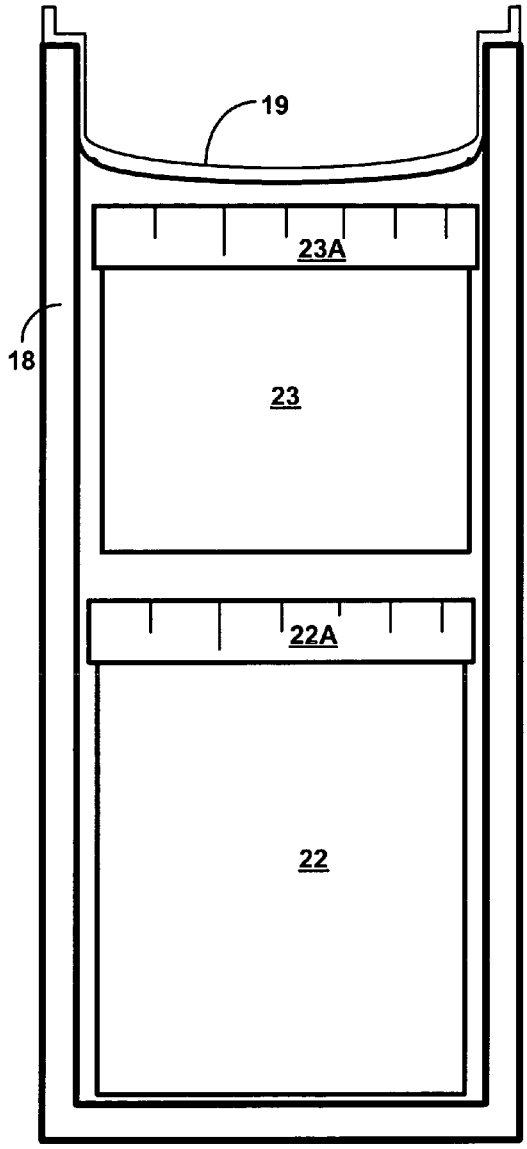
FIG. 2B is a side sectional view of the pod of FIG. 2A.

FIGS. 2A and 2B represent one embodiment of the pod 18 whereby at least one cremation urn and an optional relic container is placed into the pod 18. FIG. 2A is a partial cutaway perspective view of the pod 18. The pod 18 has a pod lid 19 located near the top of the pod 18. As illustrated, the pod lid 19 is a press-to-fit configuration, but equivalent configurations to restrict water entry in the pod 18 may include a threaded cap and seal, or a breech bayonet system that engages with the pod 18 configured to be compatible with threaded caps and breech bayonet lids. Beneath the pod lid 19 are two containers. The two containers include a cremation urn 22, the cremation urn having a cremation urn lid 22A. Above the cremation urn 22 is a relic container 23 having a relic container lid 23A. FIG. 2B is a side cutaway view of the pod 18 and shows the approximate relationship of the placement of the cremation urn 22 and the relic container 23 inside the pod 18. Pod numbers (not shown) can be placed on the pod 18 and pod lid 19 as part of an identification and mapping system.

Figure 3A:
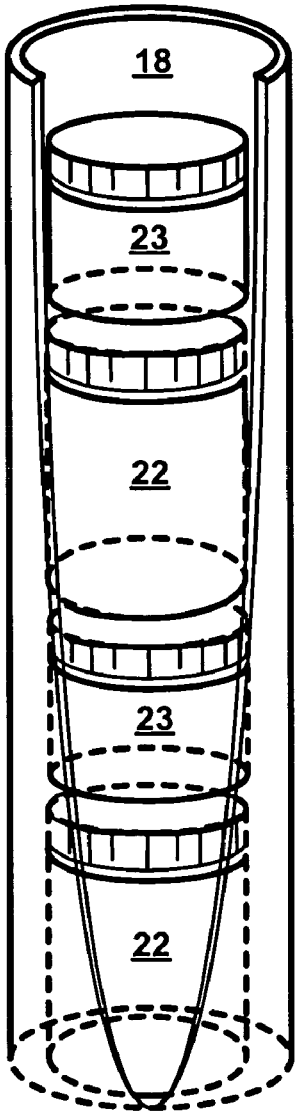
FIG. 3A is a partial cross-sectional perspective view of an alternative loading arrangement of four containers in a pod in accordance with an alternate embodiment of the invention.
Figure 3B:
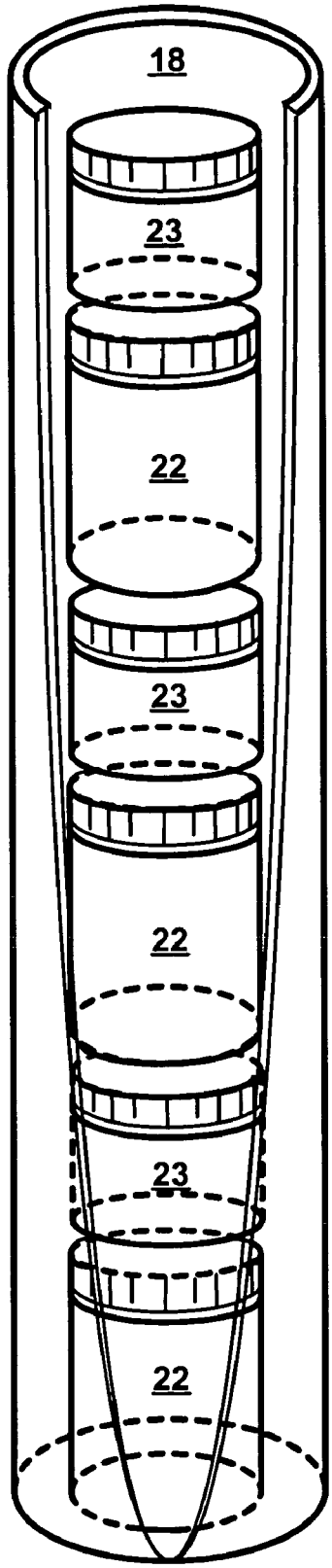
FIG. 3B is a partial cross-sectional perspective view of a loading arrangement for six containers in a pod in accordance with another embodiment of the invention.

FIGS. 3A and 3B depict alternate embodiments of loading arrangements of more than two containers in the pod 18. FIG. 3A depicts a loading arrangement of four containers 22, 23 in the pod 18. The partial cutaway view of FIG. 3A shows two cremation urns 22 and two relic containers 23. The arrangement is for the cremation urn 22 to be placed on the-bottom followed by the relic urn 23 followed by another cremation urn 22 followed by another relic container 23. Similarly, FIG. 3B is a partially cut-away perspective view of a loading arrangement of six containers. The six containers include three sets of cremation urns 22 and relic containers 23 arranged with a bottom cremation urn 22 and a bottom relic container 23 followed by a middle positioned cremation urn 22 followed by a middle positioned relic container 23, that in turn followed by a top cremation urn 22 and a top relic container 23.

Figure 4:
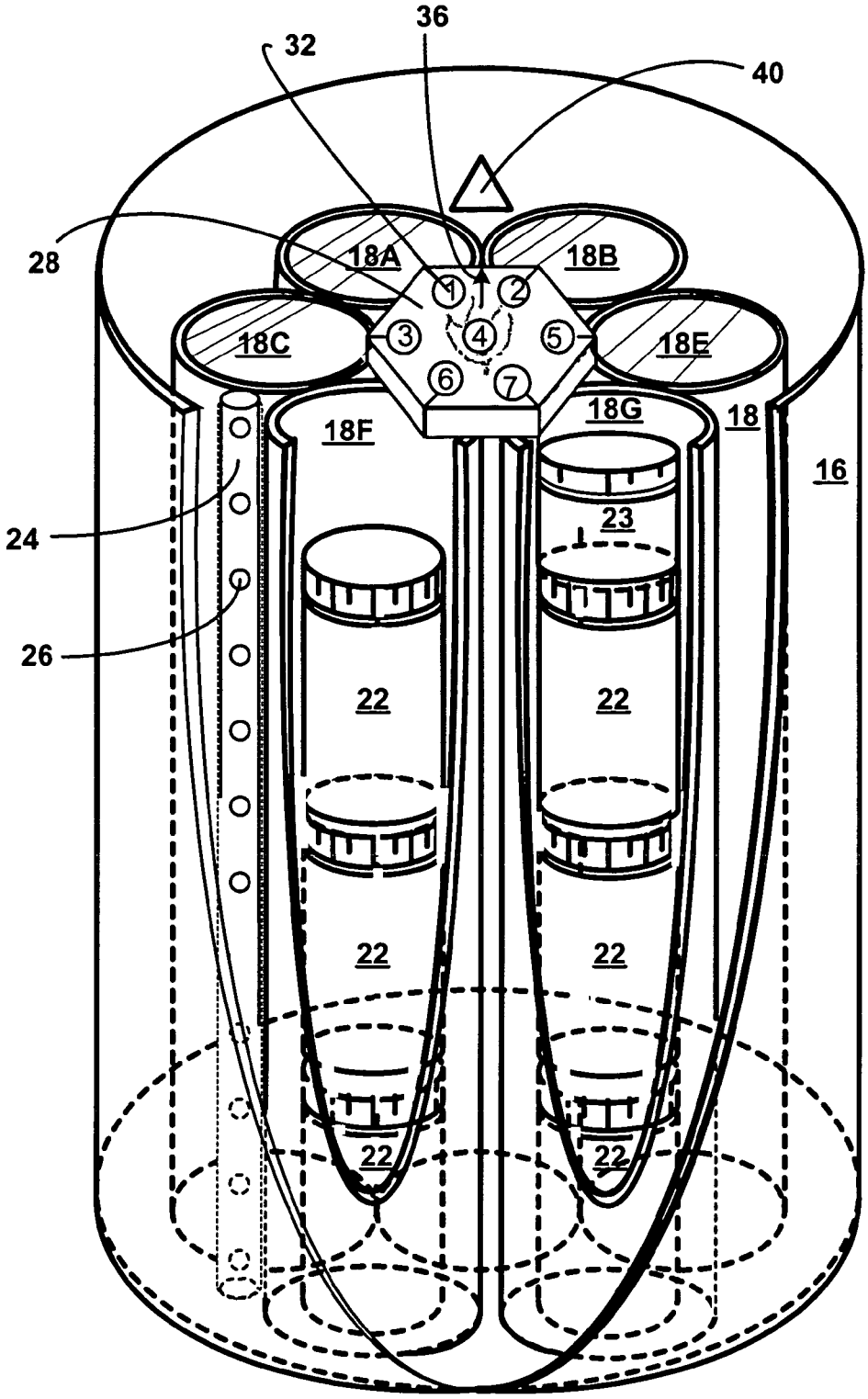
FIG. 4 is a partial cross-sectional perspective view of a tub loading arrangement of seven pods in accordance with another alternate embodiment of the invention.

FIG. 4 is a partial cross-sectional perspective view of a tub loading arrangement of seven pods 18A–18G. The tub 16 is shown in a perspective partial cutaway view where seven pods are shown in a proximate hexagonal arrangement inside the tub 16. Within the tub 16 and substantially parallel to the tubes 18A through G, is a ballast pipe 24. The ballast pipe 24 has at least one ballast pipe aperture 26. The ballast pipe 24 is attached to an aperture on the bottom of the tub 16 that allows the inflow and outflow of water into the internal chamber of the tub 16. The ingress and egress of water into the internal chamber of the tub 16 ensures that the tub 16 is properly ballasted so that underground water-saturating conditions in the burial plot does not expel the tub 16 above the ground. The number of and spacing between the apertures 26 on the ballast pipe 24 may be varied to accommodate for historical variation of local water tables and so retain water volumes inside the tub 16 to keep the tub 16 in a subterranean location and to prevent the tube 16 from being expelled from the ground.

With continued reference to FIG. 4, pods 18A through 18G are secured in the tub 16 through a pod stabilizer and locator 28. On the surface of the pod stabilizer and locator 28 are pod reference numbers 32. The pod reference numbers 32, illustrated as circle inscribed 1, 2, 3, 4, 5, 6, and 7 are circumferentially aligned with the first, second, third, fourth, fifth, sixth and seventh pods 18A through 18G respectively. The pod reference numbers 1–7 may be affixed to each respective pod 18 and pod lid 19. For example, the first pod 18A and first pod lid 19A is affixed with pod number 1, and the fifth pod 18E and fifth pod lid 19E is affixed with pod number 5. On the pod stabilizer and locator 28 is a pod locator reference mark 36. The pod locator reference mark 36 is pointed to or aligned with the tube locator 40. The pod stabilizer and locator 28 is turned to a point such that sufficient restraining force is exerted by the pod stabilizer and locator 28 against the pods 18A through 18G and such that the pod locator reference mark 36 aligns with the tub locator 40. The alignment of the reference mark 36 with the tub locator 40 registers the pod reference number 1–7 with the pod reference numbers 1–7 affixed to the first, second, third, fourth, fifth, sixth and seventh pods 18A through 18G and respective pod lids 19A–19G.

Figure 5:
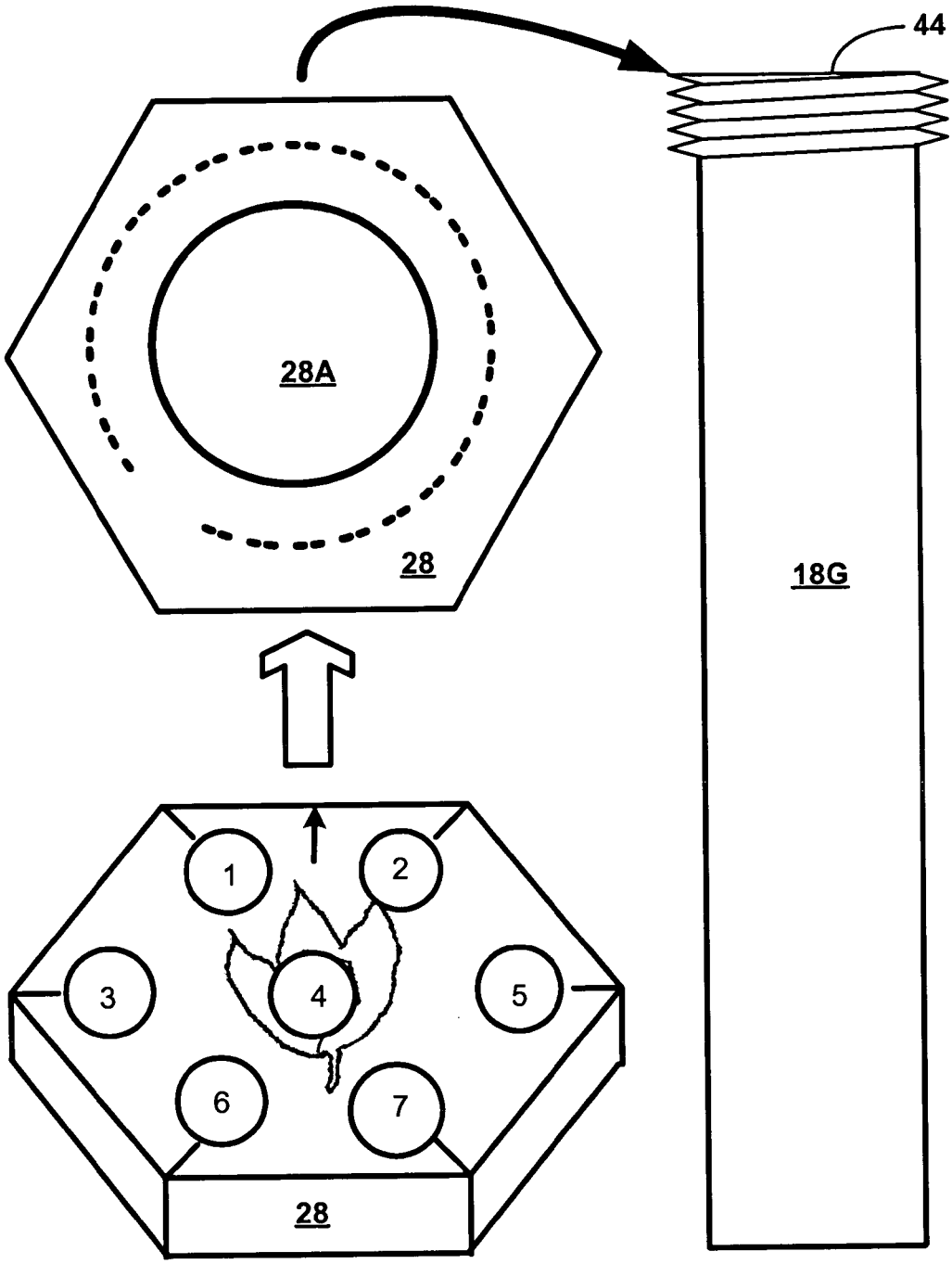
FIG. 5 depicts an assembly sequence view of a pod stabilizer to a central pod of a pod burial system in accordance with another embodiment of the invention.

FIG. 5 depicts an assembly sequence view of the pod stabilizer to the fourth pod in accordance with an embodiment of the invention. The stabilizer and locator 28 has a threaded aperture 28A located on the bottom side which engages against a threaded surface 44 located on the fourth pod 18G.

Figure 6A:
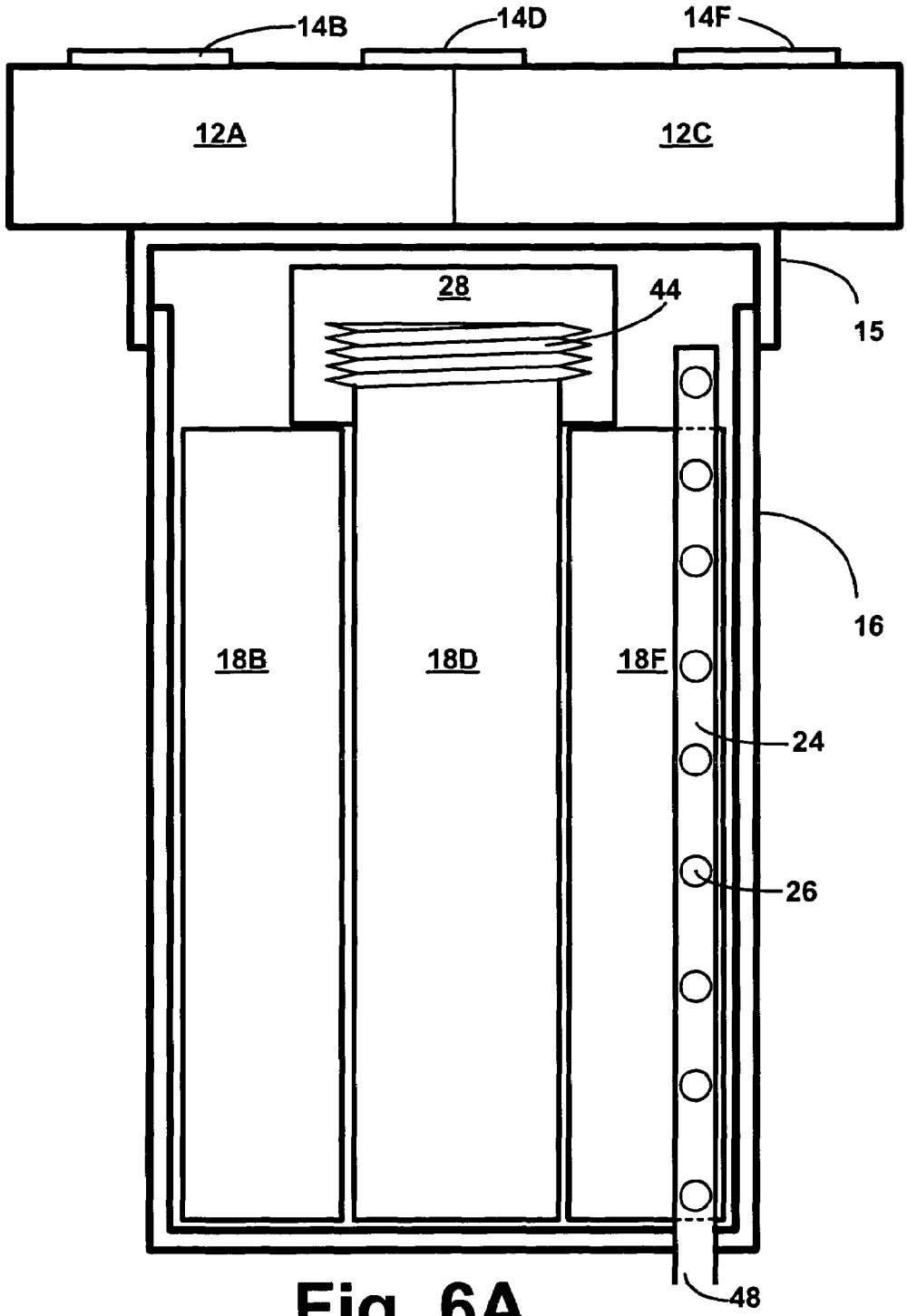
FIG. 6A is a side cross-sectional view of the assembled components of the pod burial system of FIG. 5.

FIG. 6A is a side cutaway view of the pod burial system of FIG. 5. FIG. 6A shows a cutaway sectional view approximately along the axis of the second pod 18B, the fourth pod 18D and the sixth pod 18F. Above the tub 16 and the lid 15 is the stone 12 where the view shows the first side of the stone 12A and the third side of the stone 12C. In registration with the second, fourth and sixth pods 18B, 18D and 18F are the respective second, fourth and sixth memorial plaques 14B, 14D and 14F. In this embodiment, substantially parallel and located adjacent to the sixth pod 18F is a ballast pipe 24 having a plurality of apertures 26. The ballast pipe 24 is open to receiving and expelling groundwater through an aperture 48 located at the end of the pipe 24. The ballast pipe 24 permits the accumulation and retention of ground water inside the tub 16 to a height roughly equivalent to the location of the aperture 26 on the pipe 24 closest to the bottom of the tub 16. Thus as ground water levels increase, water accumulates and is retained in the tub 16 to insure that the tub 16 remains submerged beneath the ground. Though disposed parallel to the pods, the ballast pipe 24 may be configured to be in any orientation or may be segmented to effect water removal from the tub 16.

In one embodiment, the water ballast may be designed to insure that the weight of the columbarium pod system 10 exceeds the cumulative weight of the ground and ground water it displaces, so that upon removal of the stone 12, the tub 16 and lid 15 are not propelled above the ground. In another embodiment, the water ballast system is designed to insure that the weight of the tub 16 and container holding pods exceeds the weight of the cumulative ground and groundwater it displaces, so that removal of the tub lid 15 does not cause the tub 16 to be propelled from the ground. In yet another embodiment of the invention, the water ballast system is supplemented with sand or equivalent materials to fill the spaces between each pod 18.

Figure 6B:
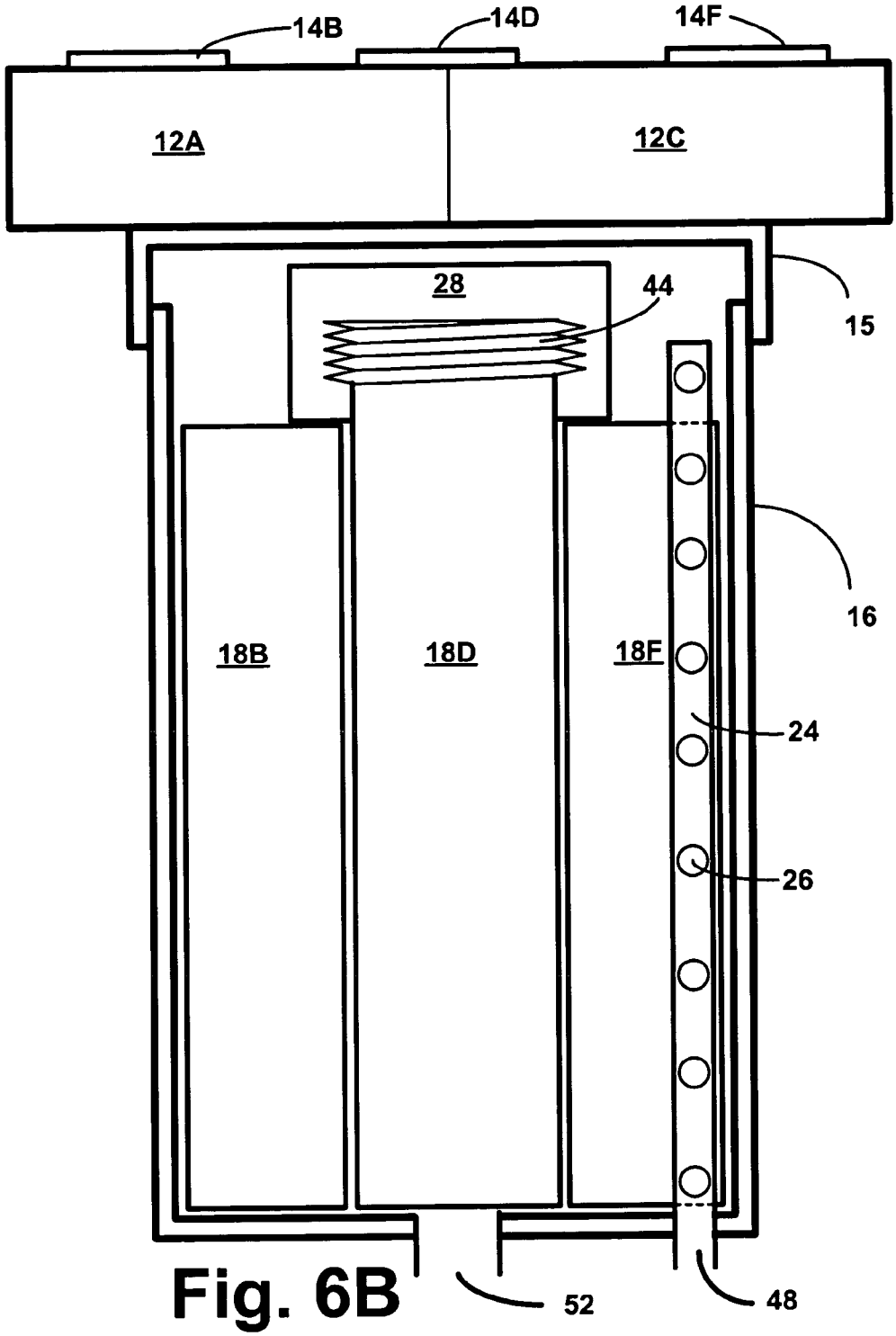
FIG. 6B is a side cross-sectional view of an alternate embodiment of the pod burial system.

FIG. 6B is a cutaway view of an alternate embodiment of the pod burial system. This alternate embodiment employs all the same components as described in FIG. 6, except it also includes a tub aperture 52 to permit a secondary opening for groundwater flow. The tub aperture 52 is located at the bottom of the tub 16 permitting the tub 16 to be completely emptied when the groundwater recedes below the bottom of the tub 16.

Figure 7:
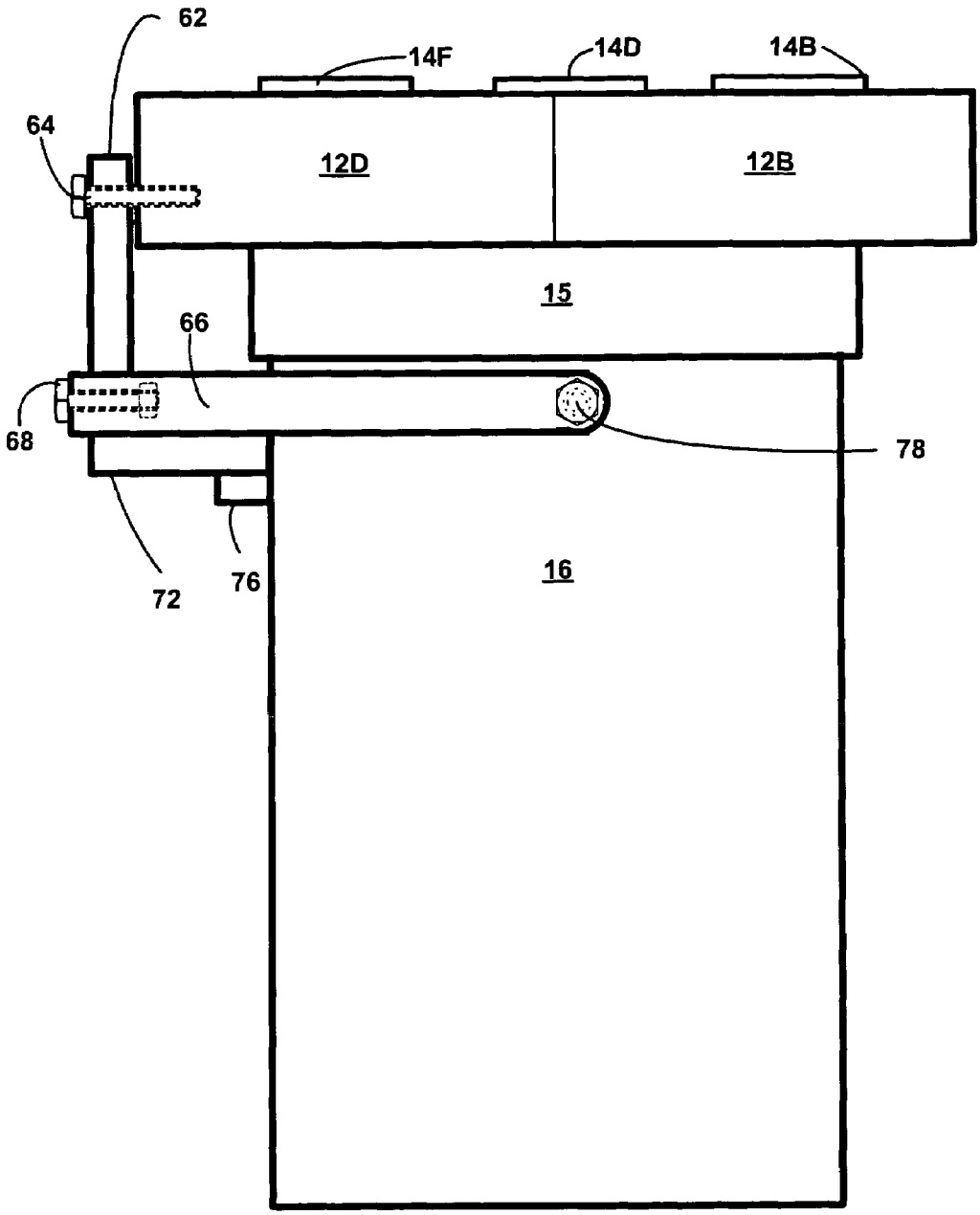
FIG. 7 is a side view of the pod burial system of FIG. 1 adapted for hilly terrains in accordance with yet another embodiment of the invention.

FIG. 7 is a side view of the pod burial system adapted for hilly terrain. The side view is from the second and fourth sides of the stone 12, specifically along the axis defined by the second side 12B and the fourth side 12D. Visible above the sides 12D and 12B are the second fourth and sixth memorial plaques, 14B, 14D and 14F.

The stone 12 rests above the lid 15 which in turn is resting above the tub 16. The hilly terrain embodiment of the invention 100 includes supporting brace work 102 that secures the lid 12 to the tub 16. The secured lid 12 is prevented from sliding off the tub 16 when the tub 16 is buried on hilly slopes. The supporting brace work 102 includes a stone brace 62 that is mounted by a mounting screw 64. In this embodiment, the stone brace 62 is substantially perpendicular to the stone 12 and extends below the stone 12 from which a bracket 72 attaches to the tub 16. Stone brace 62 may be connected to a support element 66, for example, by a nut and bolt 68. The support element 66 in turn is connected to the tub 16 via a nut and bolt 78.

In the embodiment shown in FIG. 7, the stone brace 62 is substantially L-shaped in configuration and is secured to the stone 12 via the mounting screw 64 and to the tub 16 via a support brace 76. Between the support brace 76 and the stone brace 64 is a tub support brace 66. The tub support brace 66 is secured to the stone brace 62 via a nut and bolt 68 and to the tub 16 via a nut and bolt 78. The mounting hardware is asymmetrically attached or mounted one side of the tub 16 to provide uphill leverage thereby preventing columbarium pod 100 from tilting down toward the hill slope. The asymmetrical mounting of the securing hardware serves to compensate for tilting down the slope that otherwise would occur were it not there. Of course, a variety of alternate embodiments of the supporting brace work 102 may be conceived in accordance with the teachings of the present invention.

Figure 8:
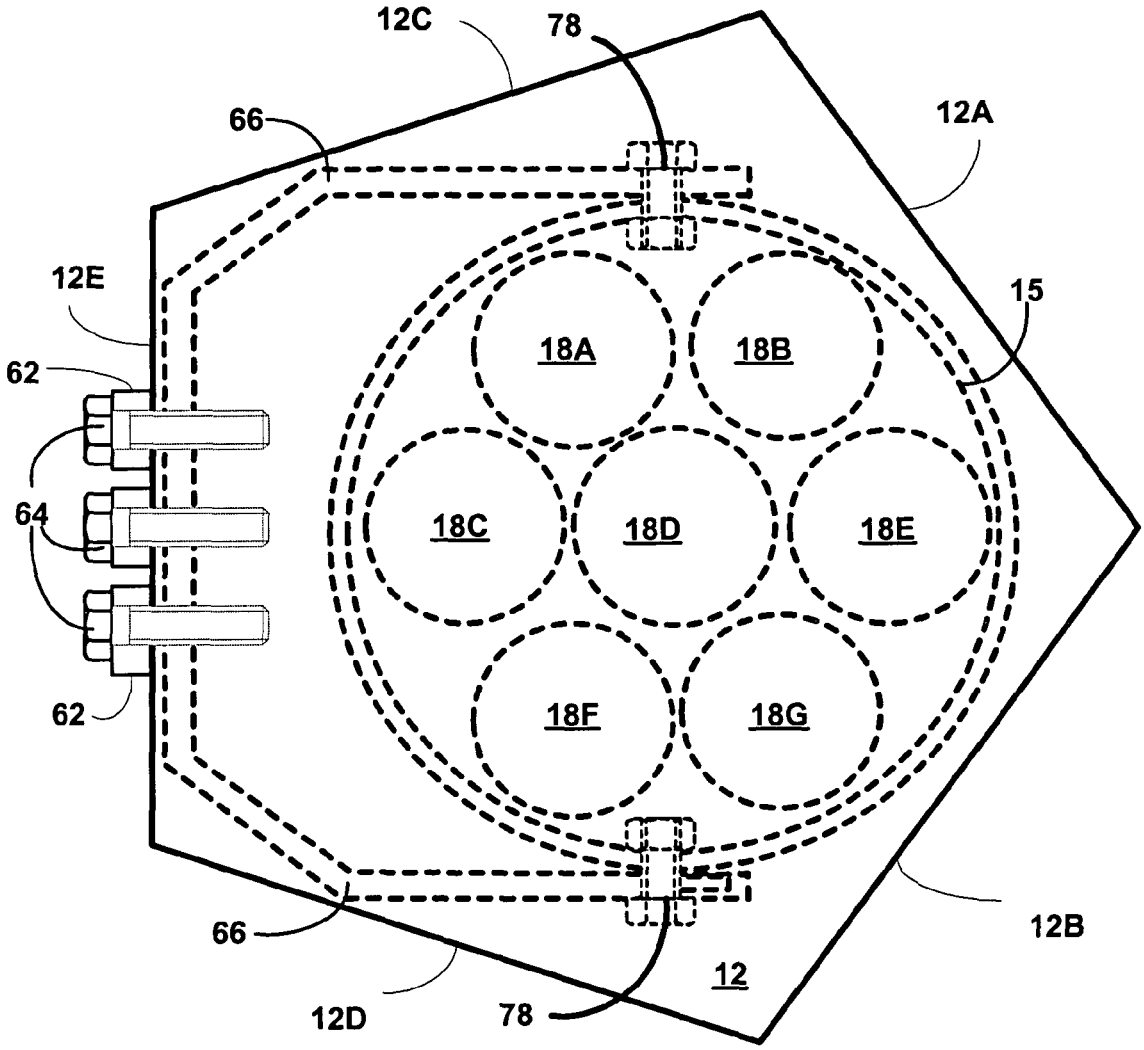
FIG. 8 is a top view of the pod system adapted for hilly terrains of FIG. 7.

FIG. 8 is a top view of the pod system 100 of FIG. 7. Attached to the stone 12 alongside 12E are three stone braces 62. Each stone brace 62 is secured by a mounting screw 64. In phantom outline beneath the mounting screw 64 is support element 66 shown attached to a tub 15 via the nut and bold 78. Contained within the tub 15 in phantom view are pods 18A, B, C, D, E, F and G. The burial system 100 may also include a water ballast system substantially similar to the system described above with reference to the burial system 10.

Figure 9:
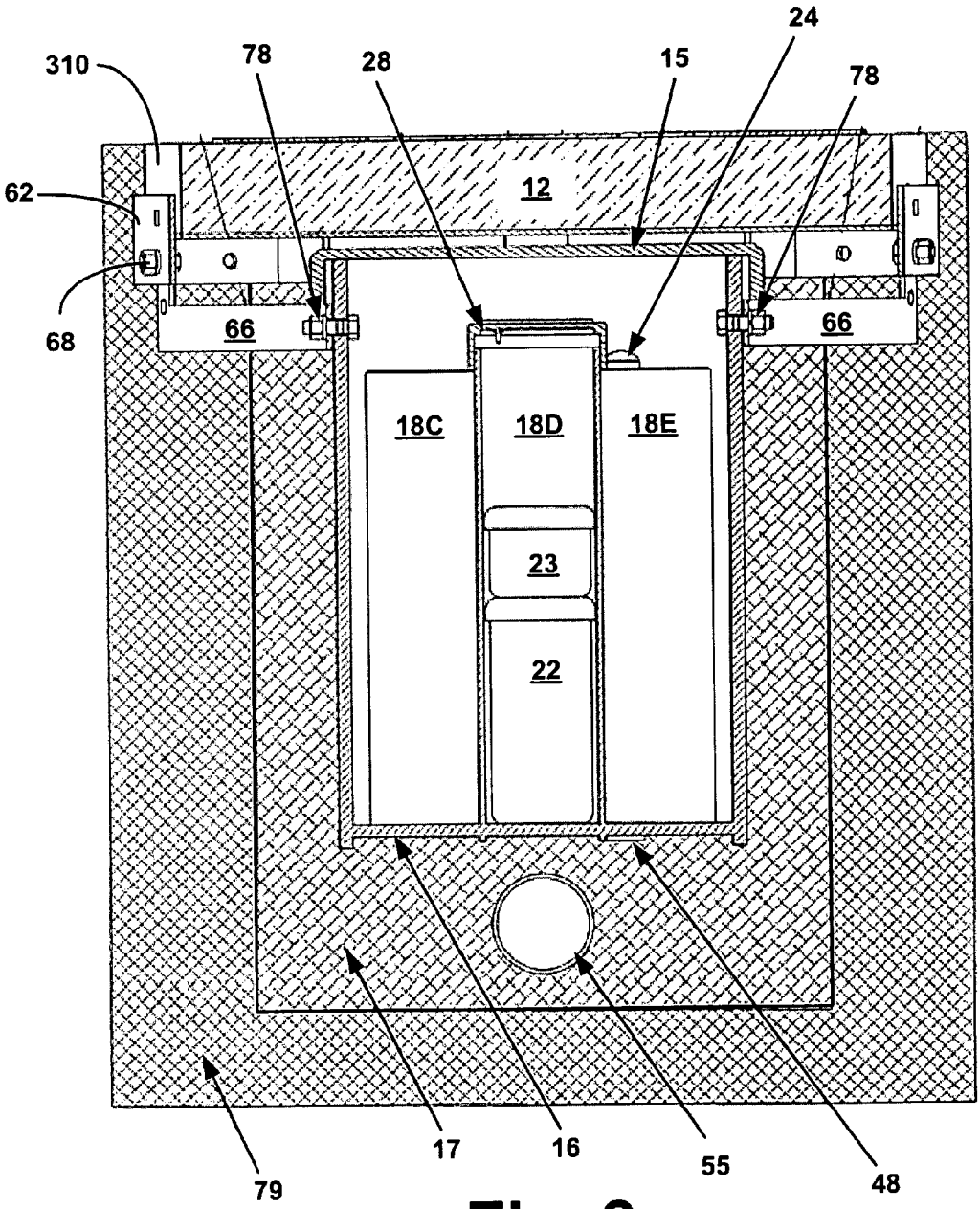
FIG. 9 is a side view of an alternate embodiment of the pod burial system of FIG. 7 placed in surrounding drain rock.

FIG. 9 is a side view of an alternate embodiment of the pod burial system placed in surrounding drain rock. A portion of a hexagon frame 310 surrounds the stone 12 and is secured to the support element 66 by bolt 68. The tub 16, overlaid with the lid 15, is supported by bolts 78 to the support element 66. Inside the tub 16 in cross-section are pods 18C, 18D, and 18E. Inside centrally located pod 18D is the cremation urn 22 and relic container 23. Secured to the pod 18D is the pod stabilizer and locator 28. Interposed between the tub 16 and soil 79 is a drain rock field 17. Water that has entered the pod tub 16 drains through the water ballast 24 through the opening 48 and out into the drain rock field 17. A pipe 55 positioned in the drain rock field 17 delivers the water to the surrounding soil 79.

Figure 10A:
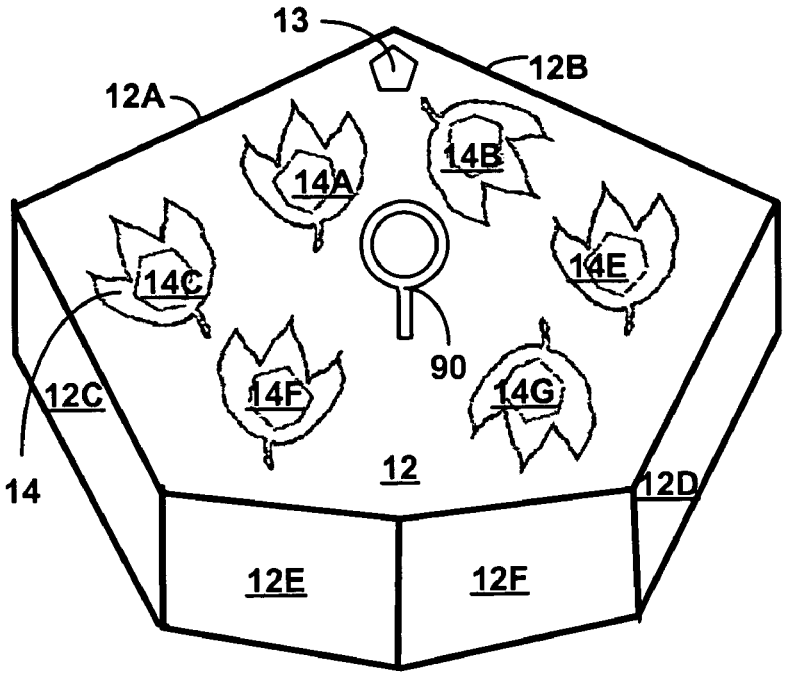
FIG. 10A is a perspective view of an irregular hexagon-shaped stone in accordance with a further embodiment of the invention.

FIG. 10A is a perspective view of the irregular hexagon shaped stone 12 with a mounting eye-bolt 90 in accordance with another embodiment of the invention. The mounting eye-bolt 90 may be screwed into a threaded cylinder (not shown) imbedded into the stone 12. The mounting I-bolt 90 is used as a hoisting structure to permit placement of the stone 12 over the tub and lid assembly 16 and 15. All other element numbers are substantially the same as in FIG. 1.

Figure 10B:
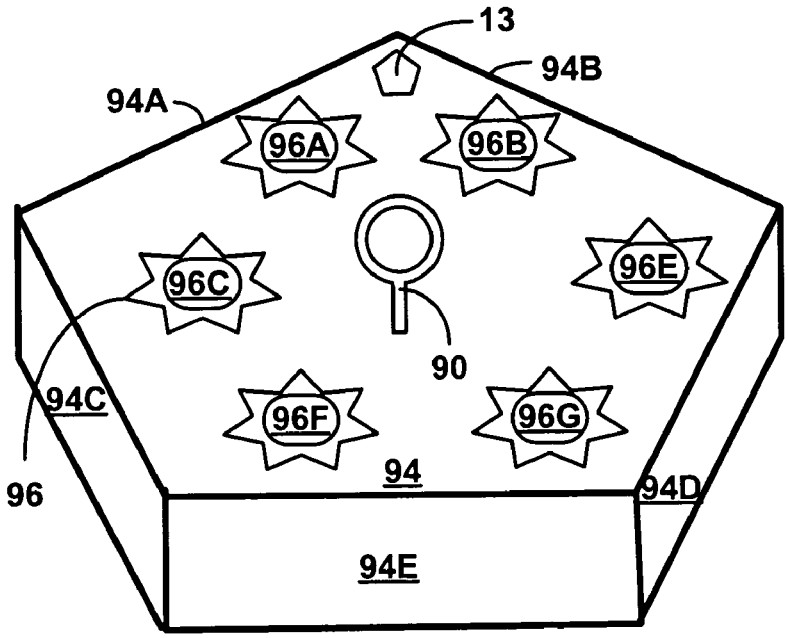
FIG. 10B is a perspective view of a regular pentagon-shaped stone in accordance with another alternate embodiment of the invention.

FIG. 10B is a perspective view of a substantially regular pentagon shaped stone 94. Substantially similar to the irregular hexagon shaped stone 12 of FIG. 1 and FIG. 10A, the regular pentagon shaped stone 94 also has a mounting I-bolt 90 installed for the purposes of placement of the stone 94. The stone 94 has five substantially equal sides in a pentagon array: a first side 94A, a second side 94B, a third side 94C, a fourth side 94D, and a fifth side 94E. The memorial plaques 96 are substantially star shaped and shown are six of seven plaques, a first plaque 96A a second plaque 96B, a third plaque 96C and a fifth plaque 96E, an sixth plaque 96F and a seventh plaque 96G.

Figure 11:
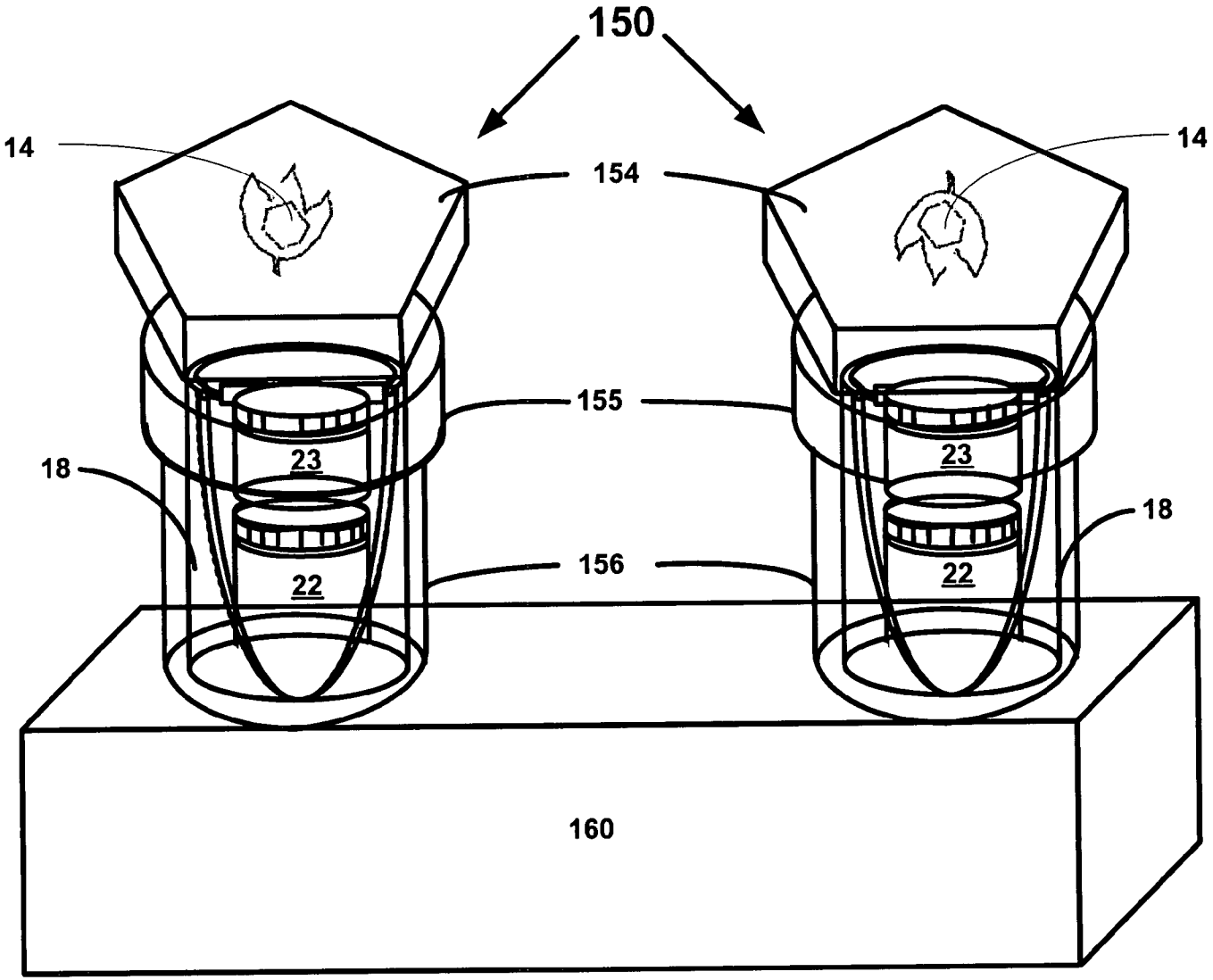
FIG. 11 is a perspective partial cross-sectional view of a pod burial system adapted for placement over buried caskets in accordance with another embodiment of the invention.

FIG. 11 is a perspective partial cross-sectional view of a pair of single pod burial systems 150 adapted for placement over a buried coffin 160 in accordance with still another embodiment of the invention. Substantially smaller lids and tubs are illustrated as a tub 156 overlaid with a lid 155. Overlaying the lid 155 is a stone 154. On top of the stone 154 is illustrated the memorial plaque 14 having a substantial leaf shaped configuration. Inside the tub 156 in a partial cutaway view, is a single pod 18. Single pod 18 is shown containing the cremation urn 22 and the relic container 23. Both embodiments 150 are shown resting on top of the buried coffin 160.

Figure 12:
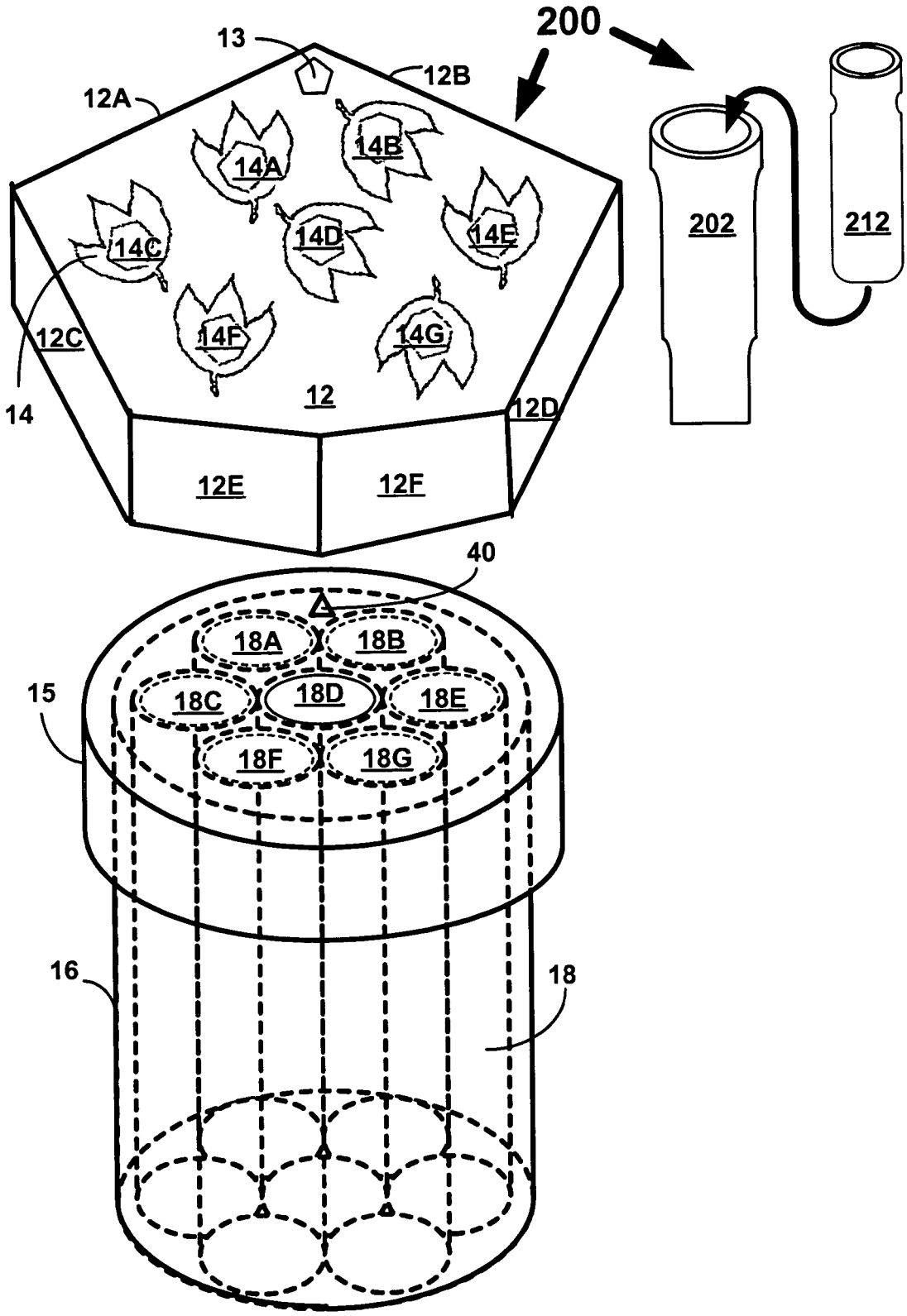
FIG. 12 is an alternate embodiment of a multi-pod burial system incorporating a detachable vase.
Figure 13:
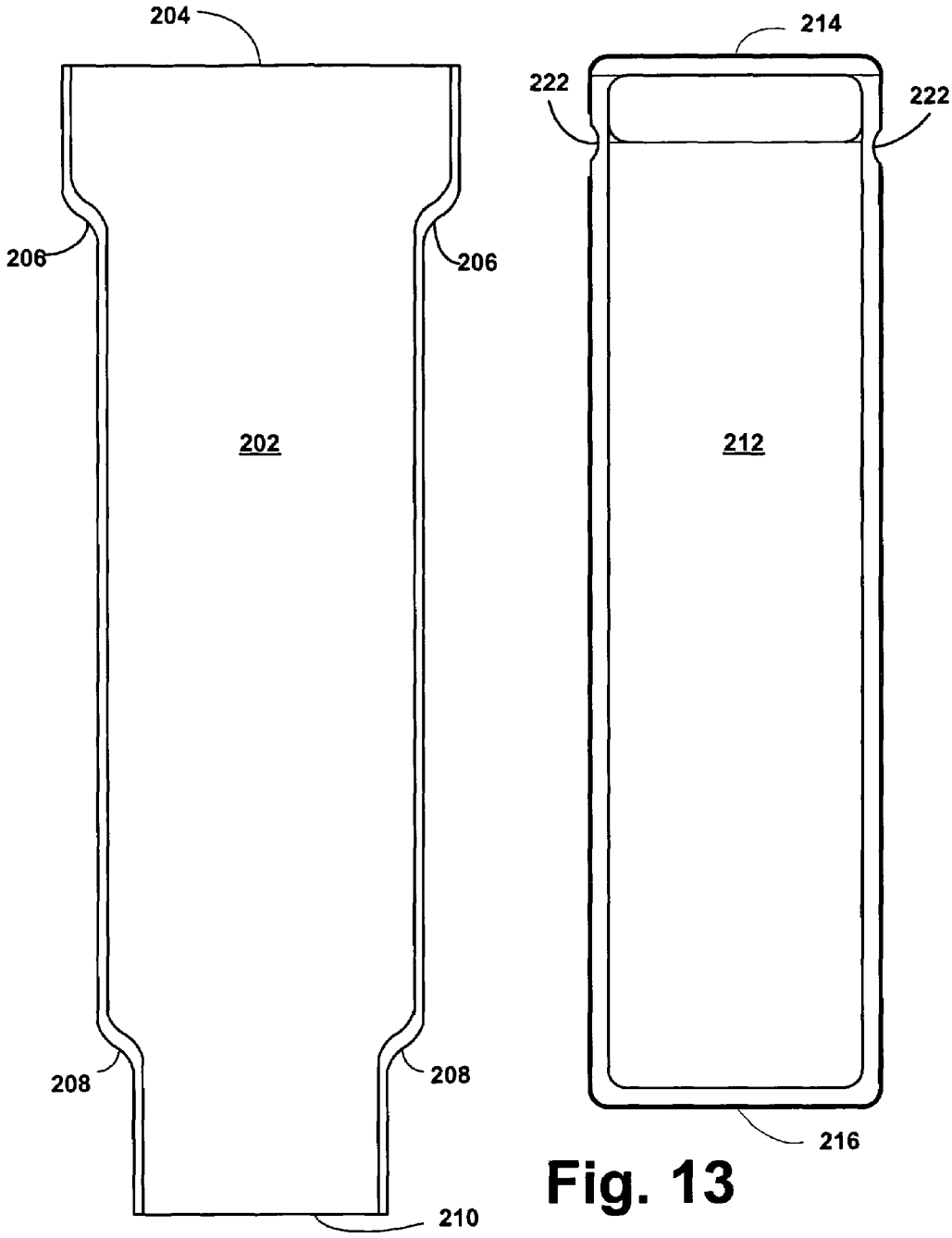
FIG. 13 presents cross-sectional views of the vase receiver and vase of FIG. 12.
Figure 14:
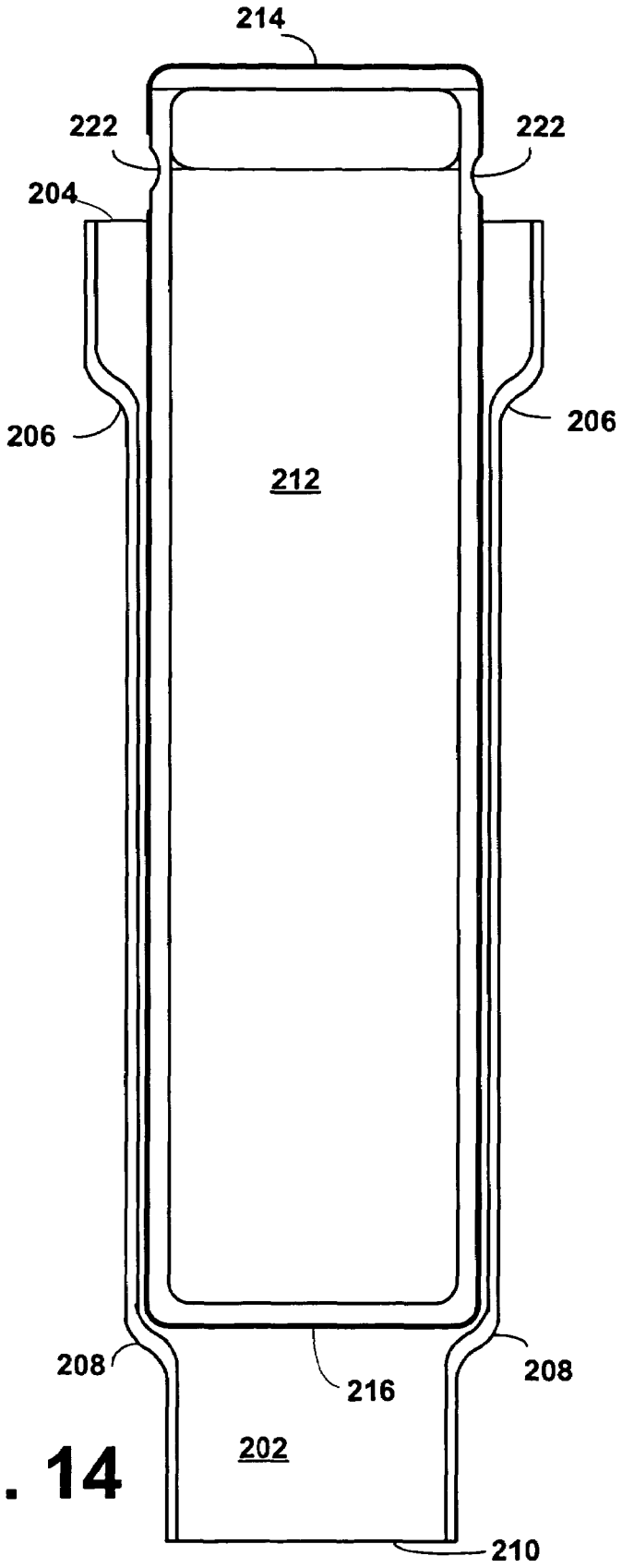
FIG. 14 is a side cross-sectional view of the vase inserted into the vase receiver of FIG. 12.

FIG. 12 is an alternate embodiment of the multi-pod columbarium burial system 200 that has substantially the same components as the pod burial systems 10, 100 and 150 described above, but also includes a vase receiver 202 and a vase 212. FIGS. 13 and 14 are side cross-sectional views of the vase receiver 202 and vase 212 of FIG. 12. As shown in FIG. 12, the vase receiver 202 may be mounted in the ground nearby the stone 12. As best shown in FIG. 13, the vase receiver 202 has a top opening 204, a first constriction point 206, a second constriction point 208, and a bottom opening 210. The bottom opening 210 is inserted into the ground (not shown) for holding the vase receiver 202. The vase 212 has a top opening 216, finger receptacles 220 and a closed bottom 224. As best shown in the cross-sectional view of FIG. 14, the vase 214 is inserted into the base receiver 202.

Figure 15:
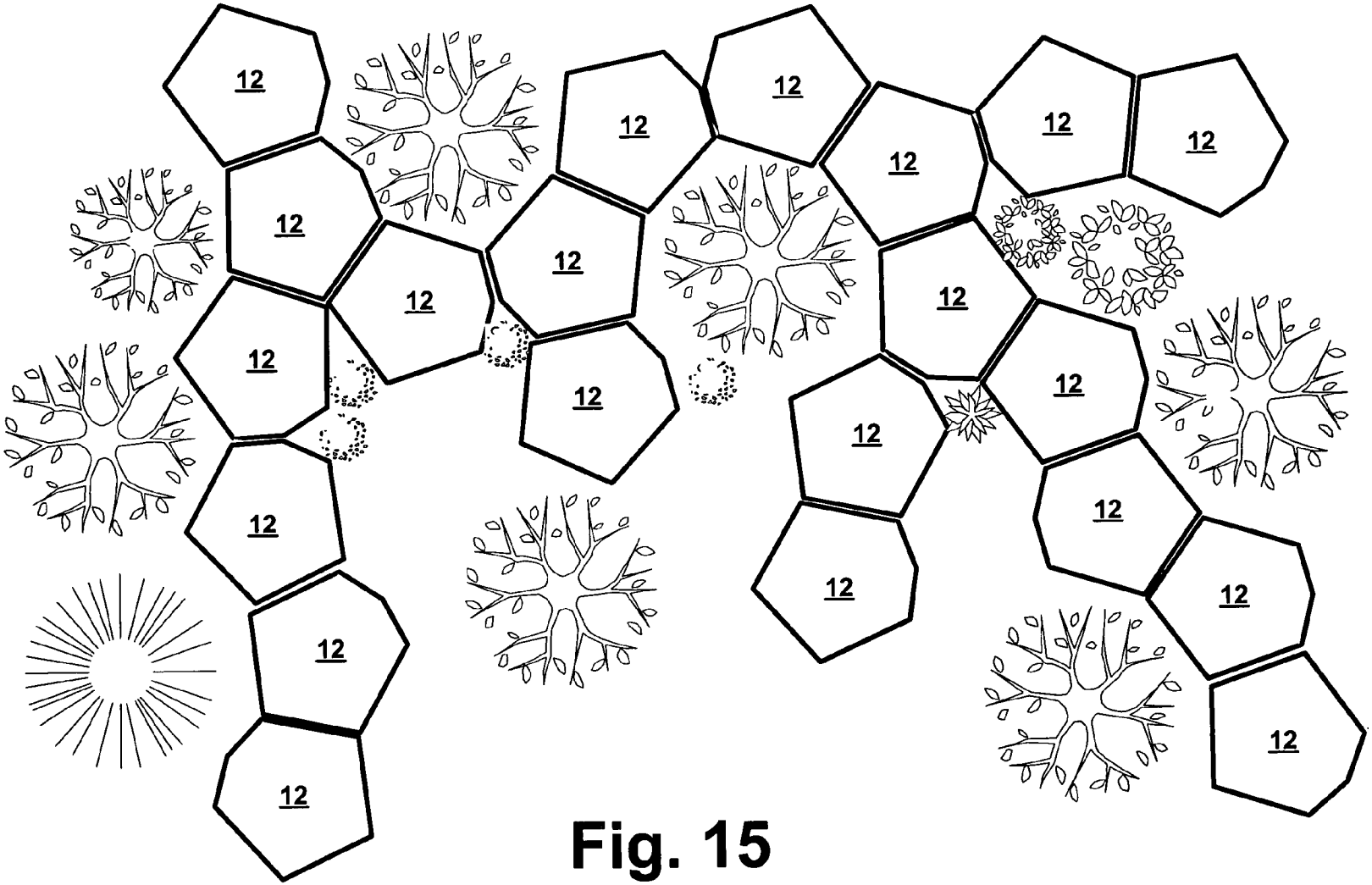
FIG. 15 is a top view of a serpentine arrangement of irregularly shaped hexagon stones of a cemetery landscape in accordance with yet another embodiment of the invention.

FIG. 15 is a landscape top view of a serpentine arrangement of irregularly shaped hexagon stones 12. Serpentine arrangement as depicted in FIG. 15 is for Columbarium pod units that are not put together by a surrounding frame, instead they are freely inserted into the ground as separate stand-alone units. The irregularly shaped hexagon stones 12 are shown in a serpentine array and a branched array wherein the substantial or equal pentagon sides as well as the smaller hexagon sides impart to the stone 12 the ability to take on multiple paths and so be patternized to adapt to existing terrain. For example as depicted in this terrain with existing shrubbery and trees, normally what would be unusable space in a conventional rectangular coffin system or in a substantially rectangular urn form, the multi-unit columbarium pod burial systems as shown for 10, 100 and 200 utilizing the irregular hexagon stone 12 can be adapted to multiple configurations.

Figure 16:
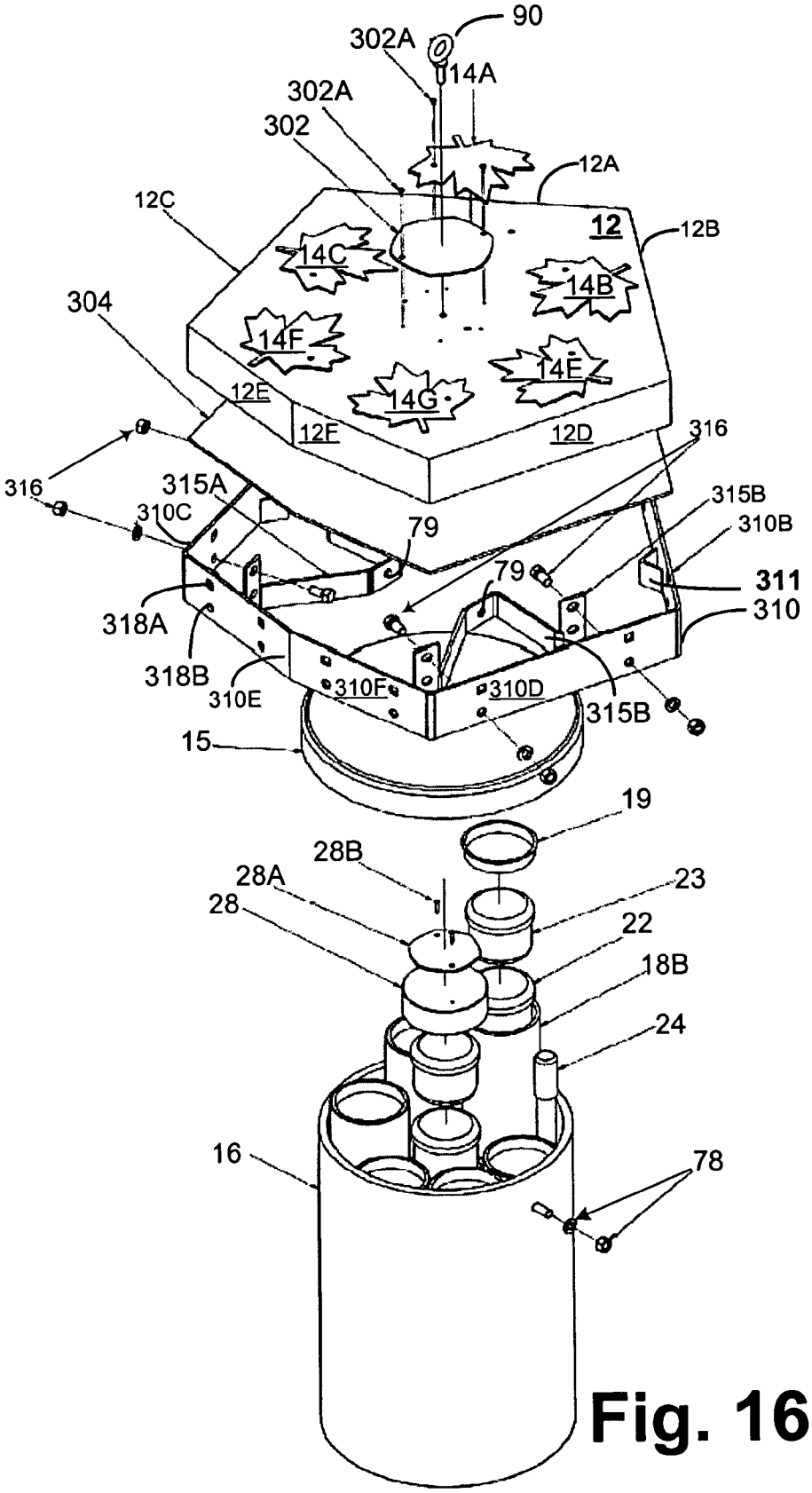
FIG. 16 is a perspective, partially exploded view of another embodiment of a multi-unit columbarium pod burial system with hexagon frame and securing brackets.

FIG. 16 is a perspective and exploded view of a preferred embodiment of the multi-unit columbarium pod burial system with hexagon frame and securing brackets. The irregular shaped hexagon stone 12 is shown with its first side 12A, second side 12B, third side 12C, fourth side 12D, fifth side 12E and sixth side 12F. On the stone 12 are the six memorial plagues 14A, 14B, 14C, 14D, 14F, and 14G. A verse plate 302 is shown suspended above the stone 12 and secured to the stone 12 by positioning projections 302A. The verse plate 302 is detachably removable to allow insertion of the mounting eyebolt 90 to permit positioning of the stone 12. In exploded view beneath the lid 15 and inside the tub 16 are a plurality of pods, here represented as second pod 18B, the ballast tube 24, the pod lid 19, the stabilizer 28, and a pod locater plate 28A mounted to the stabilizer 28 via mounting screws 28B.

Beneath the stone 12 is a stone pad 304 to provide support to the stone 12 and is placed inside a hexagon frame 310. Shown on the inside perimeter of the hexagon frame 310 is a support brace 311. Attached to the inside perimeter of the hexagon frame 310 is a first securing bracket 315A and a second securing bracket 315B. Each securing bracket has a tub-mounting orifice 79 and at least one frame-mounting orifice 81.

The frame 310 has a plurality of sides matching the sides of the stone 12. Visible in this perspective view is a second side 310B, a third side 310C, and fourth side 310D, a fifth side 310E, and a sixth side 310F. The frame 310 serves to enhance placement of the stone 12 during hoisting via ropes or chains attached to the eyebolt 90, or to provide uniform edges to cast concrete on the burial site. Interspersed along each side of the frame 310 are mounting orifices 318 configured to receive round or square shaped securing bolts. The first and second securing brackets 315A and 315B are mounted to the frame 310 by a nut-and-bolt assembly 316 placed through the frame-mounting orifice 81 and tightened. Each tub-mounting bolt assembly 78 inserted through the respective tub-mounting orifices 79 of the first secures the tub 16 to the frame 310 and second securing brackets 315A and 315B, and tightened.

Figure 17:
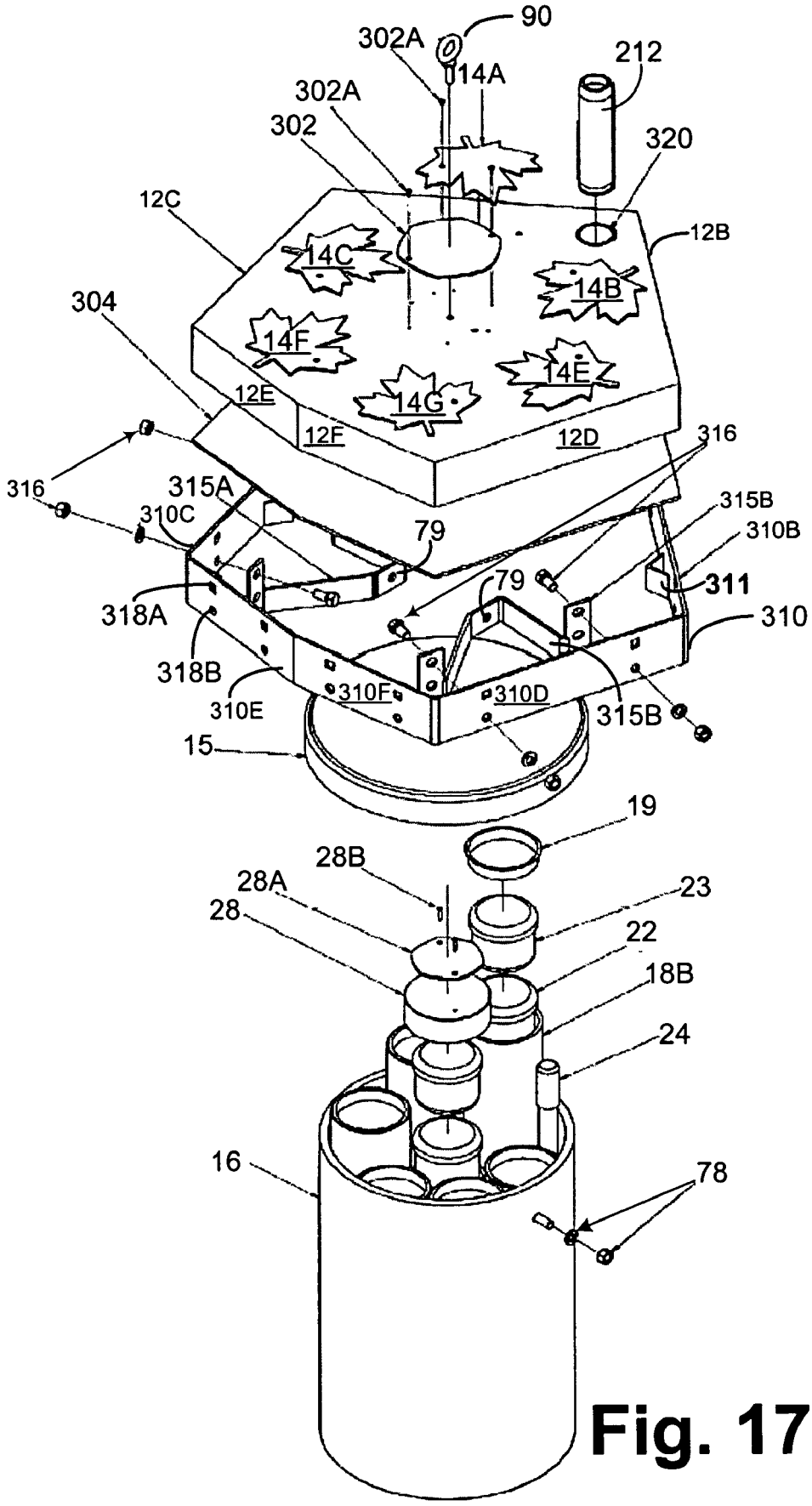
FIG. 17 is a perspective, partially exploded view of another embodiment of the multi-unit columbarium pod burial system with a frame, securing brackets, and vase.

FIG. 17 a perspective and exploded view of an alternate preferred embodiment of the multi-unit columbarium pod burial system with a hexagon frame, securing brackets, and vase. Essentially the same as FIG. 16, FIG. 17 shows the stone 12 having an aperture 320 to receive the vase 212.

FIG. 18A is a perspective view of a cover mold assembly. FIG. 18 shows a small cover mold assembly 402 configured to manufacture concrete or other durable materials stones equivalent to the small stone 12 of prior figures. The small cover assembly 402 has a top plate 406 reinforced by first plates supports 410, each plate support disposed approximately 90 degrees to the other, an articulated side 414, and a bottom plate 436 reinforced by second plate supports 439. The top plate 406 has a top edge 406A, and the bottom plate 436 has a bottom edge 436A. Along the top edge 406A is a first plurality of orifices (not shown), each orifice configured to receive a securing bolt 416. Along the top flange 414A is a second plurality of orifices (not shown), each orifice configured to receive the securing bolt 416. The first and second plurality of orifices are mutually spaced to co-align when the top edge 406A is co-adapted with the top flange 414A. Along the bottom flange 414A is a first plurality of cutouts 414C, and along the bottom edge 436A is a second plurality of cutouts 436B. The first cutouts 414C and the second cutouts 436B are mutually spaced to co-align when the bottom edge 426A is co-adapted with the bottom flange 414A. Along the bottom edge 436A is a plurality of first clamping devices 440, each first clamping device 440 pivoting from a first pivot base 443.

The articulated side 414 positioned with respect to the first side 406 and the second side 436 by articulation about hinges 418, and is secured to the top plate 406 and the bottom plate 436 by different mechanisms. The top plate 406 is secured to the upper flange 414A by a insertion and securing of each bolt of a plurality of bolts 416 through the orifices along the edge 406A and the orifices along the top flange 414A. The bottom plate 436 is secured to the bottom flange 414B by pivoting each first clamping device 440 through first and second cutouts 414C and 436B and securing each first clamping device 440 against a spacer plate 456. The perspective view of the stone mold assembly 402 shows an axis line B—B that proceeds along the top plate 406 along the support 410. Also present in FIG. 18A are two form handles 426 disposed diagonally to each other.

FIG. 18B is a top view of the small cover mold assembly. The top view of the small cover mold assembly 402 shows the top plate 406 and the first plate supports 410. Also shown in this figure are the bolts 416 and a partial view each first clamping device 440 along the bottom edge 436A (not shown). Also in slight partial view is a second clamping device 442. The diagonal arrangement of the form handles 426 are shown in FIG. 18B and an axis line A—A is shown bisecting first plate support 410 and the form handles 426.

Figure 18C:
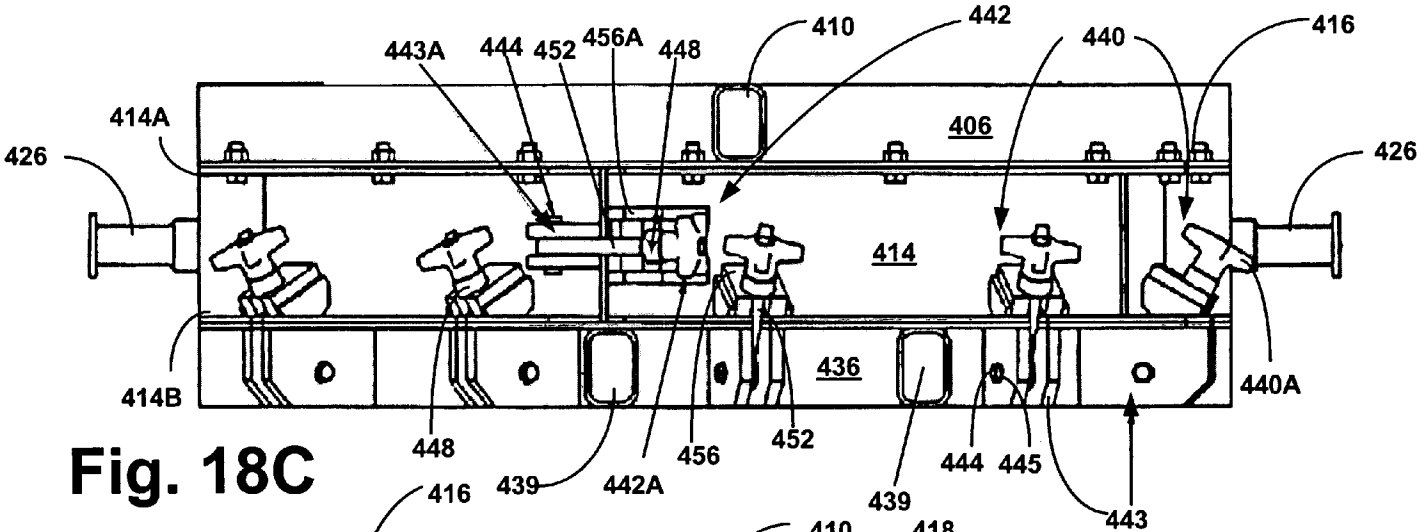
FIG. 18C is a side cross-sectional view of the cover mold assembly of FIG. 18A taken along line A—A.

FIG. 18C is a side view of the small cover mold 402 along line A—A. Adjacent to the side 414 are the two form handles 426 extending from the side 414. Here the first clamping device 440 is seen with its cooperating components. The components of the first clamping device 440 includes the first pivot base 443 made from two parallel plates holding an axel 444 inserted in an orifice 445 of the pivot base 443. The axel shaft 444 passes through and holds a handle shaft 452, the handle shaft having an axel section housing a channel (not shown) receiving the axel shaft 444, a middle section having a frictional lock 448, and a knob 440A. The operation of each first clamping device 440 to engageably secure the first bottom plate 436 to the side 414 begins with pivoting the handle shaft 452 between the space of the parallel plates of the pivot base 443, through the space of the first cutout 414C and the second cutout 436B until the frictional lock 448 engages the surfaces of the spacer plates 456. The knob 440A is rotated until sufficient friction is developed between the frictional lock 448 and the spacer plate 556 to hold the side 414 and the bottom plate 436 tightly together. Loosening the first clamping device 440 is accomplished by reversing the above operation to disengage each first clamping device 440 from the side 414.

Also visible in FIG. 18C is the second clamping device 442. The second clamping device 442 has the same components as the first clamping device 440, but is horizontally orientated to engage clamping action to close and secure the side 414 to enclose the cavity in the small stone mold 402. The components of the second clamping device 442 includes a pivot base 443A made from two parallel plates holding an axel 444 inserted in an orifice (not shown) of the parallel plates in the pivot base 443A. The axel shaft 444 passes through and holds the handle shaft 452, the handle shaft having an axel section housing a channel (not shown) receiving the axel shaft 444, a middle section having a frictional lock 448, and a second knob 442A. The tightening operation of the second clamping 442 is similar to the operation of the first clamping device 440 in that the handle 452 is swung to engage the frictional lock against the surface of spacer plate 456A and clamping action is conferred by rotating the second knob 442A to generate sufficient frictional resistance against the second spacer plate 456A. The loosening operation is the reverse of the tightening operation.

FIG. 18C also shows in side view the end of one of the first plate supports 410 on the top plate 406 and the ends of the second plate supports 439 on the bottom plate 439. The positioning of tightened bolts 416 securing the top plate 406 to the side 414 via the top flange 414A is seen in relation to the first clamping device 440 engaged against the bottom flange 414B.

Figure 18D:
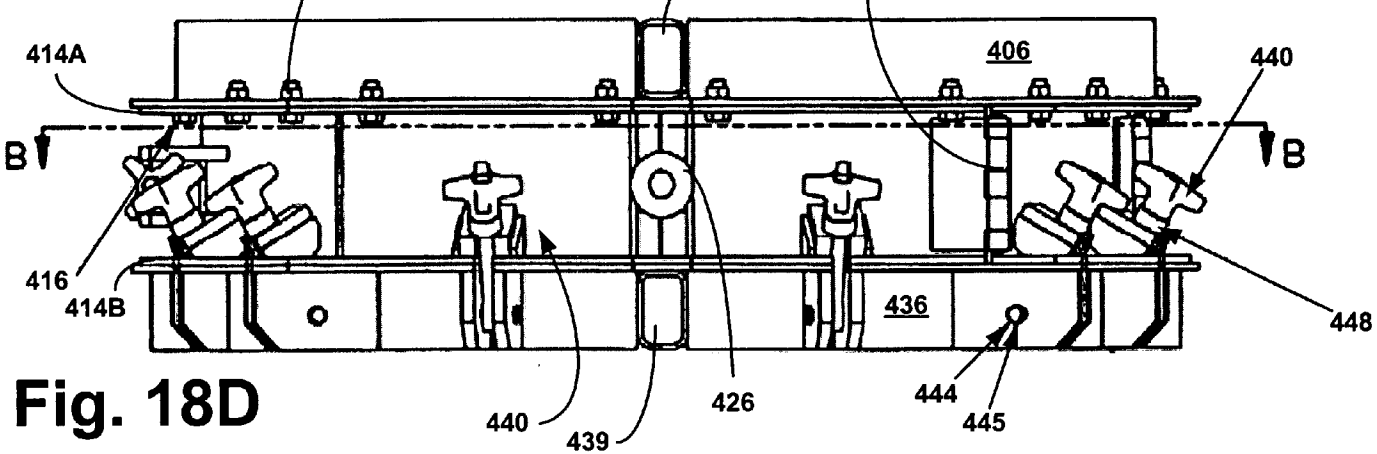
FIG. 18D is a side cross-sectional view of the cover mold assembly of FIG. 18A taken along line B—B.

FIG. 18D is a side view of the small cover mold assembly 402 along line B—B. Visible is the plurality of the first clamping devices 440, the bolts 416, and one of the form handles 426 which is parallel with one of the supports 410 of the top plate 406. Also visible are the ends the support 439 of the bottom plate 436. The positioning of tightened bolts 416 securing the top plate 406 to the side 414 via the top flange 414A is seen in relation to the first clamping device 440 engaged against the bottom flange 414B.

Figures 19A, 19B, 19C:
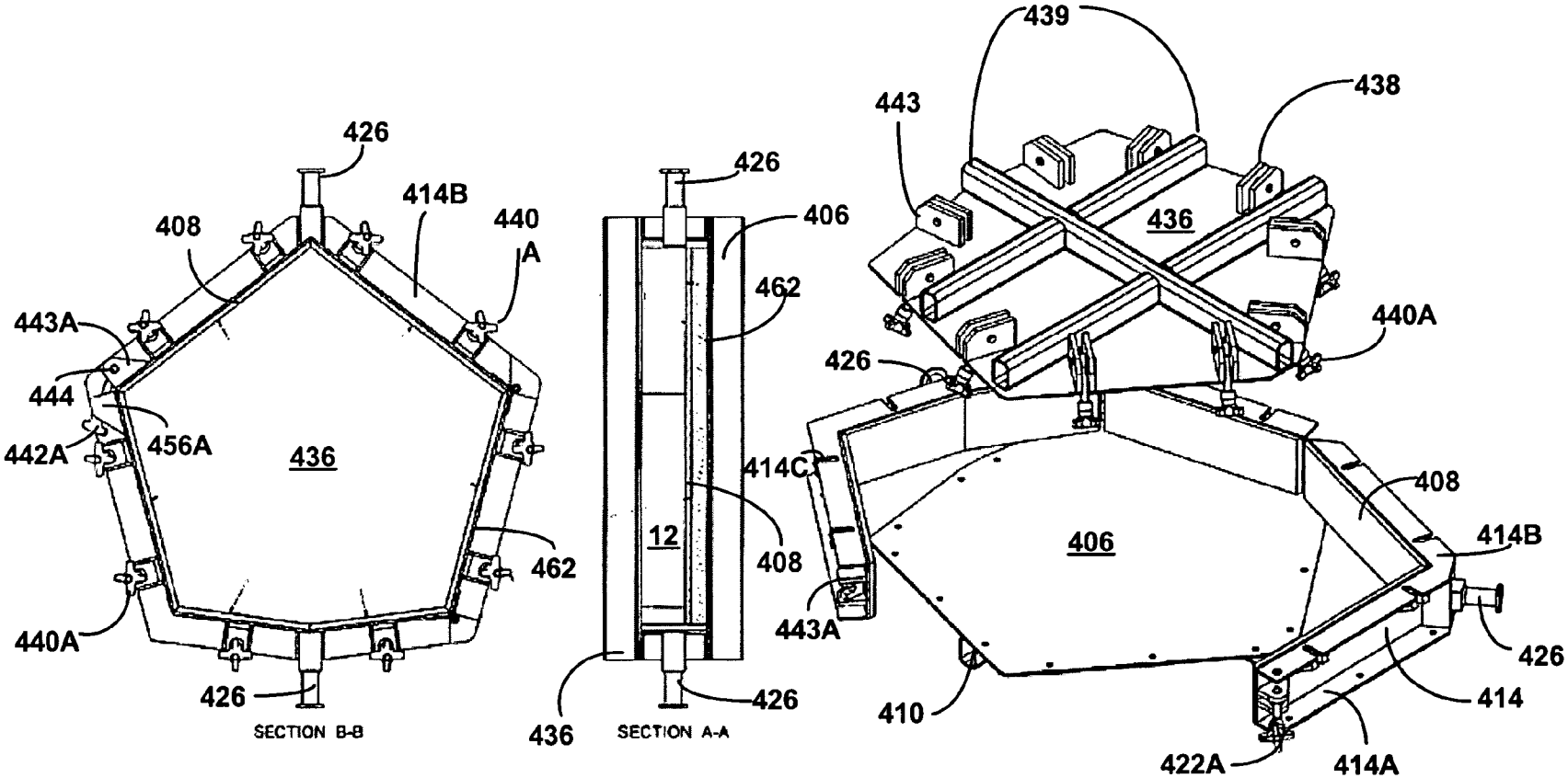
FIG. 19A is a cut-away top view of the cover mold assembly of FIG. 18A.
FIG. 19B is a cut-away view of the cover mold assembly of FIG. 18A taken along line A—A.
FIG. 19C is a perspective, partially-exploded view of the cover mold assembly of FIG. 18A.

FIG. 19A is a cut-away top view of the small stone mold 402. Visible in FIG. 19A is the bottom plate 436 on one which is a perimeter of mold inserts 462 which are segmented with each side of irregular hexagon of the small stone mold. Visible also are the mold form handles 426, the first clamping devices 440, and the second clamping device 442. The second clamping device 442 shows the pivot axel 444 and the second clamping device 442 engaged against the second spacer plate 456A. Other parts from FIGS. 18A–D are shown in FIG. 19A. Lining each wall of the side 414 are a texture liner 408 and a mold spacer 462. The texture liner 408 is made of ultra high molecular weight polyethylene (UHMWP) or other suitable thermoplastic or non-plastic substrate to which a decorative pattern is etched upon and subsequently imparted during the curing process to the side surfaces of what will become the small stone 12. Among the decorative patterns include simulated granite, sandstone, or any stylistic pattern. Adjacent to the texture liner 408 is the mold spacer 462 to press the etched pattern of the texture liner 408 into the side surfaces of the curing cement taking the form of the small stone 12. The texture liner 408 may be of sufficient thickness such that the mold space 462 is not required.

FIG. 19B is a cut-away view of the small cover mold 402 along line A—A. As shown between the top plate 406 and the bottom plate 436 and in between the two form handles 426 is the cement casting of what will become the small stone 12. On the top surface of what will become the small stone 12 is a texture liner 408. The texture liner 408 is made of ultra high molecular, weight polyethylene (UHMWP) or other suitable thermoplastic or non-plastic substrate to which a decorative pattern is etched upon and subsequently imparted during the curing process to the top surface of what will become the small stone 12. Among the decorative patterns include simulated granite, sandstone, or any stylistic pattern. Adjacent to the texture liner 408 is a mold spacer 462 to press the etched pattern of the texture liner 408 into the surface of the curing cement taking the form of the small stone 12. The texture liner 408 may be of sufficient thickness such that the mold space 462 is not required.

FIG. 19C is a perspective and exploded view of the small cover mold 402. Here the small stone mold 402 is inverted upside down such that bottom plate 436 is seen hovering over the top plate 406. The cavity within the small stone mold 402 is made visible by the uncoupling of the second clamping device 442 and pivoting the articulated side 414 about the hinges 418 to an open position. Other parts from FIGS. 18A–D are shown in FIG. 19C for reference.

Figure 20B:
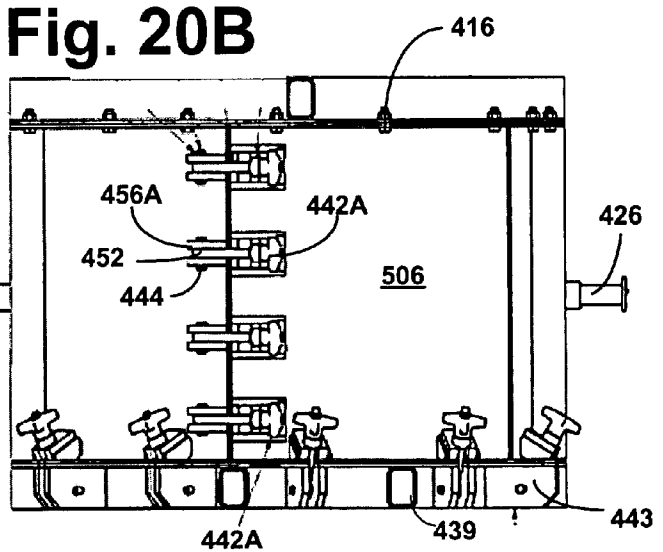
FIG. 20B is a side cross-sectional view of the large cover mold assembly of FIG. 20A taken along line A—A.
Figure 20C:
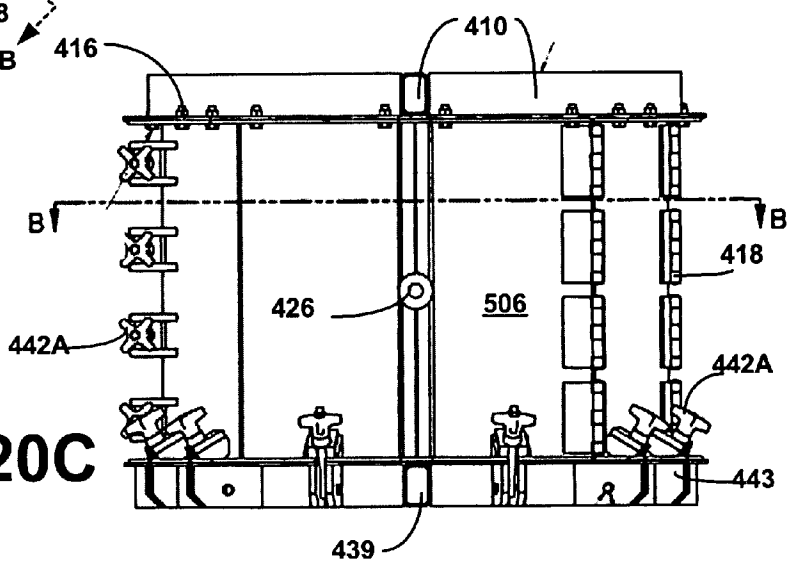
FIG. 20C is a side cross-sectional view of the large cover mold assembly of FIG. 20A taken along line B—B.
Figure 20A:
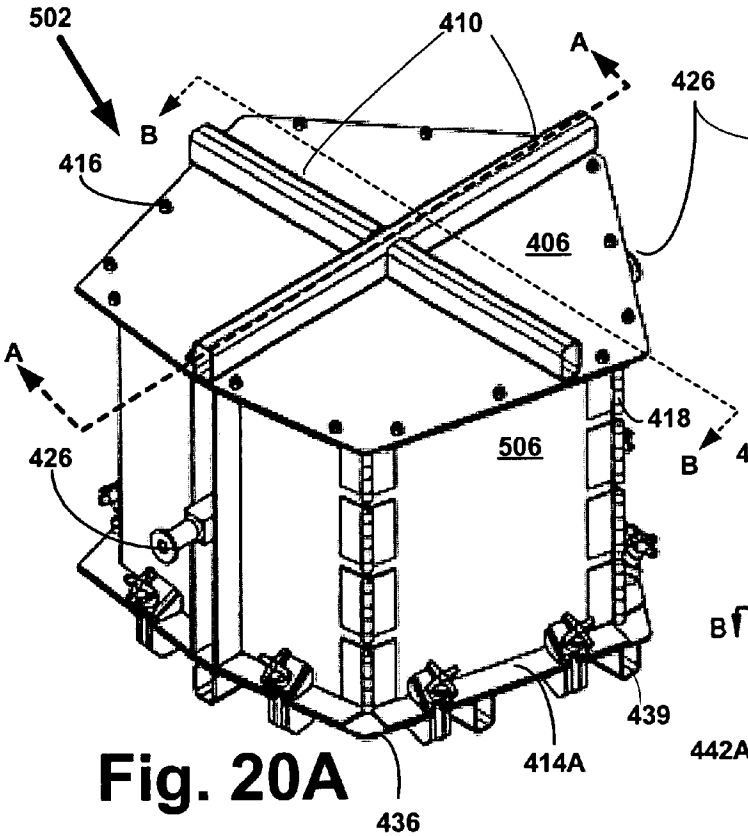
FIG. 20A is a perspective view of a large cover mold assembly in accordance with yet another embodiment of the invention.

FIG. 20A is a perspective view of a large cover mold 502 assembly. The large cover mold 502 has the same components of the small cover mold 402 except the articulated side 506 is taller than the articulated side 414 and has more hinges 418 and second clamping devices 442. Due to the increased size conferred by the taller articulated side 506, the cavity enclosed is accordingly larger for pouring cement to form a large stone 512. Other parts from FIGS. 18A–D are shown in FIG. 20A for reference. The operation of the first and second clamping devices 440 and 442 function the same in the large mold 502 as in the small mold 402.

FIG. 20B is a side view of the large cover mold 502 assembly along line A—A. Here the articulated side 506 can be more clearly seen in which four-second clamping device 442 are more clearly seen. Each of the second clamping device 442 closes the cavity to the large cover mold 502. Other parts from FIGS. 18A–D are shown in FIG. 20B for reference.

FIG. 20C is a side view of the large cover mold assembly 502 along line B—B. Other parts from FIGS. 18A–D are shown in FIG. 20C for reference.

Figure 21C:
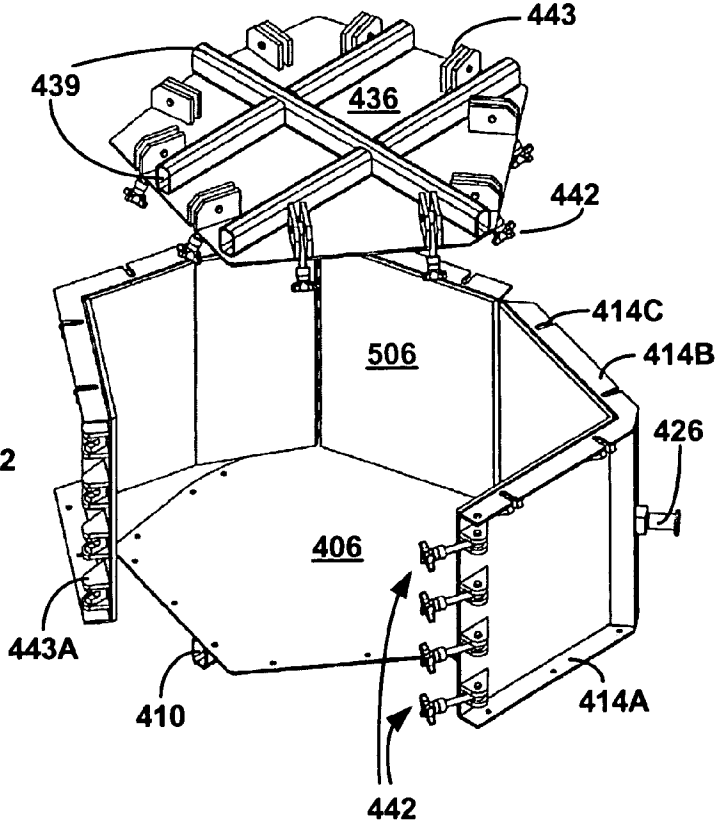
FIG. 21C is a perspective, partially-exploded view of the large cover mold assembly of FIG. 20A.
Figure 21B:
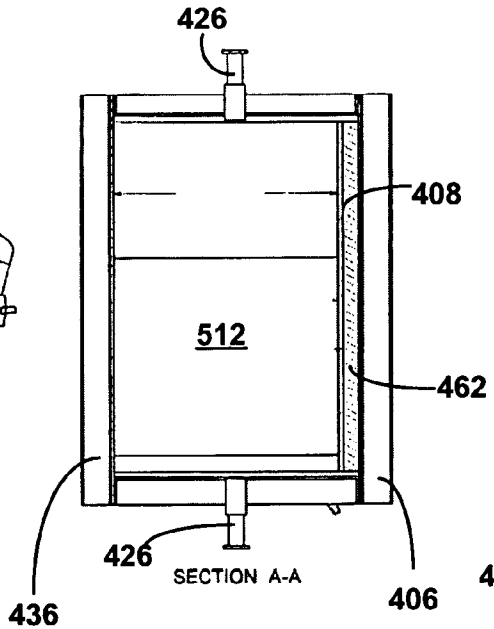
FIG. 21B is a cut-away view of the large cover mold assembly of FIG. 20A taken along line A—A.
Figure 21A:
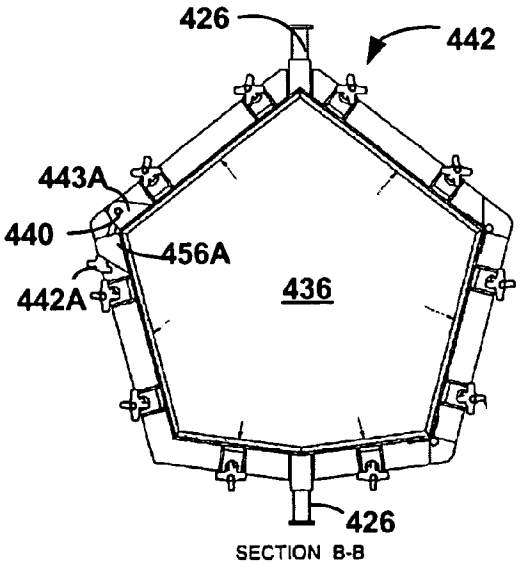
FIG. 21A is a cut-away top view of the large cover mold assembly of FIG. 20A.

FIG. 21A is a cut-away top view of the large cover mold 502. Other parts from FIGS. 18A–D are shown in FIG. 21A for reference. Lining each wall of the side 506 are the texture liner 408 and the mold spacer 462. The texture liner 408 is made of ultra high molecular weight polyethylene (UHMWP) or other suitable thermoplastic or non-plastic substrate to which a decorative pattern is etched upon and subsequently imparted during the curing process to the side surfaces of what will become the large stone 512. Among the decorative patterns include simulated granite, sandstone, or any stylistic pattern. Adjacent to the texture liner 408 is the mold spacer 462 to press the etched pattern of the texture liner 408 into the top surface of the curing cement taking the form of the large stone 512. The texture liner 408 may be of sufficient thickness such that the mold space 462 is not required.

FIG. 21B is a cut-away view of the large cover mold 502 along line A—A. As shown between the top plate 406 and the bottom plate 436 and in between the two form handles 426 is the cement casting of what will become the large stone 512. On the top surface of what will become the large stone 512 is the texture liner 408. The texture liner 408 is made of ultra high molecular weight polyethylene (UH-MWP) or other suitable thermoplastic or non-plastic substrate to which a decorative pattern is etched upon and subsequently imparted during the curing process to the top surface of what will become the large stone 12. Among the decorative patterns include simulated granite, sandstone, or any stylistic pattern. Adjacent to the texture liner 408 is the mold spacer 462 to press the etched pattern of the texture liner 408 into the top surface of the curing cement taking the form of the small stone 12. The texture liner 408 may be of sufficient thickness such that the mold space 462 is not required.

FIG. 21C is a perspective and exploded view of the large cover mold 502. Here the large cover mold 502 is inverted upside down such that bottom plate 436 is seen hovering over the top plate 406. The cavity within the large cover mold 502 is made visible by the uncoupling of each second clamping device 442 and pivoting the articulated side 506 about the hinges 418 to an open position. Other parts from FIGS. 18A–D are shown in FIG. 21C for reference.

Figures 22, 23, 24:
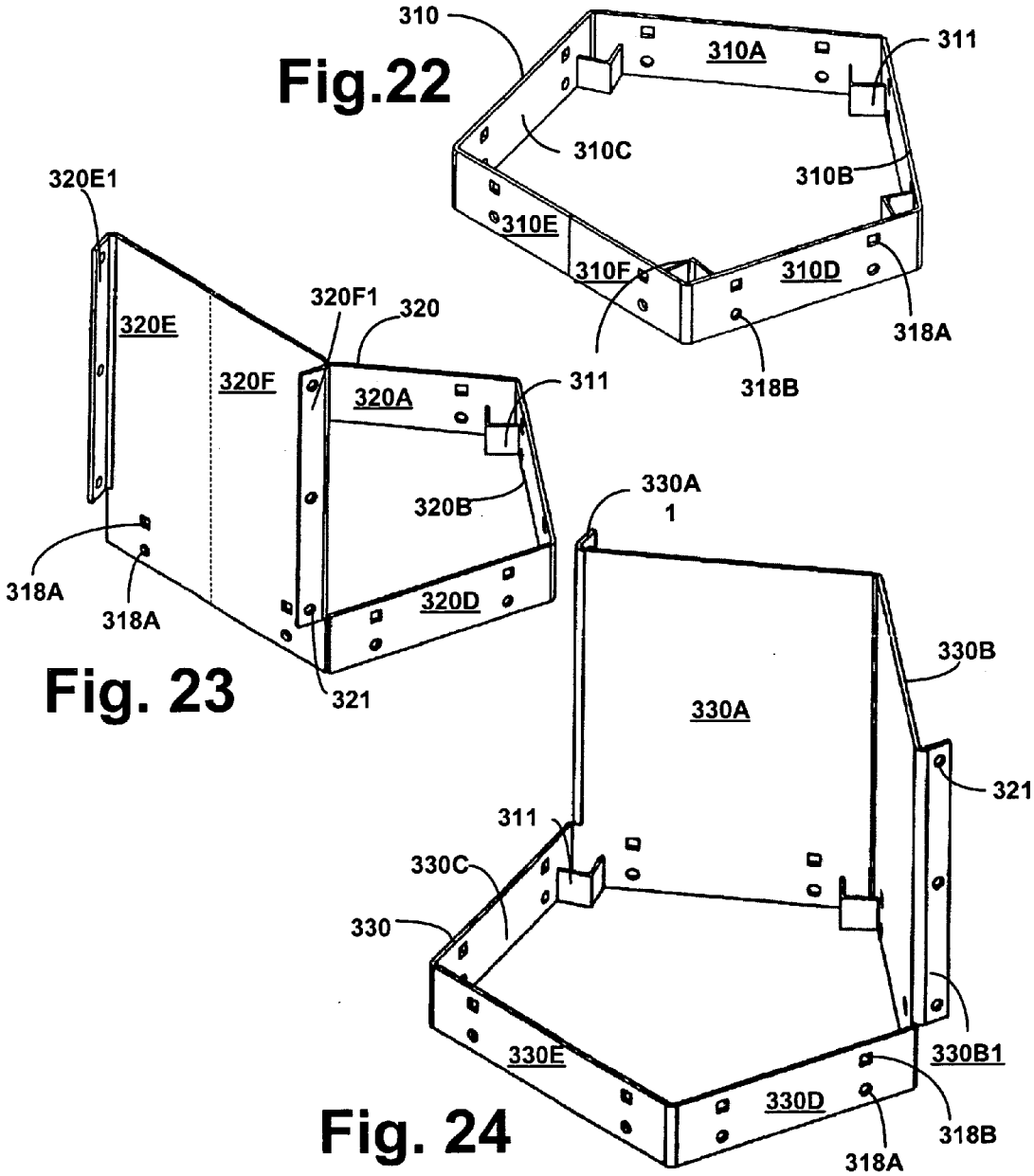
FIG. 22 is a perspective view of a frame of the cover mold assembly of FIG. 20A.
FIG. 23 is a perspective view of a frame with extended side.
FIG. 24 is a perspective view of a frame with adjacent extended sides.

FIG. 22 is a perspective view of a frame 310. The frame 310 is an irregular pentagon and has a first side 310A, a second side 310B, a third side 310C, a fourth side 310D, a fifth side 310E, and a sixth side 310F. The fifth side 310E and the sixth side 310F are minor sides substantially equal in size to each other but substantially smaller to the the more major dimensioned sides exhibited by the first, second, third, and fourth sides 310A–D. The internal brackets 311 support the Internal in the irregular pentagon 310 are a plurality of angel brackets 311 spaced as shown. The angle brackets 311 are at the vertices between first side 310A and second side 310B, between side second 310B and fourth side 310D, between first side 310A and third side 310C, and bridging fifth side 310E and sixth side 310F (bracket not shown). Each bracket supports the small stone or large stones. The angle between the first side 310A and the second side 310B is approximately 105 degrees. The angle between third side 310B and the fourth side 310D is approximately 112 degrees. The angle between the first side 310A and the third side 310C is approximately 112 degrees. The angle between third side 310C and the sixth side 310E is approximately 105 degrees. The angle between the fourth side 310D and sixth side 310E is approximately 105 degrees. The angle between the fifth side 310E and the sixth side 310F, being held straight together in one line by the angle bracket 311 fusing these sides together, is 180 degrees. Each side of the frame 310 has a first orifice 318A shown as a square and a second orifice 318B shown as a circle. Each orifice designed to receive bolts of either a squared or circular configuration for the purposes of connecting frames to other frames or for staggering the frames vertically in stepwise progression.

FIG. 23 is a perspective view of a frame with an extended side 320. The frame 320 is an irregular pentagon with an extended side and includes a first side 320A, a second side 320B, a third side 320C (not shown), a fourth side 320D, a fifth side 320E, and a sixth side 320F continuous and linear with the fifth side 320E. The fifth side 320E and the sixth side 320F are minor sides in that their dimension is substantially less than the more major sides 320A–D. The angle between the first side 320A and the second side 320B is approximately 105 degrees. The angle between third side 320B and the fourth side 320D is approximately 112 degrees. The angle between the first side 320A and the third side 320C is approximately 112 degrees. The angle between third side 320C and the fifth side 320E is approximately 105 degrees. The angle between the fourth side 310D and fifth side 320E is approximately 105 degrees. The fifth side 320E and the sixth side 320F each have extended backing that mutually merges, and the angle between the each minor side, being linearly connected, is 180 degrees. The backing of the fifth side 320E and has a first flange 320E1 and the backing of the sixth side 320F has a second flange 320F1, each flange having a plurality of orifices 321 to receive securing bolts. Internal in the frame 320 is a plurality of angel brackets 311 similarly distributed at the vertices as in the frame 310. Each side of the frame 320 has a first orifice 318A shown as a square and a second orifice 318B shown as a circle. Each orifice is designed to receive bolts of either a squared or circular configuration for the purposes of connecting frames to other frames or for staggering the frames vertically in stepwise progression.

FIG. 24 is a perspective view of a frame with adjacent extended sides 330. The frame 330 is an irregular pentagon and has a first side 330A, a second side 330B, a third side 330C, a fourth side 330D, and a fifth side 330E. The first side 330A is continuous with second side 330B both extending above the other sides of the irregular pentagon frame 330. The first extended side 330A has a flange 330A1 and a second extended side 330B has a flange 330B1. Each flange has a plurality of orifices 321 to receive securing bolts to couple with either a flange from the flame 320 or either flange from the frame 330. Internal in the frame 330 is a plurality of angel brackets 311 similarly distributed at the vertices as in the frame 320. The angles between each side are substantially the same as the angle between each side in the frame 320. Each side of the frame 330 has a first orifice 318A shown as a square and a second orifice 318B shown as a circle. Each orifice is designed to receive bolts of either a squared or circular configuration for the purposes of connecting frames to other frames or for staggering the frames vertically in stepwise progression.

Figure 25A:
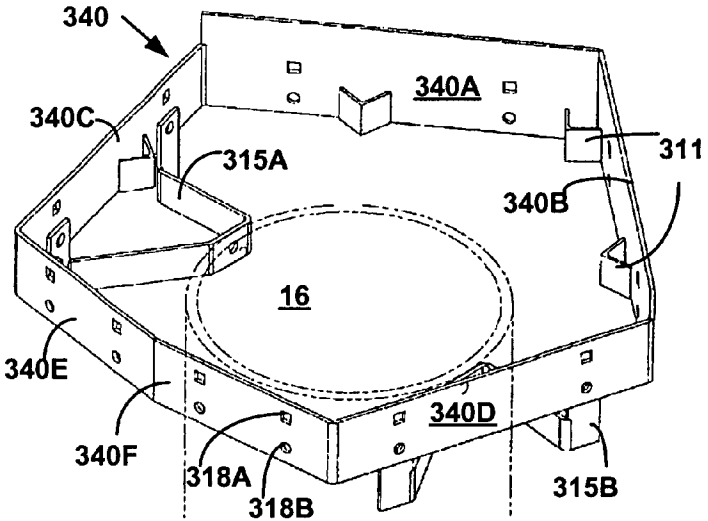
FIG. 25A is a perspective view of a frame with adjacent extended large sides.

FIG. 25A is a perspective view of a frame with adjacent extended large sides 340. The frame 340 is an irregular hexagon and is comprised of a first side 340A, a second side 340B, third side 340C, a fourth side 340D, a fifth side 340E, and a sixth side 340F. The first side 340A is slightly extended above the third side 340C. The second side 340B is slightly extended above the fourth side 340D. The first and second sides 340A and 340B are of substantially the same extension. Each side of the frame 340 has a first orifice 318A shown as a square and a second orifice 318B shown as a circle. Each orifice is designed to receive bolts of either a squared or circular configuration. For the purposes of connecting frames to other frames or for staggering the frames vertically in stepwise progression. Also shown in FIG. 25A is the tub 16, which is shown adjacent to and touching the first bracket 315A and the second bracket 315B. Internal within the frame 340 are the angel brackets 311 destributed at the vertices or midsection of first, second, third, and fourth (not shown) sides 340A, 340B, 340C, and 340D. The angle between the first side 310A and the second side 310B is approximately 105 degrees. The angle between the second side 310B and the fourth side 310D is approximately 112 degrees. The angle between the first side 310A and the third side 310C is approximately 112 degrees. The angle between the fourth sides 310D and sixth side 310F is approximately 112 degrees. The angle between the third side 310C and the fifth side 310E is approximately 112 degrees. The angle between the fifth side 310E and the sixth side 310F is approximately 165 degrees. The bracket 311 (not shown)

spanning the 165 degree vertex between the fifth side 340E and the sixth side 340F is configured to flex out and support these two minor sides to confer the 165 degree angle. Each side of the frame 340 has a first orifice 318A shown as a square and a second orifice 318B shown as a circle. Each orifice is designed to receive bolts of either a squared or circular configuration for the purposes of connecting frames to other frames or for staggering the frames vertically in stepwise progression.

Figure 25B:
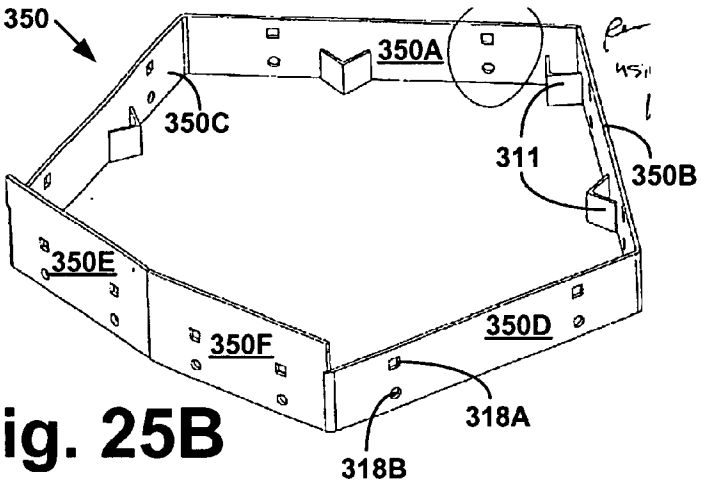
FIG. 25B is a perspective view of a frame with adjacent extended small sides.

FIG. 25B is a perspective view of a frame with adjacent extended small sides 350. The frame 350 is an irregular hexagon and is comprised of a first side 350A, a second side 350B, third side 350C, a fourth side 350D, a fifth side 350E, and a sixth side 350F. The fifth side 350E is slightly extended above the third side 350C. The sixth side 350E is slightly extended above side the fourth side 350D. The fifth side 350E and the sixth side 350F are of substantially the same extension. The bracket 311 (not shown) spanning the 165 degree vertex between the fifth side 350E (a minor side) and the sixth side 350F (also a minor side) is configured to flex out and support these two minor sides to confer the 165 degree angle. The angles between each side are substantially the same as the angle between each side in the frame 340. Each side of the frame 350 has a first orifice 318A shown as a square and a second orifice 318B shown as a circle. Each orifice is designed to receive bolts of either a squared or circular configuration for the purposes of connecting frames to other frames or for staggering the frames vertically in stepwise progression. The minor sides 350E and 350F are slightly extended above the major sides 350A through 350D.

Figure 25C:
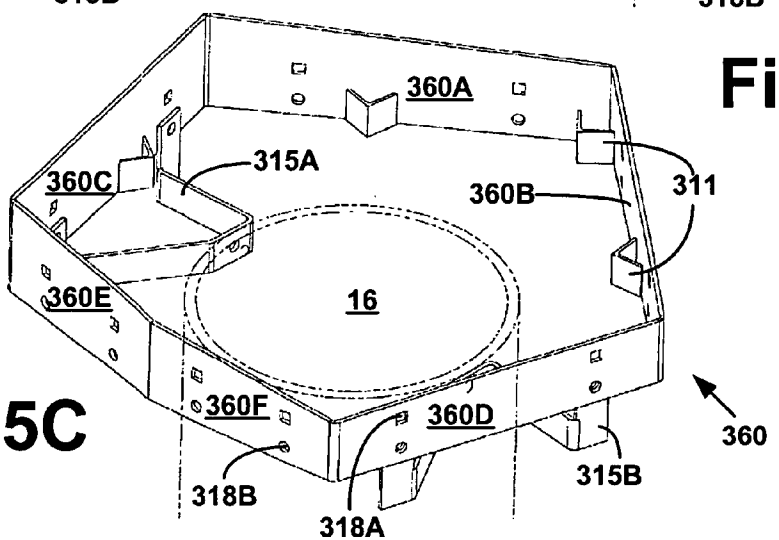
FIG. 25C is a perspective view of a frame with adjacent slanted sides.

FIG. 25C is a perspective view of a frame with adjacent slanted sides. The frame 360 comprises is an irregular hexagon and includes a first side 360A, the first side 360A having a slant, a second side 360B, the second side 360B having a slant, a third side 360C, the third side 360C not having a slant, a fourth side 360D not having a slant and the lowest height to the other sides having a slant, a fifth side 360E is continuous with the third side 360E, the fifth side 360E being a minor side and having a slant, and a sixth side 360F, the sixth side 360F being continuous with the fifth side 360E and having a slant and connected to the fourth side 360D. The angles between each side are substantially the same as the angle between each side in the frames 340 and 350. The bracket 311 (not shown) spanning the 165 degree vertex between the fifth side 360E and the sixth side 360F is configured to flex out and support these two minor sides to confer the 165 degree angle. Each side of the frame 360 has a first orifice 318A shown as a square and a second orifice 318B shown as a circle. Each orifice is designed to receive bolts of either a squared or circular configuration for the purposes of connecting frames to other frames or for staggering the frames vertically in stepwise progression. Also shown in FIG. 25C is the tub 16, which is shown adjacent to and touching the first bracket 315A and the second bracket 315B.

Figure 26:
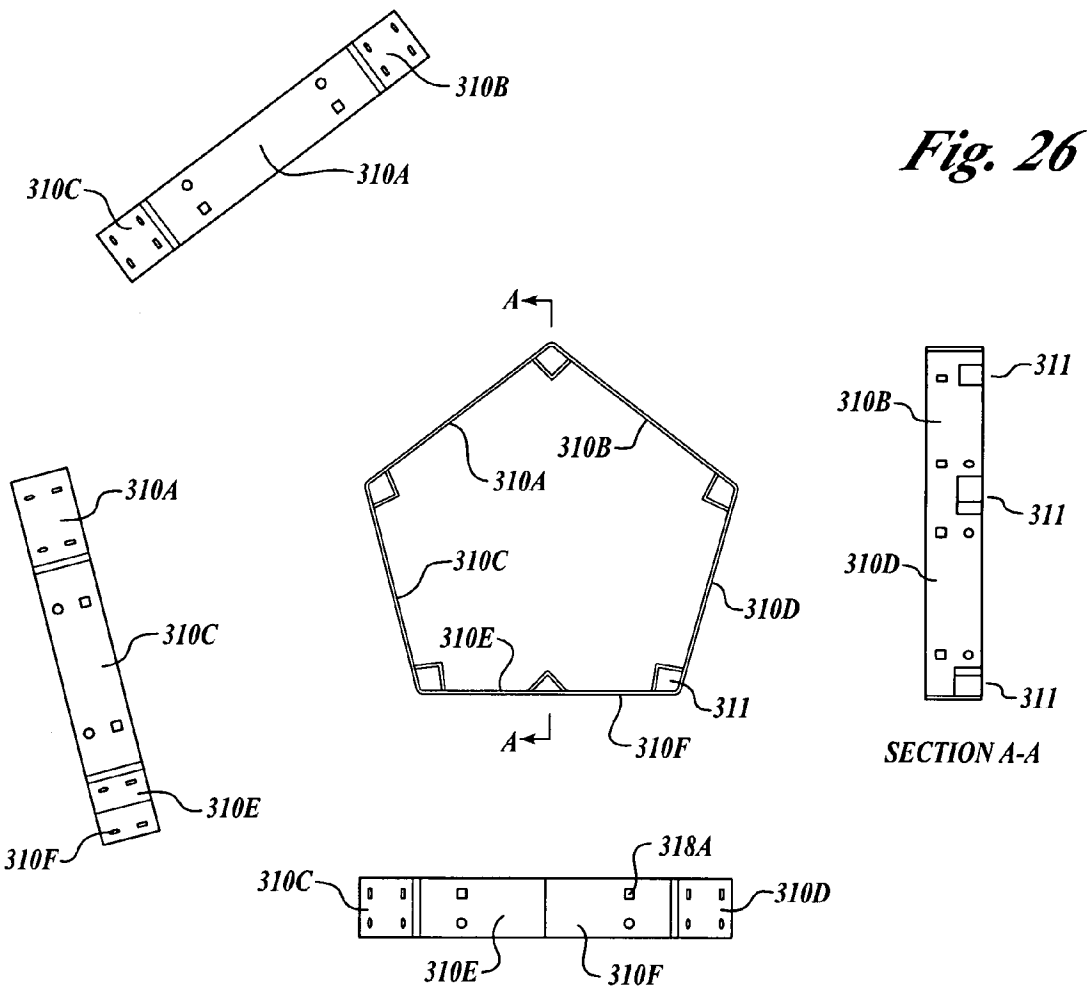
FIG. 26 is a top and side views of a frame.

FIG. 26 is a top and side view of an irregular pentagon frame 310. The first side 310A is approximately 16.5 inches long and 4 inches high. The second side 310B is approximately 16.5 inches long and 4 inches high. The angle between side 310A and 310B is approximately 105 degrees. The third side 310C is approximately 15.1 inches long and 4 inches high. The angle between the third side 310C and the first side 310A is approximately 112 degrees. The fourth side 310D is also approximately 15.1 inches long and 4 inches high with an angel between the second side 310B and the fourth side 310D being approximately 112 degrees. The fifth side 310E is approximately 9.2 inches long and 4 inches high. The sixth side 310F is approximately 9.2 inches long and 4 inches high. The angle between the fifth side 310E and the third side 310F is approximately 105 degrees, and the angle between the fourth side 310D and the sixth side 310F is approximately 105 degrees. The angle between the two minor sides 310E and 310F, being bridged by the bracket 311, is 180 degrees. The frame 310 is made from quarter inch metal stock. On each side are two first orifices 318A of a substantially squared configuration and two second orifices 318B of a substantially circular configuration. The first orifices are located approximately 1 inch from the edge of each side and are spaced according to the length of each side. For example, the first orifices 318A are spaced approximately 1 inch from the bottom edge side 310A and are separated by approximately 10 inches. Similarly, the second orifices 318B are approximately 1 inch from the center of the orifices from the edge and similarly spaced about 10 inches apart. The distance from center to center between each squared and circular orifices is approximately 2 inches. The same geometrical configuration applies to the second side 310B. For the third 310C and the fourth side 310D the spacing between the orifices is approximately 9 inches along the length and 2 inches between the orifices, each orifices being spaced from the edge by approximately 1 inch. For the fifth side 310E the distance between the orifices along the length of the side is approximately 12 inches and the spacing along the height of the frame is approximately 2 inches. Each orifice being measured from the orifice center to edge by about one inch. The angle brackets 311 are located at the vertices of each angle and in a mid-section spanning the minor sides 310E and 310F.

Figure 27:
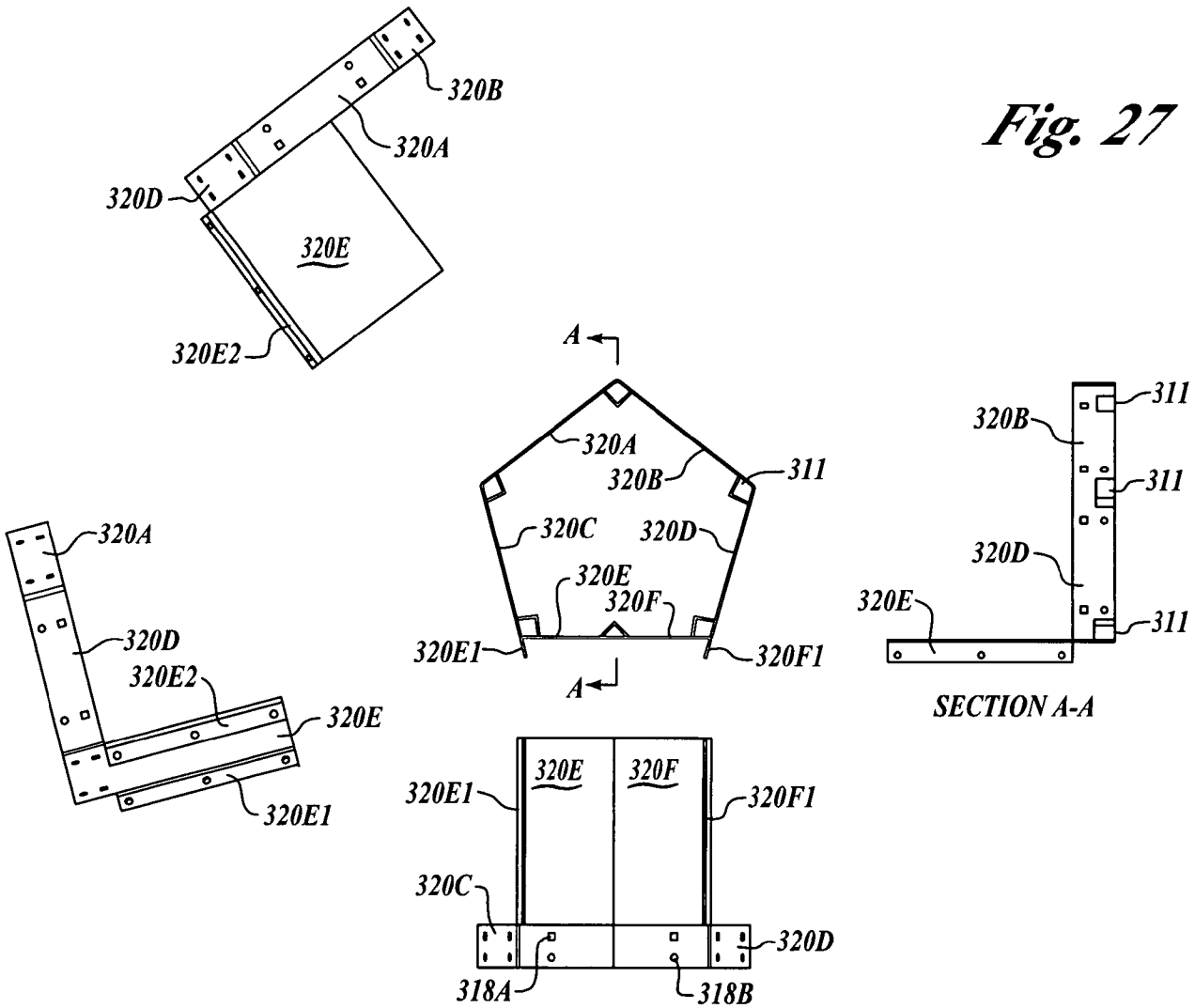
FIG. 27 is a top and side views of the frame with extended side.

FIG. 27 is a top and side views of the irregular pentagon frame with extended side. The first side 320A is approximately 16.5 inches long and 4 inches high. The second side 320B is approximately 16.5 inches long and 4 inches high. The angle between side 320A and 320B is approximately 105 degrees. The third side 320C is approximately 15.1 inches long and 4 inches high. The angle between side 320C and side 320A is approximately 112 degrees. The fourth side 320D is also approximately 15.1 inches long and 4 inches high with an angel between side 320B and 320D being approximately 112 degrees. The fifth side 320E is approximately 18.4 inches long and 4 inches high. The angle between the fifth side 320E and the third side 320C is approximately 105 degrees, and the angle between the fourth side 320D and the sixth side 320F is approximately 105 degrees. The angle between the two minor sides 320E and 320F, being bridged by the bracket 311, is 180 degrees. The frame 320 is made from quarter inch metal stock. The frame 320 is made from quarter inch metal stock. On each side are two first orifices 318A of a substantially squared configuration and two second orifices 318B of a substantially circular configuration. The first orifices are located approximately 1 inch from the edge of each side and are spaced according to the length of each side. For example, the first orifices 318A are spaced approximately 1 inch from the bottom edge side 320A and are separated by approximately 10 inches. Similarly, the second orifices 318B are approximately 1 inch from the center of the orifices from the edge and similarly spaced about 10 inches apart. The distance from center to center between each squared and circular orifices is approximately 2 inches. The same geometrical configuration applies to the second side 320B. For the third 320C and the fourth side 320D the spacing between the orifices is approximately 9 inches along the length and 2 inches between the orifices, each orifices being spaced from the edge by approximately 1 inch. For the fifth side 320E the space distance between the orifices along the length of the side is approximately 12 inches and the spacing along the height of the frame is approximately 2 inches. Each orifice being measured from the orifice center to the edge by about one inch. The angle brackets 311 are located at the vertices of each angle and in a mid-section spanning the minor sides 320E and 320F. The extended side extends from the fifth and minor side 320E to the sixth and minor side 320F and being approximately 18.4 inches long and 18 inches tall. The first flange 320E1 and the second flange 320F1 extending from the extended side 320E is approximately 2 inches wide and 14 inches long from the top of the extended side 320E. Along each extension are 3 orifices. The first orifice located approximately 1 inch from the bottom end of the flange. The second orifice located approximately 6 inches center to center from the first orifice and the third orifice located approximately 6 inches center to center from the second orifice and the third orifice being approximately one inch from the top of the flange.

Figure 28:
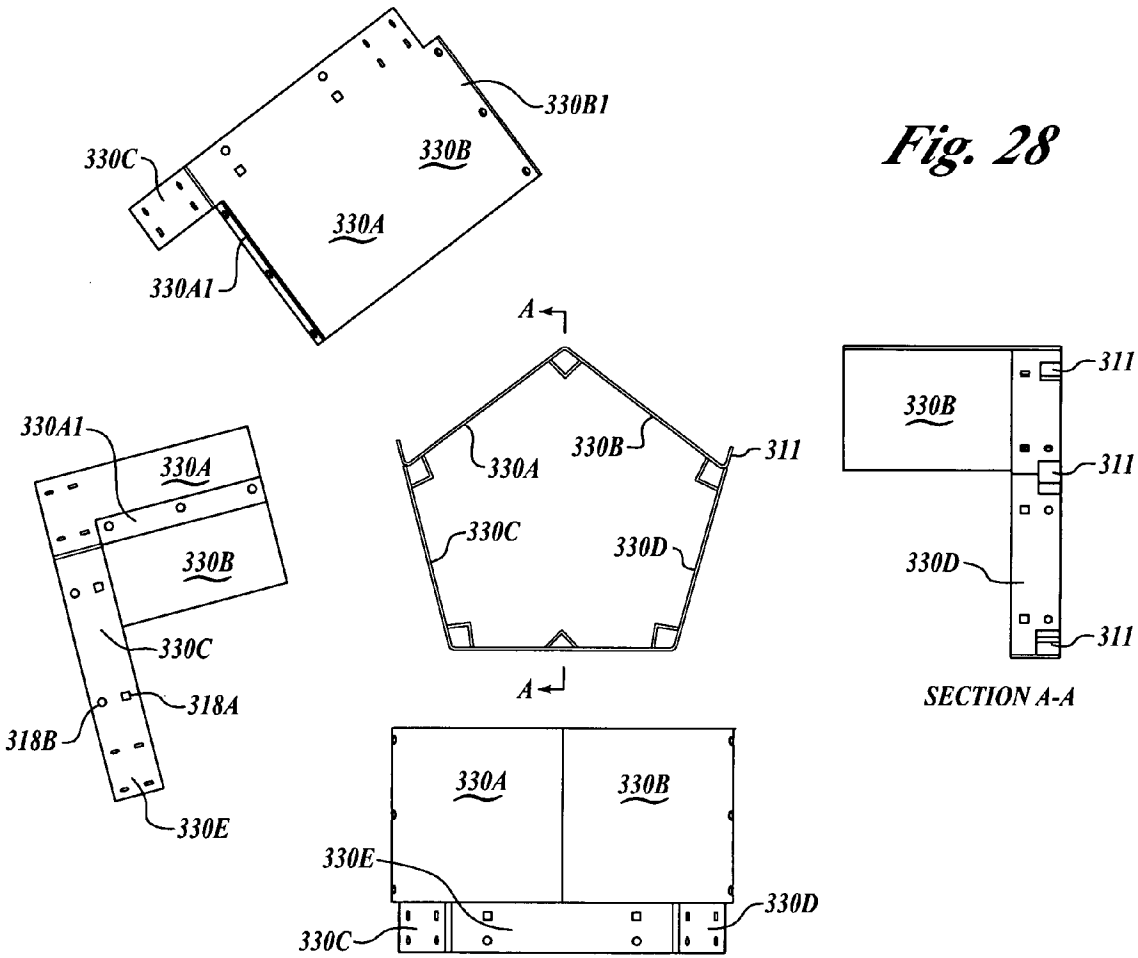
FIG. 28 is a top and side views of the frame adjacent extended large sides.

FIG. 28 is a top and side views of the irregular pentagon frame with adjacent extended large sides 330. Substantially the same as frame 320, frame 330 has a first side 330A, a second side 330B, a third side 330C, a fourth side 330D, a fifth and minor side 330E, and a sixth and minor side 330F that is mutually linear and continuous with the fifth minor side 330E. The extensions extend from the first side 330A and 330B, the extension being continuous with each other. The approximate length of the extensions is 18 inches tall. There is similarly a flanged section from each extension, for example, a first flange 330A1 continuous with the extended back of first side 330A, and a second flange 330B1, continuous with the extended back of the second side 330B. Each flange has a plurality of orifices configured to receive bolts for securing the flanges to other flanges of adjacent frames, for examples, to either another frame 330 or frame 320. The distribution of each bracket 311 in the frame 330 is substantially the same as in frames 320 and 310. The angle of the vertices for the frame 330 is substantially the same as in frames 320 and 320. The non-extension dimensions of the major and minor sides for the frame 330 are substantially the same as in frames 320 and 320. The dimension and configuration of the first orifice 318A shown as a square and the second orifice 318B shown as a circle for the frame 330 are substantially the same as in frames 320 and 310. Each orifice is designed to receive bolts of either a squared or circular configuration for the purposes of connecting frames to other frames or for staggering the frames vertically in stepwise progression.

Figure 29A:
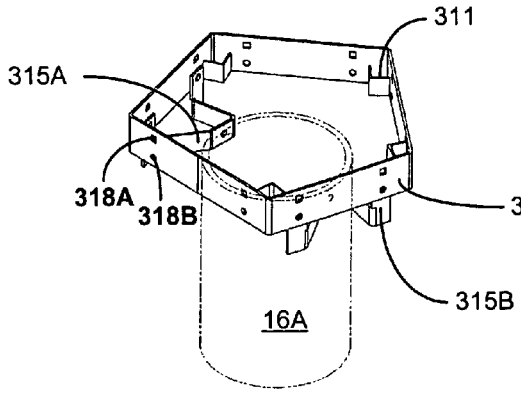
FIG. 29A is a perspective view of a frame connected to a small tub.

FIG. 29A is a perspective view of a pentagon frame connected to a small tub. The frame 310 is connected to the small tub 16A by the first securing bracket 315A and the second securing bracket 315B. The tub 16A as shown in this figure is approximately 14 inches in diameter. The frame 310 is shown with the first orifice 318A and the second orifice 318B and the bracket 311. The small tub 16A is configured to hold three pods.

Figure 29B:
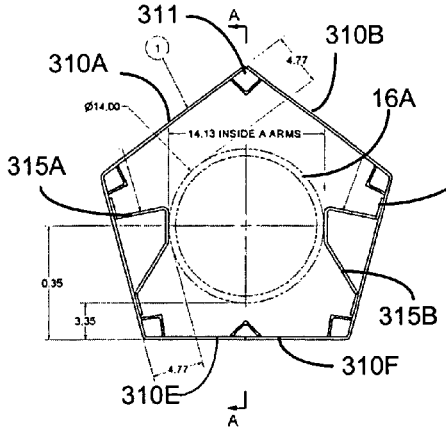
FIG. 29B is a top view of a frame connected to a small tub.

FIG. 29B is a top view of an irregular pentagon frame connected to a small tub. The small tub 16A is approximately 16 inches in diameter and shows the first and second securing bracket 315A and 315B positioned to hold the small tub 16A approximately 4.8 inches from the first side 310A and the second side 310B, and approximately 3.4 inches from the minor sides 310E and 310F.

Figure 29C:
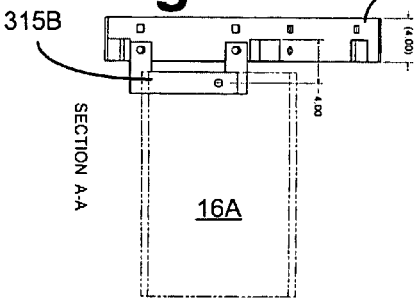
FIG. 29C is a side view of a frame connected to a small tub.

FIG. 29C is a side view of an irregular pentagon frame connected to a small tub. The small tub 16A is shown position approximately 4 inches beneath the frame 310 by the physical spacing conferred by the first and second brackets 315A and 3151B.

Figure 30A:
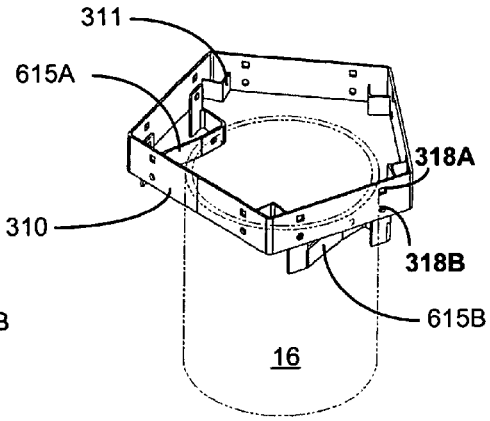
FIG. 30A is a perspective view of a frame connected to a large tub.

FIG. 30A is a perspective view of a pentagon frame connected to a large tub 16. The frame 310 is connected to the large tub 16 by the first securing bracket 615A and the second securing bracket 615B. The large tub 16 as shown in this figure is approximately 18 inches in diameter and is configured to hold seven pods. The frame 310 is shown with the first orifice 318A and the second orifice 318B and the bracket 311.

Figure 30B:
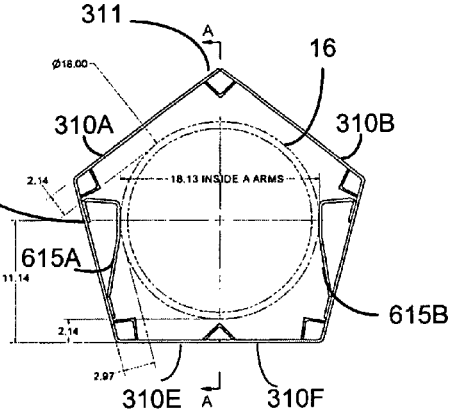
FIG. 30B is a top view of a frame connected to a large tub.

FIG. 30B is a top view of a pentagon frame connected to a large tub 16. The large tub 16 is approximately 16 inches in diameter and shows the first and second securing bracket 615A and 615B to position the frame 310 such that the first side 310A and the second side 310B are approximately 2.1 inches from the large tub 16 and the minor sides 310E and 310F is approximately 2.1 inches from the large tub 16.

Figure 30C:
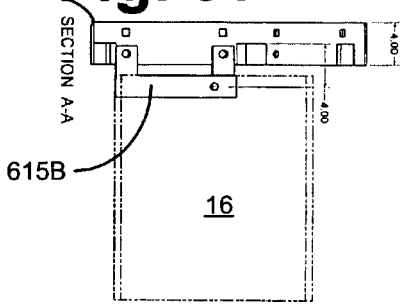
FIG. 30C is a side view of a frame connected to a large tub.
Figure 31A:
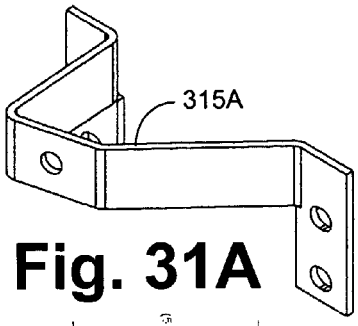
FIG. 31A is a perspective view of a double hole left-handed securing bracket.

FIG. 30C is a side view of a pentagon frame connected to a large tub. The frame 310 is positioned approximately 4 inches above the large tub 16 by the geometry conferred by the first and second securing brackets 615A and 615B FIG. 31A is a perspective view of a double-hole left-handed securing bracket 315A. The double hole left handed securing bracket 315A is made from approximately ¼ inch metal stalk and has four bends.

Figure 31B:
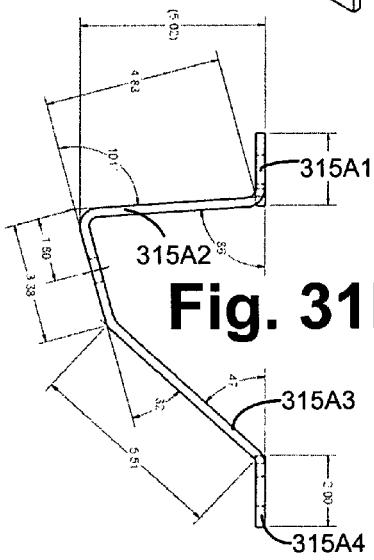
FIG. 31B is a top view of a double hole left-handed securing bracket.

FIG. 31B is a top view of a double-hole left-handed securing bracket 315A and shows the geometric configuration of the four bends and approximate dimensions. The bracket 315A is for securing to the small tub 16A, the small tub 16A being approximately 14 inches in diameter. There are four sections to the bracket through 315A, a first section 315A1, a second section 315A2, a third section 315A3 and a fourth section 315A4. The first section 315A1 is approximately 2 inches long and houses two orifices, the orifices being separated by approximately 2 inches center to center. The first section, 315A1 makes an approximate 104° turn into section 315A2, which is approximately 4.8 inches long. Thereafter, section 315A2 continues and makes an approximate 80° turn and continues for about 3.4 inches. In the center of the 3.4 inches is a mounting hole. Section 315A2 then merges into 315A3, which is approximately 32 from section 315A2 and is approximately 5.5 inches. Thereafter section 315A3 merges into section 315A4 by turning approximately 130 degrees relative to section 315A3. Section 315A4 is approximately 2 inches long and houses two orifices. The sections 315A1 and 315A4 are mutually collinear to each other and contact the sides of the irregular pentagon and hexagon frames for insertion and securing of bolts 316 of aligned securing bracket orifices with either orifices 318A or 318B of the frame sides.

Figure 31C:
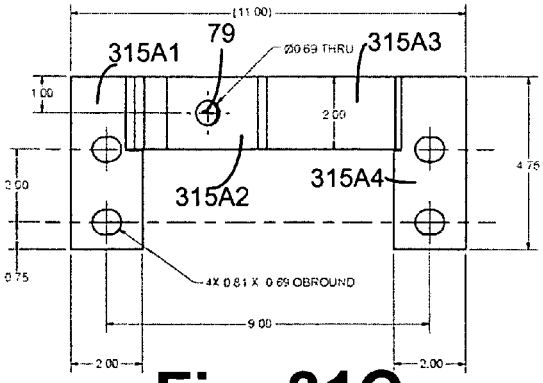
FIG. 31C is a side view of a double hole left-handed securing bracket.

FIG. 31C is a side view of a double-hole left-handed securing bracket 315A. The side view shows the four sections, 315A1, A2, A3 and A4 in which the bracket has an approximate height of 4.75 inches, length of 11 inches. Two orifices for receiving bolts are shown in section 315A1 and the first orifice is approximately ¾ inch from the bottom of section 315A1 to the center of the first orifice, and the second orifice is approximately 2 inches above the first orifice. Each orifice is recessed approximately 1 inch on center from the side of section 315A1. Section 315A2 shows the position of the mounting orifice 79 and is approximately 1 inch from center from the top edge of section 315A2. Thereafter section 315A3 continues and merges into section 315A4 where a companion set of orifices similarly disposed as in section 315A1 are similarly disposed in section 315A4.

The inter-orifice distance between the orifices in section 315A1 and the orifices in section 315A4 is approximately 9 inches.

Figure 32A:
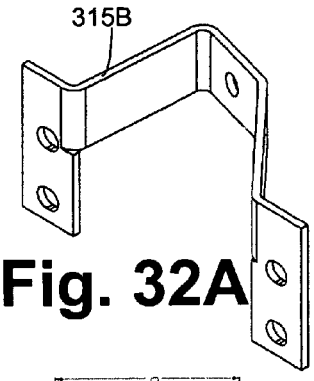
FIG. 32A is a perspective view of a double hole right-handed securing bracket.

FIG. 32A is a perspective view of a double hole right-handed securing bracket 315B. The double hole left handed securing bracket 315B is made from approximately ¼ inch metal stalk and has four bends. The bracket 315B is for securing to the small tub 16A, the small tub 16A being approximately 14 inches in diameter.

Figure 32B:
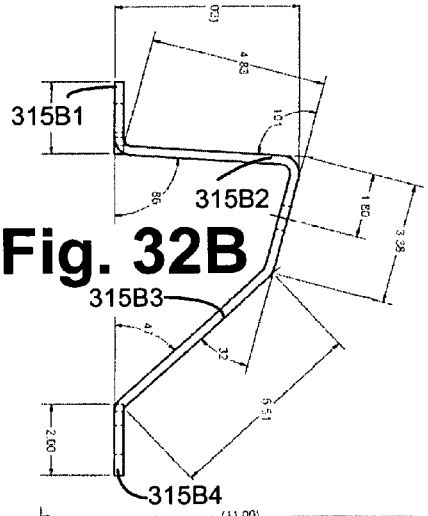
FIG. 32B is a top view of a double hole right-handed securing bracket.

FIG. 32B is a top view of a double hole right-handed securing bracket 315B. There are four sections to the bracket through 315B, a first section 315B1, a second section 315B2, a third section 315B3 and a fourth section 315B4. The first section 315B1 is approximately 2 inches long and houses two orifices, the orifices being separated by approximately 2 inches center to center. The first section, 315B1 makes an approximate 104° turn into section 315A2 which is approximately 4.8 inches long. Thereafter, section 315B2 continues and makes an approximate 80° turn and continues for about 3.4 inches. In the center of the 3.4 inches is a mounting hole. Section 315B2 then merges into 315B3 which is approximately 32 from section 315A2 and is approximately 5.5 inches. Thereafter section 315B3 merges into section 315B4 by turning approximately 130-degree turn relative to section 315B3. Section 315B4 is approximately 2 inches long and houses two orifices. The sections 315B1 and 315B4 are mutually collinear to each other and contact the sides of the irregular pentagon and hexagon frames for insertion and securing of bolts 316 of aligned securing bracket orifices with either orifices 318A or 318B of the frame sides.

Figure 32C:
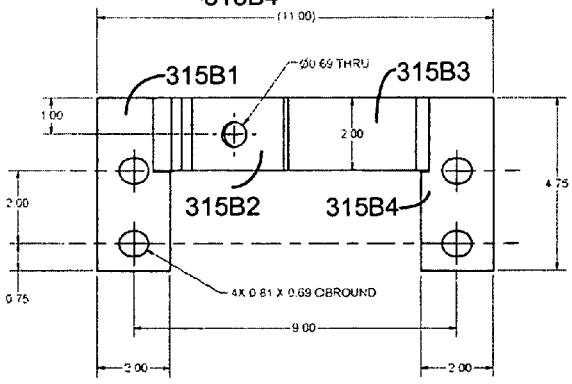
FIG. 32C is a side view of a double hole right-handed securing bracket.

FIG. 32C is a side view of a double hole right-handed securing bracket 315B. The side view shows the four sections, 315B1, B2, B3 and B4 in which the bracket has an approximate height of 4.75 inches, length of 11 inches. Two orifices for receiving bolts are shown in section 315B1 and the first orifice is approximately ¾ inch from the bottom of section 315B1 to the center of the first orifice, and the second orifice is approximately 2 inches above the first orifice. Each orifice is recessed approximately 1 inch on center from the side of section 315A1. Section 315A2 shows the position of the mounting orifice 79 and is approximately 1 inch from center from the top edge of section 315B2. Thereafter section 315B3 continues and merges into section 315B4 where a companion set of orifices similarly disposed as in section 315B1 are similarly disposed in section 315B4. The inter-orifice distance between the orifices in section 315B1 and the orifices in section 315B4 is approximately 9 inches.

Figure 33A:
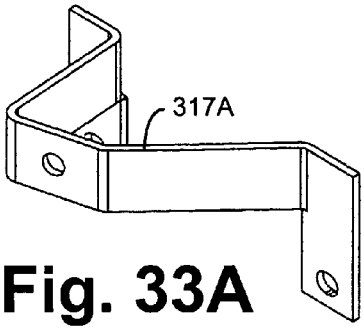
FIG. 33A is a perspective view of a single hole left-handed securing bracket.

FIG. 33A is a perspective view of a single-hole left-handed securing bracket 317A. FIG. 33A is a perspective view of a single hole, left handed securing bracket. The double hole left handed securing bracket 317A is made from approximately ¼ inch metal stalk and has four bends.

Figure 33B:
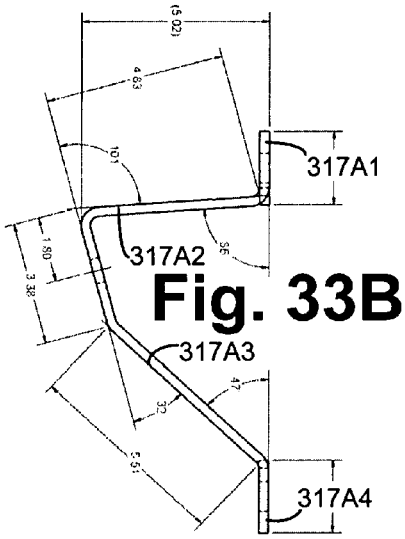
FIG. 33B is a top view of a single hole left-handed securing bracket.

FIG. 33B is a top view of a single-hole left-handed securing bracket 317A. There are four sections to the bracket through 317A, a first section 317A1, a second section 317A2, a third section 317A3 and a fourth section 317A4. The geometry of the single-hole left-handed securing bracket 317A is the same as the double-hole left handed securing bracket 315A except that there is only one orifice in the first section 317A1 and one orifice in the second section 317A4.

Figure 33C:
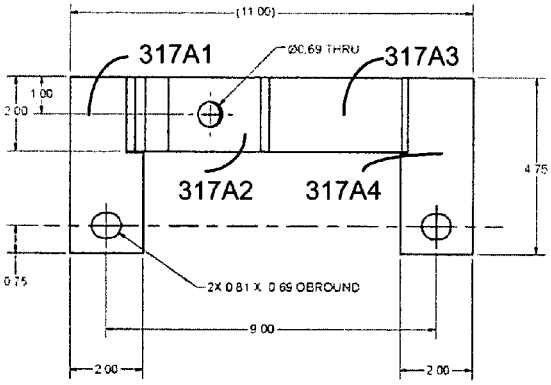
FIG. 33C is a side view of a single hole left-handed securing bracket.

FIG. 33C is a side view of a single-hole left-handed securing bracket 317A. The geometry of the single-hole left-handed securing bracket 317A is the same as the double-hole left handed securing bracket 315A except that there is one orifice in the first section 317A1 and one orifice in the second section 317A4.

Figure 34A:
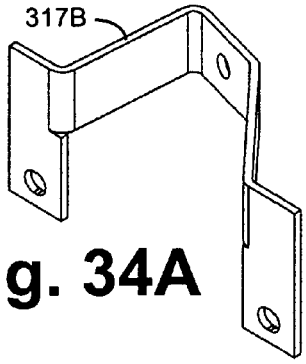
FIG. 34A is a perspective view of a single hole right-handed securing bracket.

FIG. 34A is a perspective view of a single-hole right-handed securing bracket 317B. The double hole left handed securing bracket 317B is made from approximately ¼ inch metal stalk and has four bends.

Figure 34B:
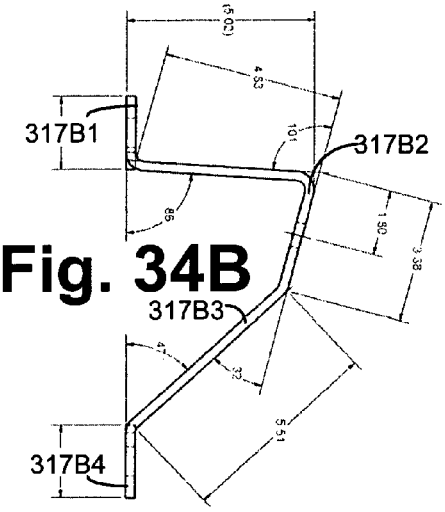
FIG. 34B is a top view of a single hole right-handed securing bracket.

FIG. 34B is a top view of a single-hole right-handed securing bracket. There are four sections to the bracket through 317B, a first section 317B1, a second section 317B2, a third section 317B3 and a fourth section 317B4. The geometry of the single-hole right-handed securing bracket 317B is the same as the double-hole right-handed securing bracket 315B except that there is only one orifice in the first section 317B1 and one orifice in the second section 317B4.

Figure 34C:
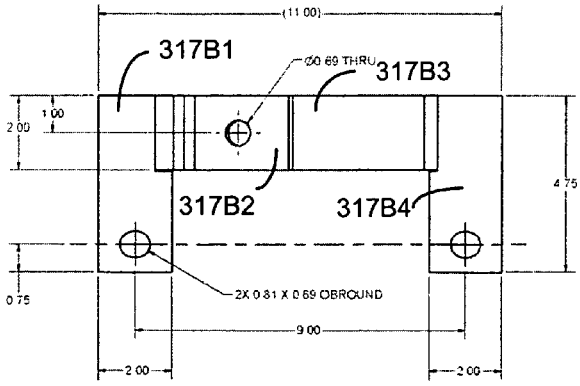
FIG. 34C is a side view of a single hole right-handed securing bracket.

FIG. 34C is a side view of a single-hole right-handed securing bracket 317B. The geometry of the single-hole right-handed securing bracket 317B is the same as the double-hole right-handed securing bracket 315B except that there is only one orifice in the first section 317B1 and one orifice in the second section 317B4.

Comparable bracket configurations but proportionately smaller for securing the large tub 16 of approximately 18 inch diameter to the frames is achieved by left and right handed double-hole versions of securing brackets 615A and 615B, as well as single-hole equivalents.

Figure 35:
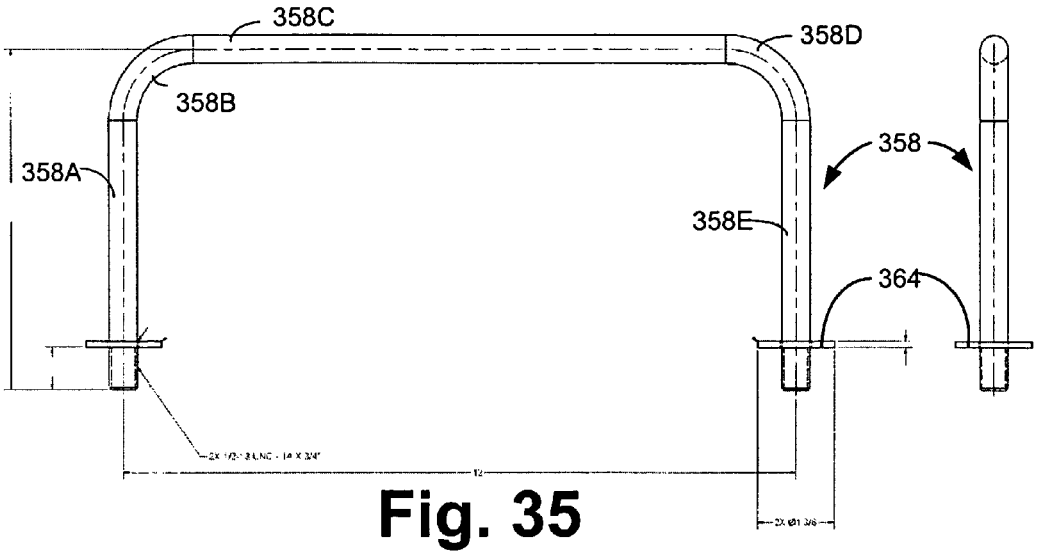
FIG. 35 is a top and side view of a large concrete anchor.

FIG. 35 is a top view and side view of a large concrete anchor 358. The large concrete anchor 358 is made from ¾ inch thick bars and is approximately 6 inches wide and 12 inches long. The small concrete anchor 358 has a first section 358A, the section 358 being linear, a second section 358B, the second section 358B being curved, a third section 358C, the third section 358C being linear and approximately 90 degrees disposed from the first section 358A, a fourth section 358D, the fourth section being curved, and a fifth section 358E, the fifth section being linear and 90 degree disposed to the third section 358B and parallel to the first section 358A. Recessed approximately ¾ inch from each end is an anchor collar 364 located in the first and fifth sections 358A and 358B. The anchor is approximately ⅛ inch thick and 13⅜ inches wide. The anchor collar secures to either the first or second orifices 318A and 318B of the frame sides having an inter-orifice distance of 12 inches.

Figure 36:
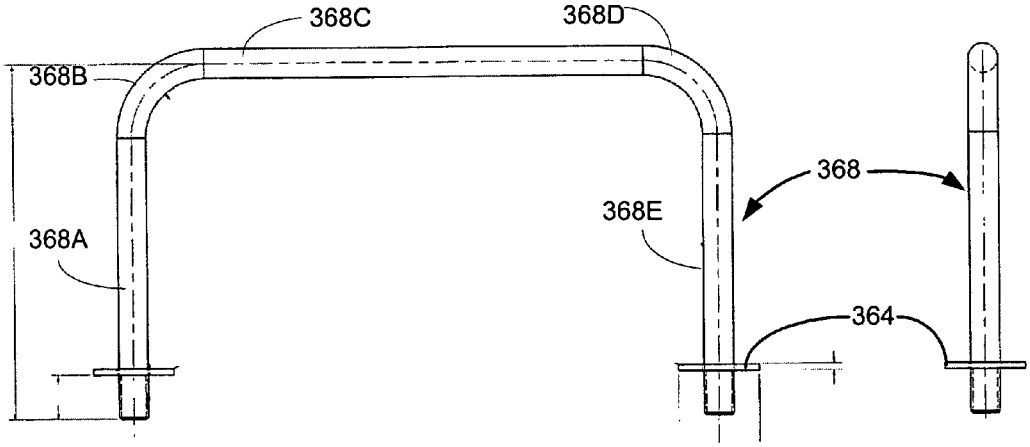
FIG. 36 is a top view and side view of a small concrete anchor.

FIG. 36 is a top view and side view of a small concrete anchor 368. The large concrete anchor 368 is made from ¾ inch thick bars and is approximately 6 inches wide and 10 inches long. The small concrete anchor 368 has a first section 368A, the section 368 being linear, a second section 368B, the second section 368B being curved, a third section 368C, the third section 368C being linear and approximately 90 degrees disposed from the first section 368A, a fourth section 368D, the fourth section being curved, and a fifth section 368E, the fifth section being linear and 90 degree disposed to the third section 368B and parallel to the first section 368A. Recessed approximately ¾ inch from each end is an anchor collar 364 located in the first and fifth sections 368A and 368B. The anchor is approximately ⅛ inch thick and 13⅜ inches wide. The anchor collar secures to either the first or second orifices 318A and 318B of the frame sides having an inter-orifice distance of 10 inches.

Figure 37B:
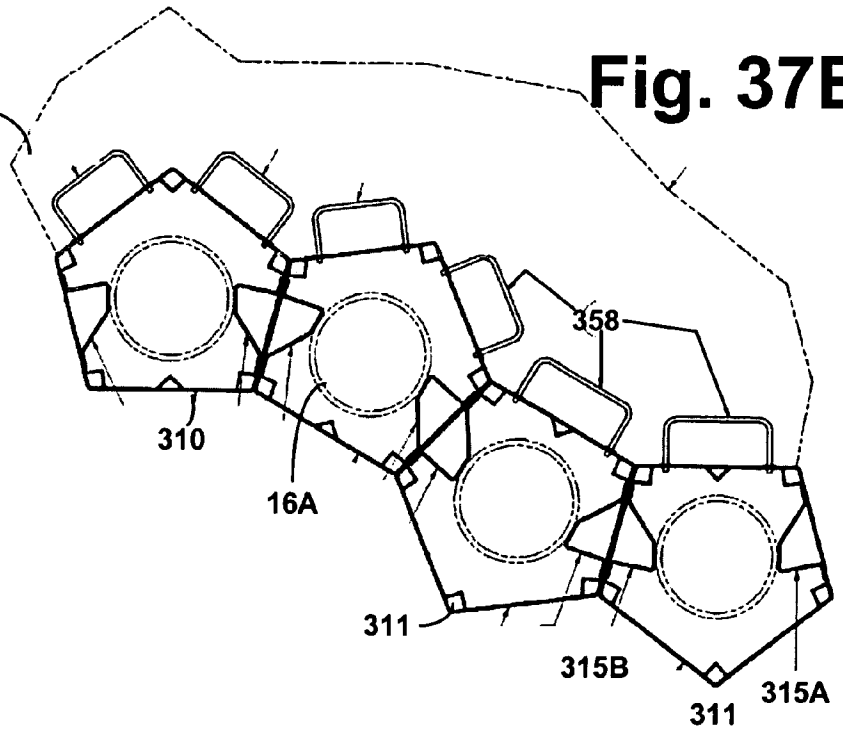
FIG. 37B is a top view of a linear array of connected columbarium units.
Figure 37A:
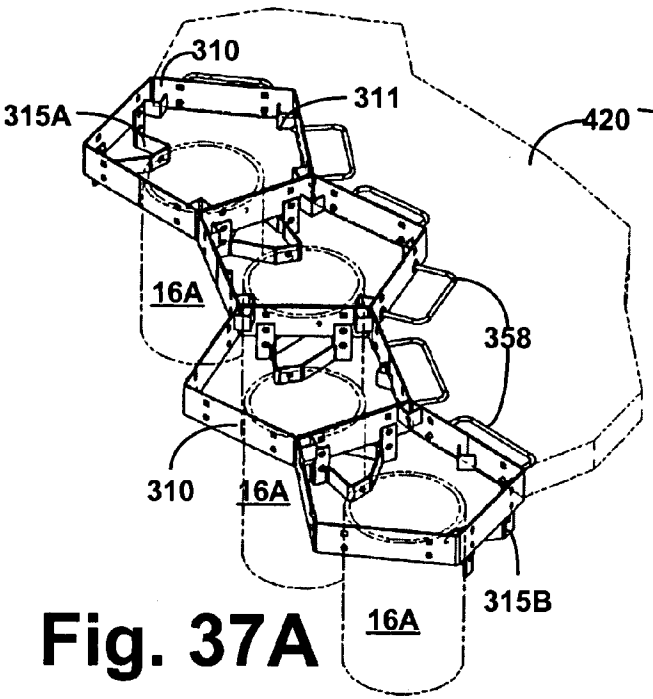
FIG. 37A is a perspective view of a linear array of connected columbarium units.

FIG. 37A is a perspective view of a linear array of connected columbarium units. Here the linear array is depicted as four connected columbarium units, where the connection is between each frame 310 bolted together and the large anchor handles 358 are shown immobilized in a concrete field 420. Each columbarium unit is attached to a small tub 16A through the first and second securing brackets 315A and 315B. Though the linear array of columbarium units are depicted as attached to the small tub 16A, the connected columbarium units in the linear array may be attached to the large tub 16 via the first and second supporting brackets, 317A and 317B. Furthermore, the linear array may be attached to alternating small tub 16A and large tub 16 in any numerical configuration.

FIG. 37B is a top view of a linear array of connected columbarium units. The connected columbarium units are shown connecting a series of small tubs 16A. Similarly the large anchor 358 is shown on one side of the array and immobilized in the concrete field 420.

Figure 37C:
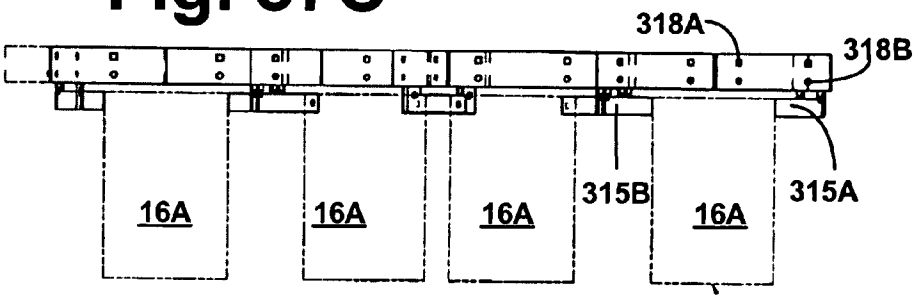
FIG. 37C is a side view of a linear array of connected columbarium units.

FIG. 37C is a side view of a linear array of connected columbarium units. The columbarium units are shown connected as a linear chain about a series of pentagon frames 310 and connected to the small tub 16A via the first and second securing brackets 135A and 315B.

Figure 38B:
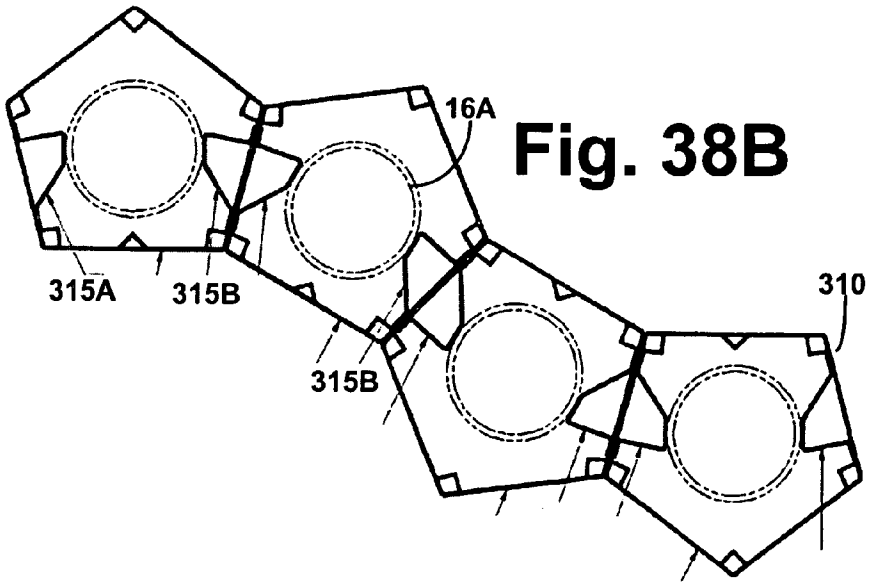
FIG. 38B is a top view of a linear stepped array of connected columbarium units.
Figure 38C:
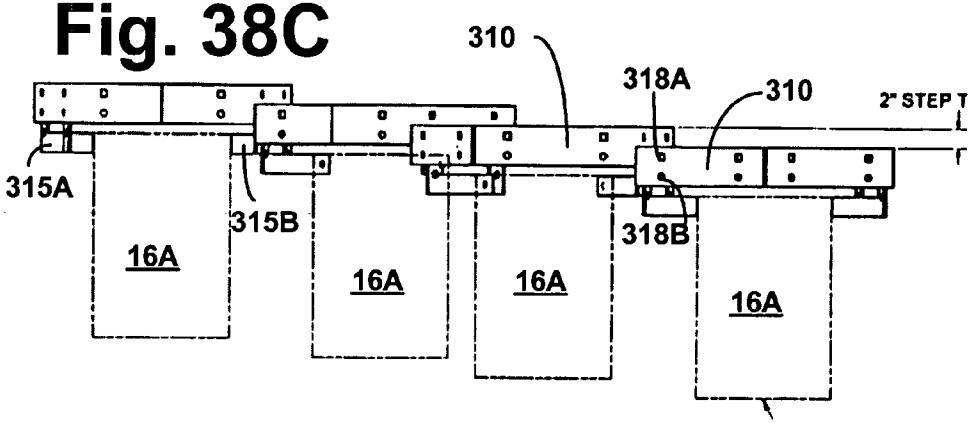
FIG. 38C is a side view of a linear stepped array of connected columbarium units.
Figure 38A:
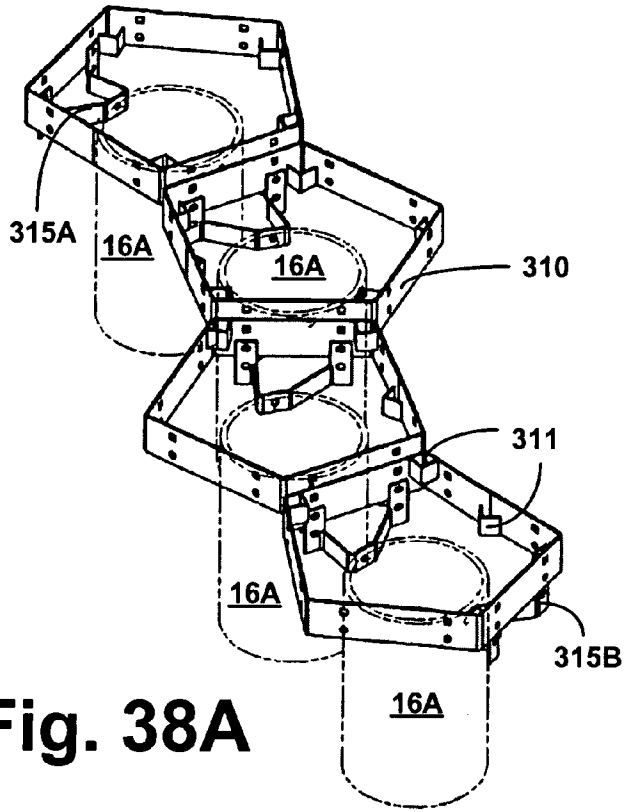
FIG. 38A is a perspective view of a linear stepped array of connected columbarium units.

FIG. 38A is a perspective view of a linear stepped array of connected columbarium units. The linear connected stepped array is a chain of columbarium units connected via the regular pentagon frame 310 but which the units are stepped down and connected between adjacent first orifices and second orifices 318A and 318B. The linear stepped array is shown over the small columbarium unit 16A and in this figure is not immersed in a concrete field.

FIG. 38B is a top view of a linear stepped array of connected columbarium pod units. The connected array is depicted as a chain of alternating columbarium units connected along each frame 310. The tub, as shown, is the small tub 16A.

FIG. 38C is a side view of a linear stepped array of connected columbarium pod units. Here the stepped array over the small tub 16A is clearly shown where the first securing orifices 318A are stepped approximately down 2 inches to the second secured orifices 318B and the stepwise pattern is clearly shown. The small tub 16A is shown secured to each respective frame 310. The first and second securing brackets 315A and 315B.

Figure 39B:
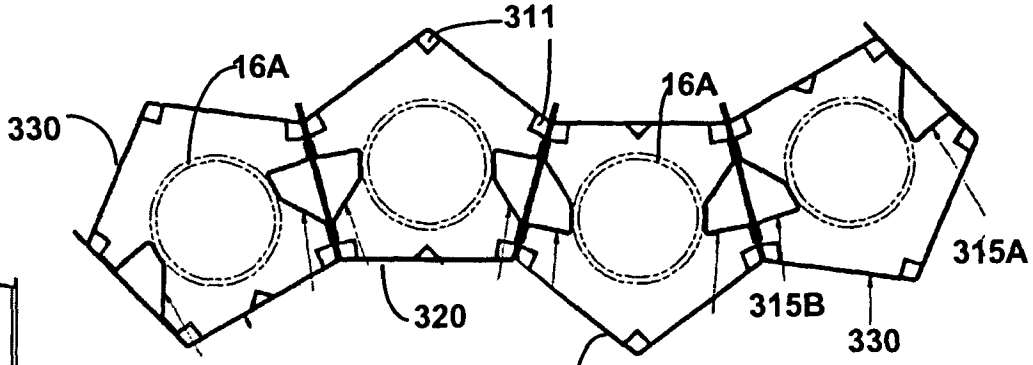
FIG. 39B is a top view of a linear array of connected columbarium units using a pentagon frame with adjacent extended large sides.
Figure 39C:
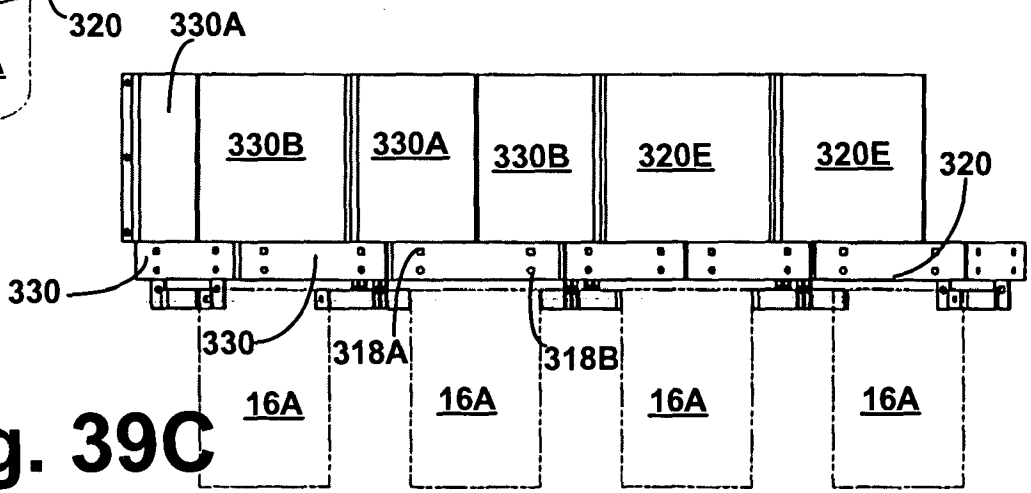
FIG. 39C is a side view of a linear array of connected columbarium units using a pentagon frame with adjacent extended large sides.
Figure 39A:
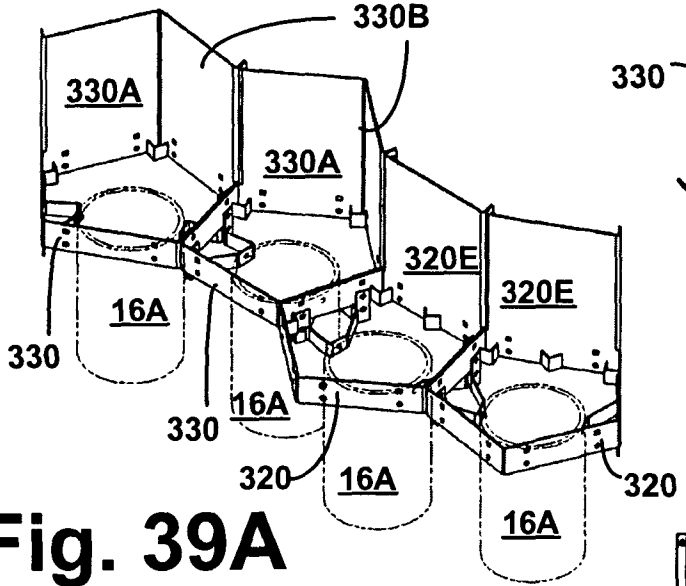
FIG. 39A is a perspective view of a linear array of connected columbarium units using a pentagon frame with adjacent extended large sides.

FIG. 39A is a perspective view of a linear array of connected columbarium units using a pentagon frame with adjacent extended large sides. The linear array is depicted showing each hexagon frame 330 attached to the small tub 16A via the first and second securing brackets 315A and 315B. As shown, the array presents a wall of alternating sides, 330A, 330B along the length of the array, which serves to be useful in securing a stepped columbarium pod array in the hillside of the cemetery. As with the previous linear array, the array may also alternate between a large tub 16 and a small tub 16A. Each extended side 330A through 330B are connected by the securing through bolts through the mating flanges of each 350B side to the adjacent 330A side by bolts securing through the aligned orifices of each flange.

The array is a combination of frames 330 and 320, where frame 330 has two extended sides, 330A and 330B which are hooked together through aligned securing orifices of the extended sides 330A that registers with the orifices of the flange or 330B. Then the flanges of 330B are mated with the orifices of the flange the extended side of an adjacent frame 320E. As shown a four unit array is made of two hexagon frames hooked together with two extended sides followed by two hexagon frames 320 with one extended side and bolted together accordingly.

FIG. 39B is a top view of a linear array of connected columbarium units using a pentagon frame with adjacent extended large sides. Here the array is shown connected to the small tub 16A via the first and second securing brackets 315A and 315B.

FIG. 39C is a side view of a linear array of connected columbarium units using a pentagon frame with adjacent extended large sides. The four-unit columbarium pod array is shown in a non-staggered format in which it is more clearly seen how the extended sides 330B, 330A and 320E are hooked together via each respective pentagon frames 330 and 320. The first and second securing brackets 315A and 315B are secure the frame to a small tub 16A.

FIG. 40A is a perspective view of a curved and stepped array of connected columbarium units using a hexagon frame with slanted sides. Here the small stone 12 is shown placed over the large columbarium pod 16 and is within the irregular hexagon frame 350 with slanted sides.

FIG. 40B is a side view of a curved and stepped array of connected columbarium units using a hexagon frame with slanted sides. Three of the columbarium units of the eight chain columbarium unit array is shown, inside view, in which a similar stepped pattern of the irregular hexagon frame 350 is shown staggered between the first orifice set 318A and the second orifice set 318B each large tub 16 is secured to the hexagon 350 via the first and second securing brackets 317A and 317B. The stepped array as depicted in FIGS. 40A and 40B is suitable for gradually sloping terrains.

Figure 41:
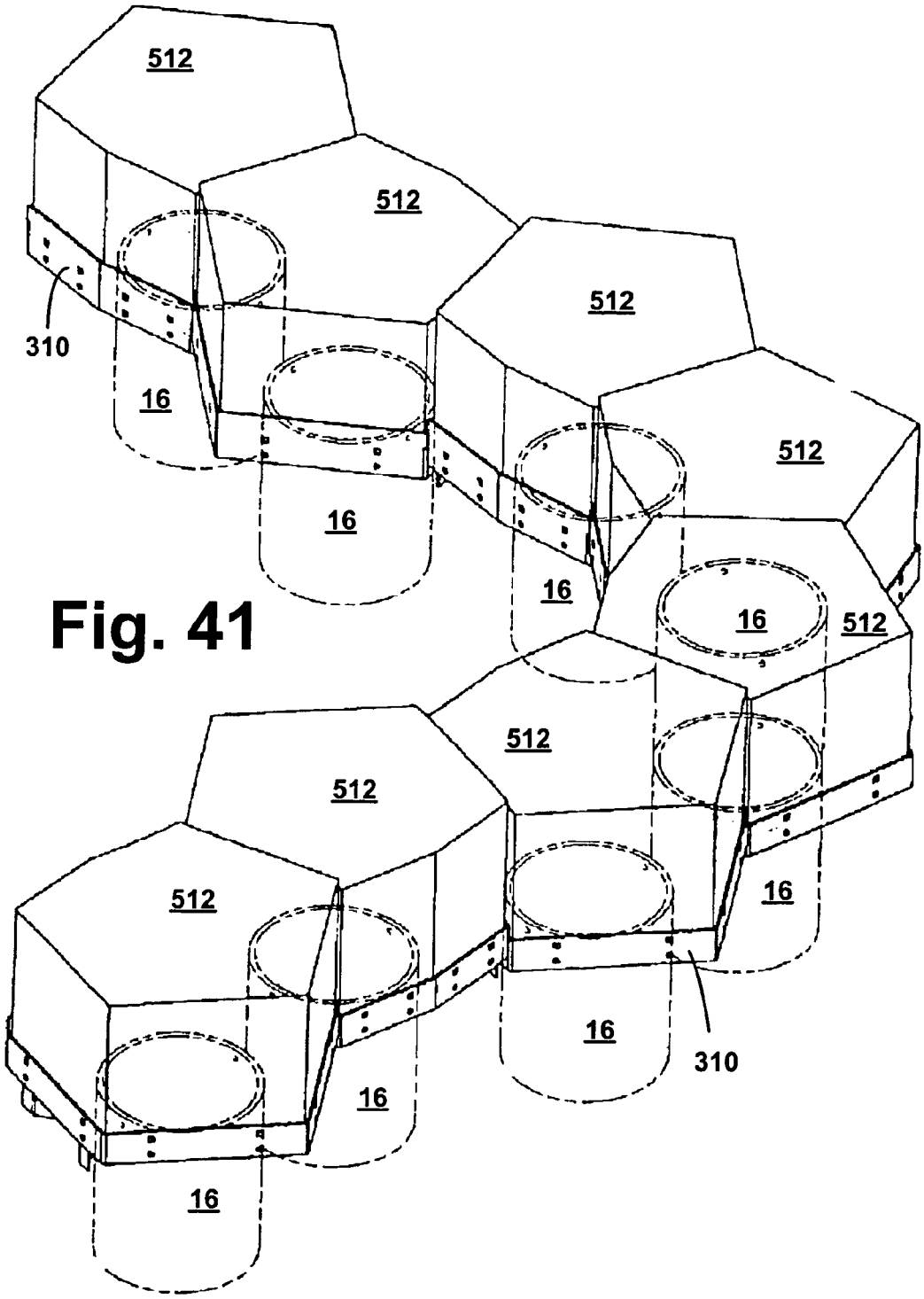
FIG. 41 is a perspective view of a curved and stepped array of connected columbarium units using a hexagon frame and large stones.

FIG. 41 is a perspective view of a curved and stepped array of connected columbarium units using a hexagon frame and large stones. The curved and stepped array utilizes irregular hexagon frame 310 staggered between adjacent columbarium pod units. The frame 310 holds the large stone 512 and the large stone 512 is placed over the large tub 16. Such an array provides a wall that is suitable against the beginning regions of stepped terrains and may make a series of stabilizing plateaus.

Figure 42:
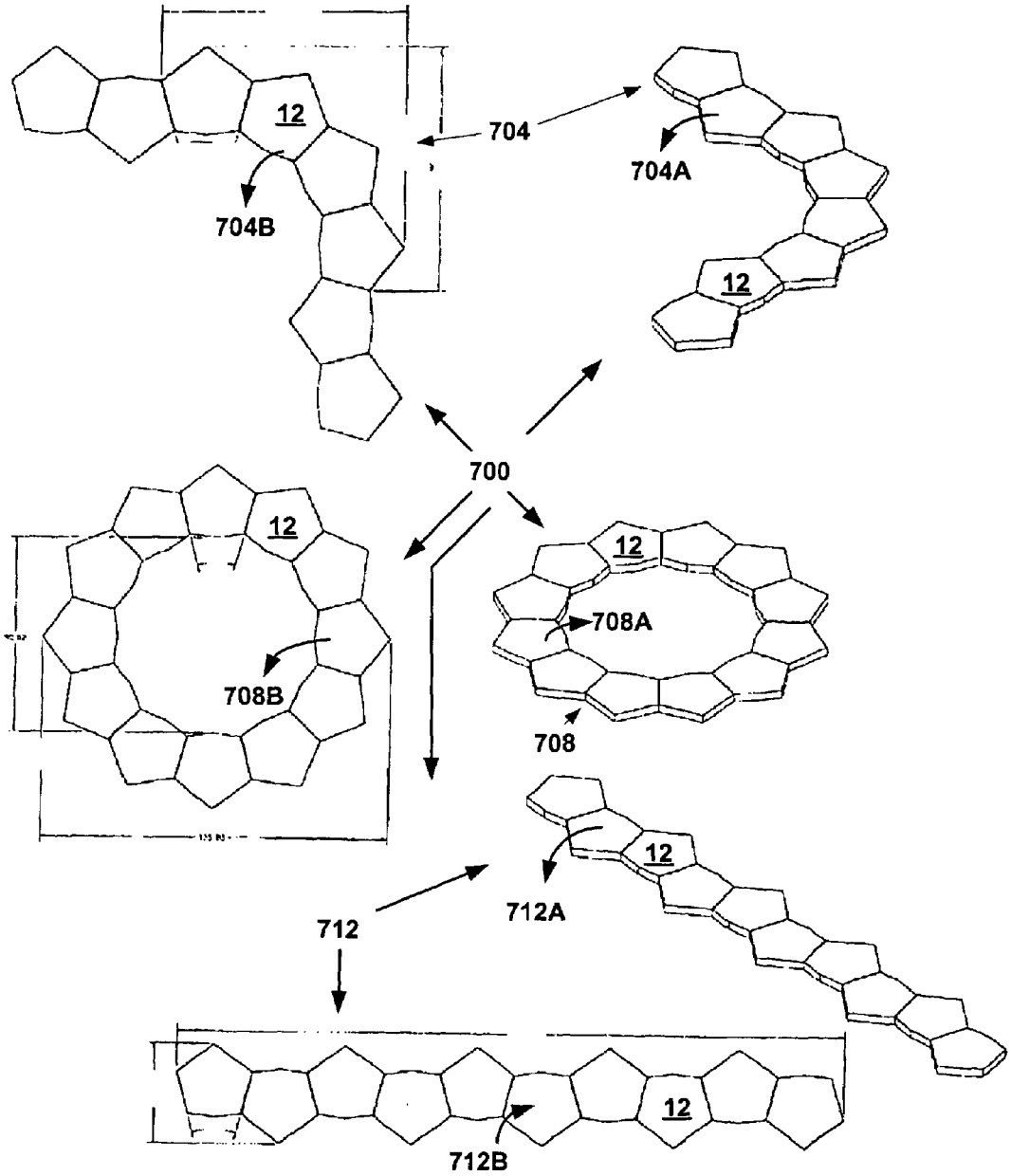
FIG. 42 presents perspective and top views of columbarium arrays using irregular hexagon stones.

FIG. 42 presents perspective and top views of columbarium arrays using irregular hexagon stones. The arrays 700 are illustrated in multiple forms and presents the arrays using the small stone 12. A curved array 704A is shown in perspective view and the same curved array 704 is shown in top view in array 704B. The curved array is close to a 90° turn. Array 708 is shown in perspective view as 708A and in top view in 708B. Here the array is a closed circle. Array 712 is presented in perspective view in 712A and is substantially linear. The top view of the array 712 is shown as a straight array. The arrays depicted for 700 may also use the large stone 512, or combinations of the large stone 512 with the small stone 12 and in combinations using the frames 310, 320, 330, 340 and 350.

Procedure for Casting Concrete Stones in the Small or Large Molds

Referring to the small stone mold 402, the procedure begins with securing the bottom plate 436 using the plurality of first clamping devices 440 engaged against the second flange 414B of the small articulated side 414 previously clamped shut using the second clamping device 442. Concrete is poured in and the texture liner 408 is placed over the poured concrete, and the mold spacer 462 is placed over the texture liner 408. The top plate is positioned over the concrete and the first flange 414A of the articulated side 414. The cement is allowed to cure.

After curing, the small stone mold 402 is pivoted upside down about the handles 426 and each first clamping device 440 is loosened to permit the removal of the bottom plate 436. The bolts 416 are removed and the second clamping device is loosened to permit opening of the articulated side 414 about the hinges 418 and removal of the articulated side 414 to reveal the cured cement now taken on the shape of the small stone 12. The small stone 12 is removed by pivoting the small stone mold 12 about the stone handles 426 to urge the small stone 12 from the top plate 406. The top plate 406 is removed to reveal the top surface of the small stone 12 having a texturized pattern as pressed in by the texture liner 408. An eyebolt 90 may then be inserted into the stone 12 to apply a lifting apparatus to position the stone 12.

An equivalent procedure for casting the large stone 512 is performed using the large stone mold 502 assembly.

Cremation Urn and Relic Container Location System

A pod depth number and a pod capacity number identify containers stacked within the pod 18, where the depth number is expressed as a numerator and the capacity number as a denominator. Thus for a pod that is long enough to hold four containers, the depth number is assigned 1 for a bottom position, 2 for the second position above the bottom position, 3 for the third position above the second position, and 4 for the fourth and topmost container within the pod 18. The capacity number is the last and topmost container number that can be located within the pod 18. If a pod is designed to hold only one container, then the pod depth number equals the pod capacity number, both number being 1 for a single container holding pod.

Expressed as pod depth number-to-pod capacity number ratios, for example, of a first lowermost container, a single container holding pod is 1/1, a two container holding pod is 1/2, a three container holding pod is 1/3, a four container holding pod is 1/4, and so on. For a second container, the pod depth number-to-pod capacity number ratios would be 2/2 for a two container holding pod, 2/3 for a three container holding pod, 2/4 of a four container holding pod, and so on.

The identification and mapping system utilizes a container depth and capacity level number, the tub locator 40, the pod numbers, the pod locator 28, and the mapping locator 13 can in landmark-based and coordinate-based reference systems. In landmark-based systems, a rock outcropping or a garden serves as landmarks to which the stone 12 is mapped and identified.

For example, say locator 13 is inscribed with number "946" of a stone 12 located by the rock outcropping. Then a mapping entry to describe the location of the cremated remains of a "John Doe" located in pod number 5 at the lowest level, a relic of John Doe is in the second container above the first container, the cremated remains of a "Jane Doe" is located in the third container above the second container, and memorial materials for Jane Doe are located in the fourth and topmost container of three, the mapping entry is expressed in a landmark numerical array that reads:

| Name/Relic | Landmark | Stone # | Pod # | Depth #/Capacity # |
|---|---|---|---|---|
| John Doe | Rock Outcropping | 946 | 5 | 1/4 |
| John Doe: Relic | Rock Outcropping | 946 | 5 | 2/4 |
| Jane Doe | Rock Outcropping | 946 | 5 | 3/4 |
| Jane Doe: memorial materials | Rock Outcropping | 946 | 5 | 4/4 |

Similarly, local street maps and geographic descriptions serve as part of coordinate-based reference systems. In the above example, say stone # 946 is located at 14E and 15N of a known meets-and-bounds legal description of a cemetery. The mapping entry is expressed in a property description numerical array that reads:

| Name/Relic | Legal Description | Stone # | Pod # | Depth #/Capacity # |
|---|---|---|---|---|
| John Doe | 14E 15N | 946 | 5 | 1/4 |
| John Doe: Relic | 14E 15N | 946 | 5 | 2/4 |
| Jane Doe | 14E 15N | 946 | 5 | 3/4 |
| Jane Doe: memorial materials | 14E 15N | 946 | 5 | 4/4 |

The geographic descriptions may also be in terms of GPS data.

While the preferred embodiments of the invention has been illustrated and described, as noted above, many changes can be made without departing from the spirit and scope of the invention. For example, the pods and the tubs that hold them may be hexagonal, pentagonal, or other polygon shaped. Tubs larger than 18 inches diameter may be made to hold more than seven pods, and the depth of the tubs may vary to accommodate short pods or pods significantly longer to accommodate more than three cremation urns. The number of memorial plaques is in proportion to the number of pods, and inscriptions within the memorial plaques may be varied in any angular orientations between 0 and 360 degrees. If desired, the memorial plaques may be mounted within in any angular orientation between 0 and 360 degrees. The frames holding the covers of the columbarium burial systems may be constructed with metals having thicknesses greater or less than ¼ inch stocks, as long as each frame is sufficiently strong to secure the tubs, hold the covers, and interlink to other frames. Furthermore, the frames may be made of durable materials other than metal to accomplish the required securing and linking tasks. The securing brackets between the frames and the tubs may also be made of durable non-metal materials and be greater or less than ¼ inch thick (metals and durable non-metals) as long as the securing requirements are met. The frames, brackets, pads, and covers adjust in dimension to the changes in dimensions of the tubs to be secured and buried. Accordingly, the scope of the invention is not limited by the disclosure of the preferred embodiment.

I claim:

1. A burial system for interring remains comprising:

a cover;

a tub adjacent to the cover and configured to receive a removable lid, the tub being adapted to be at least proximate to the ground;

a ballast control positioned within the tub and in fluid communication with the groundwater within the ground and operable to alter a fluid volume within the tub resulting from the infiltration of the groundwater into the tub;

at least one pod located inside the tub, the at least one pod having a removable top and having an interior region; and at least one container located within the interior region for holding the remains.

2. The system of claim 1, wherein the cover is comprised of at least one of natural stone and concrete.

3. The system of claim 1, wherein the container is configured to receive at least one of cremation remains, relics, and memorial materials.

4. The system of claim 1, wherein the cover includes a plurality of sides and further includes a polygonal shape wherein alignment of the cover's sides with the corresponding sides of other similarly shaped covers permits the formation of a cover arrangement having at least one of a linear, curved, circular, and serpentine array.

5. The system of claim 4, wherein the cover comprises four major sides of approximately equal length and two minor sides of approximately equal length, the minor sides being about half the length of the major side, and wherein the four major sides includes a first major side and a second major side, the first major side and the second major side defining a first includes angle of approximately 105 degrees;

a third major side and a fourth major side, the third major side defining a second included angle of approximately 112 degrees with the first major side, and the fourth major side defining a third included angle of approximately 112 degrees with the second major side; and wherein the two minor sides include a fifth minor side and a sixth minor side, the fifth minor side defining a fourth included angle of approximately 112 degrees with the third major side, and the sixth minor side defining a sixth included angle of approximately 112 degrees with the fourth major side, and the fifth minor side defining a seventh included angle of approximately 165 degrees with the sixth minor side.

6. The system of claim 1, wherein the tub further includes a stabilizer to secure the at least one pod within the tub.

7. The system of claim 6, wherein the stabilizer includes markings to assist locating the at least one pod within the tub.

8. The system of claim 6, wherein each pod comprises an elongated, substantially cylindrically-shaped interior region.

9. The system of claim 1, wherein the ballast control includes an inlet aperture disposed therethrough, further comprising a conduit positioned within an interior region of the tub and fluidly communicating with the inlet aperture, the conduit having at least one exit aperture disposed therethrough in fluid communication with the interior region of the tub.

10. The system of claim 1, further comprising a bracing device coupled to the tub with at least one bolt and to the lid with at least one mounting screw.

11. The system of claim 10, wherein the bracing device includes a first member coupled to the tub and a second member coupled to the lid, the first and second members being hingeably coupled such that the lid may be hingeably removed from the tub.

12. The system of claim 10, wherein the bracing device is asymmetrically coupled to the tub.

13. The system of claim 1, wherein the cover includes an attachment member adapted to facilitate removal of the cover from the lid.

14. The system of claim 1, wherein the door member includes a receptacle adapted to receive a vase.

15. A columbarium pod burial system, comprising:

a tub with a removable lid;

a pod located inside the tub, the pod having a removable top and configured to hold at least one container;

a water ballast located inside the tub; and a stone having a memorial plaque, whereby the tub is buried overlaid by the removable lid and stone and kept to a stable position by the water ballast under a variety of groundwater conditions.

16. The system of claim 15, wherein the pod is substantially cylindrical shaped.

17. The system of claim 15, wherein the container is configured to receive cremation remains, relics, and memorial materials.

18. The system of claim 15, wherein the stone has a plurality of polygon shapes including a regular pentagon, an irregular pentagon, a regular hexagon, an irregular hexagon, a square, a rectangle, and a triangle.

19. The system of claim 18, wherein the irregular hexagon comprises four major sides of approximately equal length and two minor sides of approximately equal length, the minor sides being about half the length of the major side, and further described as a first major side and a second major side, the first side and the second side having an angle of approximately 105 degrees;

a third major side and a fourth major side, the third side having an angle of approximately 112 degrees with the first side, and the fourth side having an angle of approximately 112 degrees with the second side; and a fifth minor side and a sixth minor side, the fifth side having an angle of approximately 112 degrees with the third side, and the sixth side having an angle of approximately 112 degrees with the fourth side, and the fifth side having an angle of approximately 165 degrees with the sixth side.

20. The system of claim 15, wherein the water ballast includes a pipe substantially parallel with the pod and attached with the bottom of the tub, the pipe having a hole placed along the length of the pipe at a distance from the bottom of the tub, whereby accumulating ground is retained in the tub at a height approximately equivalent to the distance from the bottom of the tub.

21. A columbarium pod burial system, comprising:

a tub having removable lid;

at least one pod positionable within the tub, the at least one pod having a removable top;

a first plurality of containers configured to hold cremated remains that are positionable within the at least one pod;

a second plurality of containers configured to hold relics that are positionable within the at least one pod;

a water ballast located inside the tub and operable to prevent displacement of the tub when the tub is exposed to groundwater;

a container mapping system operable to determine a container location; and a stone removably placed over the lid, the stone having a plurality of memorial plaques and a mapping locator.

22. The system of claim 21, wherein the at least one pod includes a plurality of tubes, each tube configured to hold the first and second plurality of containers.

23. The system of claim 21, wherein the container mapping system includes a tub reference mark located on the inside of the tub and a pod stabilizer, the pod stabilizer having an indicator, whereby placement of the pod stabilizer aligns the indicator with the reference mark and registers the location of the pods with the tub.

24. The system of claim 21, wherein the stone has a plurality of polygon shapes including a regular pentagon, an irregular pentagon, a regular hexagon, an irregular hexagon, a square, a rectangle, and a triangle.

25. The system of claim 24, wherein the irregular hexagon comprises four major sides of approximately equal length and two minor sides of approximately equal length, the minor sides being about half the length of the major side, and further described as a first major side and a second major side, the first side and the second side having an angle of approximately 105 degrees;

a third major side and a fourth major side, the third side having an angle of approximately 112 degrees with the first side, and the fourth side having an angle of approximately 112 degrees with the second side; and a fifth minor side and a sixth minor side, the fifth side having an angle of approximately 112 degrees with the third side, and the sixth side having an angle of approximately 112 degrees with the fourth side, and the fifth side having an angle of approximately 165 degrees with the sixth side.

26. The system of claim 21, wherein the stone is attached with the tub to prevent the slippage of the stone on hilly terrains.

27. The system of claim 21, wherein the container mapping locator includes a landmark numerical array and a property description numerical array.

28. The system of claim 27, wherein the landmark numerical array includes a landmark descriptor, a stone number, a pod number, a container depth number, and a pod capacity number.

29. The system of claim 28, wherein the landmark numerical array includes a landmark descriptor, a stone number, a pod number, a container depth number, and a pod capacity number.

30. The system of claim 27, wherein the property description numerical array includes a geographic descriptor, a stone number, a pod number, a container depth number, and a pod capacity number.

31. The system of claim 30 wherein the geographic descriptor includes a geographic coordinate of a meets-and-bounds legal description and a geographic coordinate obtained from global positioning measurements.

32. A columbarium pod burial system, comprising:

a tub with a removable lid;

a pod located inside the tub, the pod having a removable top and configured to hold at least one container;

a water ballast located inside the tub;

a cover having a stone appearance; and a frame holding the cover, whereby the tub is buried overlaid by the removable lid and overlaid by the cover, the cover being kept to a stable position by the frame.

33. The system of claim 32, wherein the cover is made to have the stone appearance with a mold configured to impart the stone appearance onto the surface of the cover.

34. The system of claim 32, wherein the frame is a polygon having a plurality of shapes, each side of the polygon having orifices to receive bolts to connect to other frames.

35. The system of claim 34, wherein the polygon includes a triangle, a square, a diamond, a pentagon, and a hexagon.

36. The system of claim 34, wherein the frames are connected into a plurality of arrays, the arrays including a straight chain of frames, a staggered chain of frames, a curved chain of frames, a circular array of frames, and a stepped chain of frames.

37. The system of claim 36, wherein each frame holds the cover.

38. The system of claim 37, wherein the cover includes a plurality of sizes.

* * * * *